United States Patent [19]

Kluger et al.

[11] Patent Number: 4,992,204

[45] Date of Patent: Feb. 12, 1991

[54] IRRADIATION DETECTION AND IDENTIFICATION METHOD AND COMPOSITIONS USEFUL THEREIN

[75] Inventors: Edward W. Kluger, Pauline; Patrick D. Moore, Pacolet; John B. Hines; John G. Lever, both of Spartanburg, all of S.C.

[73] Assignee: Miliken Research Corporation, Spartanburg, S.C.

[21] Appl. No.: 397,079

[22] Filed: Aug. 22, 1989

[51] Int. Cl.[5] ..... C09K 11/02

[52] U.S. Cl. ..... 252/301.16; 8/403

[58] Field of Search ..... 252/301.16; 8/403

[56] References Cited

U.S. PATENT DOCUMENTS

| | | | |
|---|---|---|---|
| 4,167,510 | 9/1979 | Brendle | 8/403 |
| 4,284,729 | 8/1981 | Cross et al. | 521/158 |
| 4,400,320 | 8/1983 | Keller et al. | 8/403 |
| 4,451,530 | 5/1984 | Kaule et al. | 428/323 |
| 4,623,579 | 11/1986 | Quon | 428/215 |
| 4,640,690 | 2/1987 | Baumgartner et al. | 8/506 |
| 4,655,788 | 4/1987 | Jalon | 8/648 |

*Primary Examiner*—John F. Niebling
*Assistant Examiner*—Steven P. Marquis
*Attorney, Agent, or Firm*—Timothy J. Monahan; H. William Petry

[57] ABSTRACT

A method for tagging one or a mixture of natural or synthetic materials comprising contacting the same with one or a mixture of tagging compounds containing one or more non-ionic luminophore moieties attached to at least one poly(oxyalkylene) moiety by means of a linking moiety; wherein said tagging compound has substantial absorbance within the range of from about 300 to about 400 nm and reemits substantial visible light, said contacting effecting at least a temporary association between said material and said compound wherein said compound is present in an amount between about 0.0001 and about 10 percent by weight of said material.

35 Claims, No Drawings

IRRADIATION DETECTION AND IDENTIFICATION METHOD AND COMPOSITIONS USEFUL THEREIN

BACKGROUND OF THE INVENTION

1. Field of the Invention

The present invention relates to the method and compositions useful in the practice thereof, for treating or modifying bulk materials or formed articles such that they can be seen and identified under ultraviolet irradiation during their processing into other products including composites, manufactured articles, mixtures or the like, wherein the treating compositions can be made water dispersible such that they can be readily washed away from the products after the production operations have been performed, or wherein the compositions can be chemically tailored to be compatible with non-aqueous systems or materials such as various polymeric substrates, fuels, solvents, or the like.

Of particular concern is the use of the present method and compositions for visually inspecting formed articles such as different yarns, for any of a number of purposes hereinafter described, during processing of the yarns such as in the slashing, warping and weaving thereof into fabrics.

Another preferred embodiment of the invention is the use of the present method and compositions for visually inspecting compositions of polyurethane formed articles, thermoplastic formed articles, cured epoxy formed articles and silicone formed articles.

2. Description of the Prior Art

Heretofore, fluorescent materials have been employed in security paper or fibers or other materials whereby irradiation by selected wavelengths such as ultraviolet rays will cause emission of visible light for easy identification. Such technology is described in U.S. Pat. Nos. 4,655,788 and 4,451,530. The use of fluorescent materials such as organic dyes, permanently bound to yarn or the like for creating decorative effects or for use in security applications is disclosed in U.S. Pat. No. 4,623,579.

In the unrelated fields of the processing of formed articles such as fibers and yarns into fabric products, or the blending of particulate polymeric materials of different composition or color or the like, the use of fluorescent agents for the tracing or identification of the articles such as in monitoring the integrity of yarn or fiber during the slashing, warping or weaving operations would appear to have little if any use according to prior practices wherein the fluorescent material is permanently bound to the product, typically in an insoluble polymeric matrix. In this regard, the detection of broken yarn during such operations has been very difficult, particularly where close shades are being used and where the operator has to visually determine yarn fractures or other integrity problems.

OBJECTS OF THE INVENTION

A principal object therefore of the present invention is to provide a method and the materials for utilizing the same wherein the visual inspectability of bulk materials and formed articles during their further processing into products is greatly enhanced without requiring a permanent alteration of their appearance or properties.

SUMMARY OF THE INVENTION

The above and further objects hereinafter becoming evident have been attained in accordance with the present invention through the discovery of the method and compositions for utilizing the same, defined in its broad embodiment as a method for tagging one or a mixture of bulk materials or formed articles of natural or synthetic materials comprising contacting the same with one or a mixture of tagging compounds containing one or more non-ionic, luminophore moieties linked to at least one poly(oxyalkylene) moiety, wherein said tagging compound has a substantial absorbance within the range of from about 300 to about 400 nm and reemits substantial visible light and substantially said contacting affecting at least a temporary association between said materials or articles and compound, wherein said compound is present in an amount between about 0.001 and about 10 percent by weight of said materials or articles.

These and other objects hereinafter becoming evident have been attained in accordance with the present invention in which the non-ionic luminophore comprises one or more of each of the moieties consisting from 1,2-diarylethanes; 2-arylbenzazoles; 2(H)-1-benozpyran-2-ones (coumarins); 2(H)-1-benzopyrane-2-imines (iminocoumarins); carbostyrils; 3(H)-1-naphtho[2,1-b]pyran-3-ones; 3(H)-naphtho[2,1-b]pyran-3-imines; aminophthalimides; 1,8-naphthalenedicarboximides; 1,4,5,8-naphthalenetetracarboxylic acid diimides; 2,5-diarylthiophenes; 2,5-diarylfurans; 2,5-diaryl-1,3,4-thiadiazoles; 2,5-diaryl-1,3,4-oxadiazoles; 1,3-diphenyl-2-pyrazolines; 2-arylbenzofurans; 2,6-diphenylbenzodifurans; 2,2'-bis(5-phenyl-1,3,4-oxadiazoles); quinolines; quinoxalines; 3,4-diarylfuranones; distyrylarenes; 7(H)-benz[de]anthracene-7-ones(benzanthrones); polyarenes; wherein Y is a poly(oxyalkylene) moiety comprised of at least 50 mole percent of monomeric units or mixtures thereof of the formula (—RO—), wherein R is substituted or unsubstituted straight chain alkylenes of two to four carbons; wherein X linking moiety is selected from a covalent bond, —O—, —S—, —$SO_2$—, —CON($R_1$)—, —$SO_2$N($R_1$)—,—COO—, —N($R_2$)—, or 1,3,5-triazin-2,4-diylamino; wherein $R_1$ is selected from hydrogen, Y, unsubstituted or substituted alkyl; unsubstituted or substituted cycloalkyl; unsubstituted or substituted phenyl; wherein $R_2$ is $R_1$ or —$SO_2R_3$; wherein $R_3$ is selected from unsubstituted or substituted alkyl, cycloalkyl or phenyl.

The fluorescent compounds have the following general formulae:

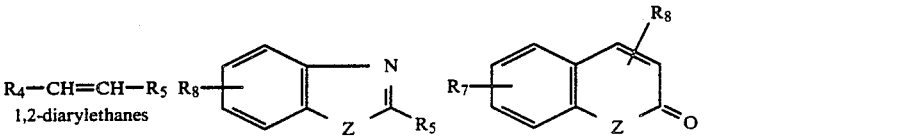

1,2-diarylethanes 2-arylbenzazoles

2(H)-1-benzopyran-2-ones

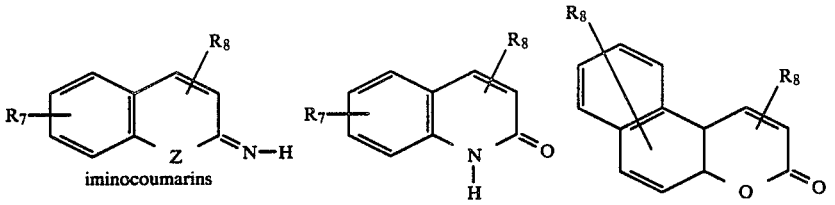

iminocoumarins carbostyrils

3(H)-naphtho[2,1-b]pyan-3-ones

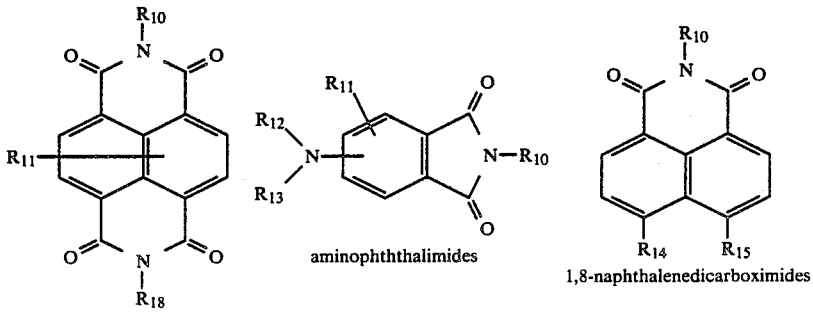

1,4,5,8-naphthalene-tetracarboxylic acid imide aminophththalimides 1,8-naphthalenedicarboximides

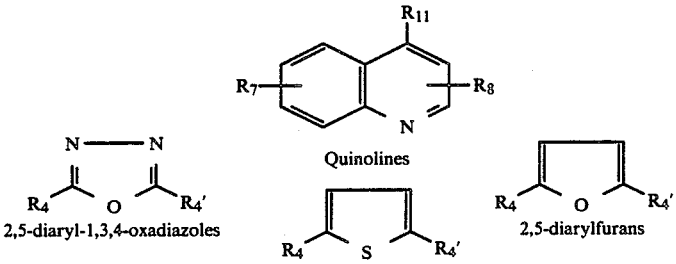

Quinolines 2,5-diaryl-1,3,4-oxadiazoles 2,5-diarylthiophenes 2,5-diarylfurans

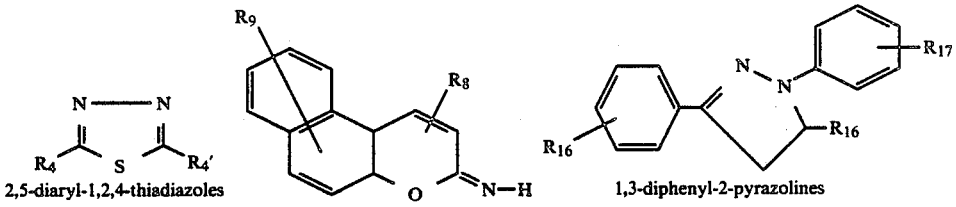

2,5-diaryl-1,2,4-thiadiazoles

3(H)-naphtho[2,1-b]pyran-3-imines 1,3-diphenyl-2-pyrazolines

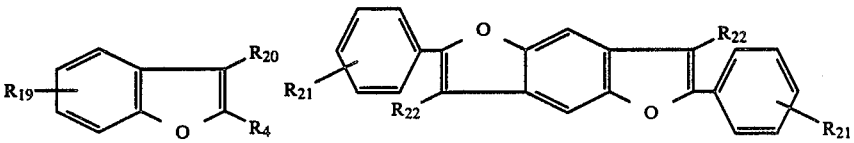

2-arylbenzofurans 2,6-diphenylbenzofurans

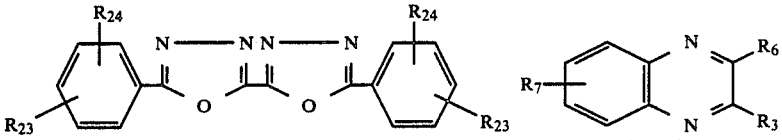

2,2'-bis(5-phenyl-1,3,4-oxadiazoles)

Quinoxalines

-continued $R_4$—CH=CH—$R_{25}$—CH=CH—$R_4$
distyrylarenes
$R_{28}$—Ar—$R_{28}$
polyarenes

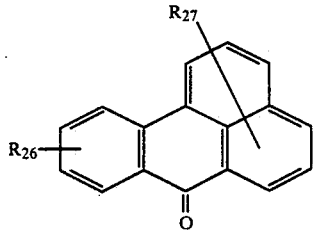

7(H)-benz[d,e]anthracen-7-ones wherein $R_4$ and $R_{4'}$ are independently selected from phenyl or phenyl substituted with one or more groups selected from lower alkyl, lower alkoxy, halogen, cyano, -X-Y, unsubstituted or substituted sulfamoyl, benzoxazol-2-yl, benzothiazol-2-yl, benzimidazol-2-yl, benzofuran-2-yl, isoxazol-2-yl, 1,2-benzisoxazol-3-yl, pyrazol-1-yl, 1,2,3-triazol-2-yl, 1,2,4-oxadiazol-5-yl, 1,3,4-oxadiazol-2-yl, 1,3,4-thiadiazol-2-yl, 1,2,4-thiadiazol-5-yl, 1,3,5-triazin-5-yl, 2(H)-tetrazol-5-yl, pyrimidin-2-yl, benzotriazol-2-yl, naphtho[1,2-d]triazol-2-yl, or trifluoromethyl; benzoxazol-2-yl; benzothiazol-2-yl; benzimidazol-2-yl; benzotriazol-2-yl; 1,3,4-oxadiazol-2-yl; 1,3,4-thiadiazol-2-yl and these azole moieties substituted with lower alkyl, lower alkoxy, phenyl, arylene-X-Y, -O-arylene-X-Y, -X-Y, lower alkylthio, cyano, carboxylate ester, unsubstituted or substituted carbamoyl, benzoxazol-2-yl, benzothiazol-2-yl or 1,3,4-oxadiazol-2-yl; wherein $R_5$ is selected from the groups listed above for $R_4$ or an optionally substituted electron rich aryl moiety derived from anilines, 1,2,3,4-tetrahydroquinolines, 3,4,-dihydro-2(H)-1,4,-benzoxazines, 2,3-dihydroindoles, naphthylamines, 2aminothiazoles, carbazoles, indoles, phenoxazines, phenothiazines, thiophenes, furans, julolidines, 2,3,3,-trimethylindolenines, diphenylamines, 3cyano-2,6-diamino-4-methylpyridines, pyrazoles, pyrroles, oxybenzenes, thiobenzenes or oxynaphthalenes; wherein $R_6$ is selected from hydrogen, -X-Y, alkylene-X-Y, alkylene-X-Y, arylene-X-Y, -O-arylene-X-Y, lower alkyl, lower alkoxy, halogen, phenyl, cyano, carboxylate ester, unsubstituted or substituted carbamoyl, unsubstituted or substituted sulfamoyl, trifluoromethyl, alkylthio, alkylsulfonyl, benzoxazol-2-yl, benzothiazol-2-yl, 1,3,4-oxadiazol-2-yl; wherein Z is selected from -O-, -S-, $-SO_2-$, $-N(R_1)-$; wherein $R_7$ selected from -X-Y; hydrogen; hydroxy; hyroxyalkoxy; lower alkyl; lower alkoxy; amino; amino substituted optionally with alkyl, cycloalkyl, phenyl or 1,3,5-triazin-2-yl; 1,2,3-triazol-2-yl; benzoxazol-2-yl, benzotriazol-2-yl; pyrazol-1-yl; naphtho[1,2-d]triazol-2-yl; alkylene-X-Y; arylene-X-Y; -O-alkylene-X-Y or -O-arylene-X-Y; wherein $R_8$ is selected from hydrogen; -X-Y; lower alkyl; cyano; unsubstituted or substituted carbamoyl; unsubstituted or substituted sulfamoyl; alkylsulfonyl; arylsulfonyl; carboxylate ester; aryl moiety selected from phenyl, naphthyl, thienyl, furanyl, benzofuran-2-yl, benzoxazol-2-yl, benzothiazol-2-yl, benzimidazol-2-yl, 1,3,4-oxadiazol-2-yl, 1,3,4-thiadiazol-2-yl, and these aryl moieties substituted with -X-Y, lower alkyl, lower alkoxy, carboxylate ester, carbamoyl, phenyl, or halogen; wherein A is selected from =O or $=N-R_1$; wherein $R_9$ is hydrogen or one or more groups selected from -X-Y, lower alkyl, alkoxy, hydroxy, halogen or hydroxyalkoxy, wherein $R_{10}$ is selected from -Y, alkylene-X-Y, arylene-X-Y, alkylenearylene-X-Y, or $R_1$; wherein $R_{11}$ is hydrogen or 1–2 substituents selected from lower alkyl, lower alkoxy or halogen; wherein $R_{12}$ and $R_{13}$ are independently selected from hydrogen, acyl, 1,3,5-triazon-2-yl, alkylene-X-Y, arylene-X-Y, or substituents represented by $R_1$; wherein $R_{14}$ and $R_{15}$ are independently selected from hydrogen, lower alkyl, lower alkoxy, halogen, acylamino, aryloxy, alkylthio, arylthio, carbalkoxy, cyano, -O-alkylene-X-Y, -O-arylene-X-Y, -S-arylene-X-Y, -O-alkylenearylene-X-Y, -O-alkylene-O-arylene-X-Y, or 1,3,5-triazin-2-ylamino; wherein $R_{16}$ and $R_{17}$ are hydrogen or one or more groups selected from lower alkyl, lower alkoxy, carbalkoxy, halogen, cyano, unsubstituted or substituted sulfamoyl, alkylsulfonyl or -X-Y; wherein $R_{18}$ is selected from hydrogen, lower alkyl, aralkyl, aryl, alkoxy, cyano or unsubstituted or substituted sulfamoyl; wherein $R_{19}$ is selected from hydrogen, lower alkyl, lower alkoxy, carbalkoxy, halogen, 1,3,5-triazin-2-ylamino, naphtho[1,2-d]triazol-2-yl, pyrazalo[3,4-d]1,2,3-triazol-2-yl, benzotriazol-2-yl or halogen; wherein $R_{20}$ is selected from hydrogen or lower alkyl; wherein $R_{21}$ is selected from hydrogen, alkyl, alkoxy, halogen or -X-Y; wherein $R_{22}$ is selected from hydrogen, cyano, carboxylate ester, alkysulfonyl, acyl, unsubstituted or substituted sulfamoyl, unsubstituted or substituted carbamoyl, $-SO_2(R_1)Y$, or $-CON(R_1)Y$; wherein $R_{23}$ is selected from -X-Y; wherein $R_{24}$ is selected from hydrogen, lower alkyl, lower alkoxy or halogen; wherein $R_{25}$ is selected from 1,4-phenylene; 1,4-phenylene substituted with lower alkyl, lower alkoxy, halogen, cyano, carboxylate ester, unsubstituted or substituted carbamoyl or alkylsulfonyl; biphenylene; terphenylene; dibenzofuran-3,8-diyl; 1,3,4-oxadiazol-2,5- diyl; 1,3,4-thiadiazol-2,5,-diyl; naphthalene-1,4-diyl; wherein $R_{26}$ and $R_{27}$ are independently selected from phenyl or phenyl substituted with one or more groups selected from hydrogen, lower alkyl, lower alkoxy, halogen, cyano, hydroxy, amino, amino substituted optionally substituted with alkyl, cycloalkyl or phenyl; 1,3,5-triazin-2-yl; -O-alkylene-X-Y; -O-arylene-X-Y; -S-alkylene-X-Y; -O-alkylenearylen-X-Y; unsubstituted or substituted sulfamoyl; unsubstituted or substituted carbamoyl; or -X-Y; wherein;

Ar is one or more fused aromatic moieties selected from naphthalenes, acenaphthenes, anthracenes, phenanthrenes, perylenes, fluorenes, triphenylenes, pyrenes, chrysenes, naphthacenes, 1,2-benzanthrenes, 2,3-benzanthracenes, 1,12-benzoperylenes, 3,4-benzopyrenes, 4,5-benzopyrenes, decacylenes, carbazoles, indoles, 2,3-benzofurans, dibenzofurans, 2,3-benzothiophenes, dibenzothiophenes, dibenzothiophene dioxides, phenothiazines, phenoxazines or non-fused polyaromatic moieties selected from biphenyls, terphenyls, quaterphenyls, or binaphthyls; wherein $R_{28}$ and $R_{29}$ are independently selected from hydrogen; lower alkyl; lower alkoxy; acyl; halogen; cyano; hydroxy; amino; amino substituted optionally substituted with alkyl, cycloalkyl, or phenyl; 1,3,5-triazin-2-yl; -O-alkylene-X-Y; -O-arylene-X-Y; -S-alkylene-X-Y; -O-alkylenearylen-X-Y; unsubstituted or substituted sulfamoyl; unsubstituted or substituted carbamoyl or -X-Y; with the proviso that at least one -X-Y group be present in the structure.

A preferred group of fluorescent compounds are those where $R_5$ is an electron-rich aromatic moiety selected from the following:

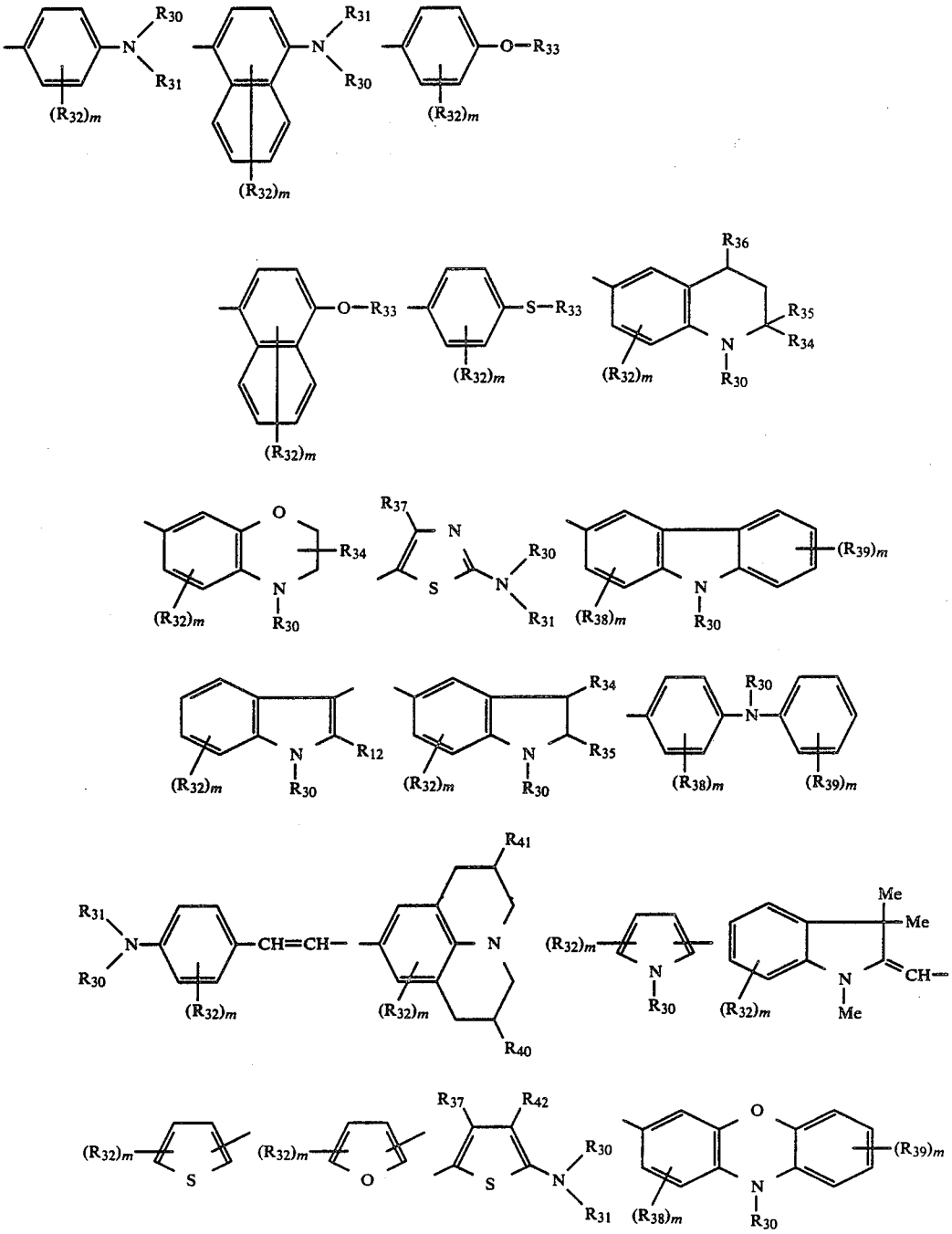

-continued

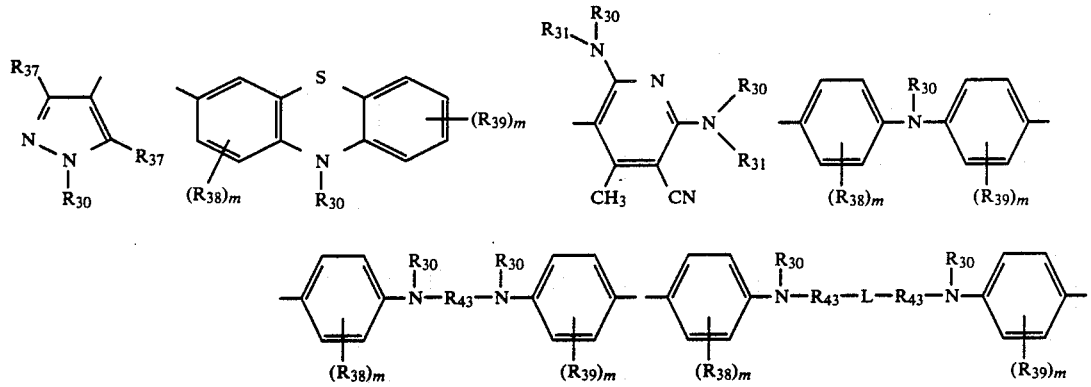

wherein:

$R_{30}$ and $R_{31}$ are selected from hydrogen; Y (as defined above); straight or branched lower alkenyl; cycloalkyl; cycloalkyl substituted with hydroxy, alkoxy, halogen or alkanoyloxy; phenyl; phenyl substituted with one or more groups selected from lower alkyl, lower alkoxy, halogen, hydroxy, alkanoylamino, carbalkoxy, carboxy, cyano, alkylanoyloxy or -X-Y (as defined above); straight or branched chain alkyl of 1-12 carbons and such alkyl substituted with one or more of the following: -X-Y; groups of the following formula:

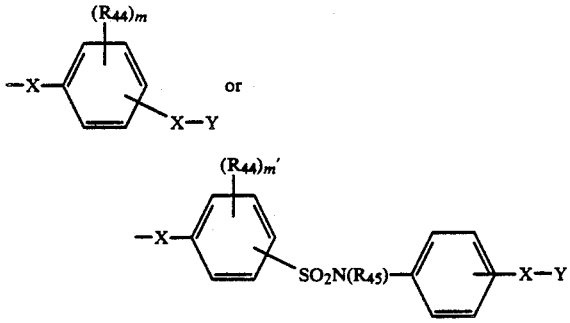

wherein X and Y are as defined above; wherein $R_{44}$ is selected from hydrogen; lower alkyl; lower alkoxy; halogen; lower alkanoylamino; cycloalkyl; cycloalkyl substituted with hydroxy, alkoxy, halogen, or alkanoyloxy; phenyl; phenyl substituted with lower alkyl, lower alkoxy, halogen, alkanoylamino, carboalkoxy, carboxy, hydroxy, cyano, or alkanoyloxy.

Additional substituents on the alkyl groups represented by $R_{30}$ and $R_{31}$ include the formulae: —$OR_{45}$, —$SO_2R_{46}$, —$CON(R_{45})(R_{47})$, —$SO_2SO_2N(R_{45})(R_{47})$, —$N(R_{45})SO_2R_{46}$, —O—X′—$R_{46}$, —$SR_{48}$, and —$SO_2C_2H_4SR_{46}$;

$R_{45}$ and $R_{47}$ are selected from hydrogen; lower alkyl; lower alkyl substituted with hydroxy, acyloxy, halogen, cycloalkyl, alkoxy, or phenyl; cycloalkyl; phenyl substituted with lower alkyl, lower alkoxy, halogen, hydroxy, alkanoylamino, carbalkoxy, carboxy, cyano, or alkanoyloxy, wherein $R_{46}$ represents the same substituents listed for $R_{45}$ and $R_{47}$ excepting hydrogen; wherein X′ is selected from —CO—, —COO—, or —$CON(R_{45})$—; wherein $R_{48}$ is selected from the groups listed above for $R_{45}$ and $R_{47}$ plus benzothiazolyl, benzimidazolyl, pyridyl, pyrimidinyl, 1,3,4-thiadiazolyl, 1,3,4-oxadiazolyl, naphthyl, or triazolyl.

Additional substituents on the alkyl group represented by $R_{30}$ and $R_{31}$ includes: cyano, halogen, 2-pyrrolidino, phthalimidino, vinylsulfonyl, acryamido, -o-benzoylsulfonimido, groups of the formula:

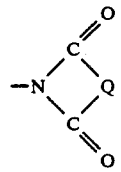

wherein Q is lower alkylene of 1-3 carbons; lower alkylene substituted with hydroxy, halogen, alkoxy or acyloxy; vinyl; 1,2-phenylene; 1,2-phenylene substituted with lower alkyl, lower alkoxy, halogen, carboxy or carbalkoxy; 1,2-cyclohexylene; —O—$CH_2$—; —$CH_2OCH_2$—; —S—$CH_2$—; —$N(R_{45})CH_2$—; —$N(R_{45})CH_2CH_2$— or —$CH_2N(R_{45})CH_2$—; wherein $R_{30}$ and $R_{31}$ can be a single combined group such as pentamethylene, tetramethylene, ethyleneoxyethylene, ethylenesulfonylethylene, ethylenethioethylene, ethylene-$N(R_{45})$ethylene, ethylene-N(-X′-$R_{46}$)ethylene, or ethylene($SO_2R_{47}$)ethylene which, with the nitrogen to which it is attached, forms a ring;

$R_{32}$, $R_{38}$, and $R_{39}$ are selected from hydrogen, chlorine, bromine, fluorine, iodine, lower alkyl, trifluoromethyl, lower alkoxy, alkoxy substituted with hydroxy, aryl, aryloxy, arylthio, alkylene-X-Y or -o-alkylene-X-Y;

m and m′ are 1 or 2;

$R_{33}$ is selected from hydrogen, or one or two groups selected from $R_{30}$ or Y;

$R_{34}$, $R_{35}$, and $R_{36}$ are each independently selected from hydrogen and lower alkyl;

$R_{37}$ is hydrogen, lower alkyl, halogen, aryl, or -o-arylene-X-Y;

$R_{40}$ and $R_{41}$ are selected from hydrogen, lower alkyl, lower alkoxy, halogen, hydroxy, or acyloxy;

$R_{42}$ is selected from hydrogen, cyano, —$COOR_{45}$, —$CON(R_{45})(R_{47})$, —$SO_2R_{46}$, —$COR_{46}$, or —$CON(R_2)$—Y;

$R_{43}$ is alkylene; arylene; aralkylene; alkyleneoxy; alkyleneoxyalkylene; alkylene; alkylene substituted with hydroxy, acyloxy, alkoxy, halogen, aryloxy, -X-Y, or -X-arylene-X-Y;

L is a divalent single covalent bond, —O(C=O)O—, —(C=O)—O—, —(=O)—, —O—, —S—, —$SO_2$—, —N($SO_2R_{46}$)—, —S—S—, —O—(C=O)-alkylene-(C=O)—O—, —O(C=O)-arylene-(C=O)—O—, —O—(C=O)NH-alkylene-NH(C=O)—O—, —O(C=O)NH-arylene-NH(=O)—O—, -O-alkylene-O-, -O-arylene-O-, cycloalkylene or arylene.

Still further preferred non-ionic luminophore moieties are those where:

(a) Y has an average weight of from about 200 to about 90,000;

(b) Y is terminated with hydrogen or a group selected from alkyl, aryl, acyl, alkoxyalkyl, mono- or dihydroxyalkyl, acyloxyalkyl, or a group of the formula:

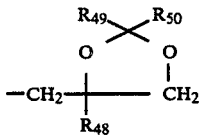

wherein each $R_{48}$, $R_{49}$, or $R_{50}$ is selected from hydrogen, alkyl or aryl;

(c) R is —$CH_2CH_2$—, —$CH(CH_3)CH_2$—, —$CH_2CH(C_2H_5)$— or mixtures thereof;

(d) Y is a poly(oxyalkylene) moiety comprised of at least three monomeric units or mixtures thereof of the formula (—R—O—), wherein each R is straight or branched alkylene of 2–4 carbons or mixtures thereof, up to about 2 mole percent of said monomeric units may be connected by on or more linking groups selected from alkyleneoxy, aryleneoxy, alkylenedioxy or alkylenetrioxy and wherein Y can be terminated by hydrogen, or contain as branch substituents, 1–2 groups or moieties selected from alkyl, cycloalkyl, acyl, or aryl; wherein any of the above recited hydrogen groups, moieties or substituents may themselves be substituted with up to four substituents selected from lower alkyl, lower alkoxy, alkylenedioxy, halogen, alkoxycarbonyl, hydroxy, aryloxy, alkoxyalkyl, mercapto, alkylthio, arylthio, —N($R_2$) ($R_3$)— or acyloxy.

In the above definitions, the term alkyl is used to represent a straight or branch chain aliphatic hydrocarbon radical of 1–12 carbons and the term lower alkyl is used to represent a straight or branched chain aliphatic hydrocarbon radical of 1–8 carbons. Cycloalkyl is used to represent a cyclic aliphatic hydrocarbon radical of 5–7 carbons. The term aryl and arylene are used generally to represent a mono- or divalent benzene ring, respectively, and this ring substituted further with 1–3 common substituents such as lower alkyl, lower alkoxy, halogen, hydroxy, alkanoylamino, alkanoyloxy, carbalkoxy, carboxy, cyano, trifluoromethyl, lower alkylthio, lower alkylsulfonyl, carbamoyl, amino, alkylamino, dialkylamino, nitro, phenylthio or phenoxy.

In carrying out the present process with respect to a formed article, the intermediate article such as fiber or yarn is brought into contact with the aqueous system which may contain dissolved, colloidal, suspended or otherwise dispersed additional binding agent, and the tagging compound or compounds. The binding agent is preferably a polymeric or resinous material such as, for example, textile sizing material exemplified by the polyester modified with 5-sodiosulfoisophthalic acid or the like as disclosed in U.S. Pat. Nos. 3,546,008, 3,779,993, 4,233,196, 3,734,874, and 3,828,010, the disclosures of which are incorporated herein by reference. Other such useful binding agents are described in incorporated herein by reference.

The concentration of binding agent employed may vary widely, e.g., between about 3.0 and 20.0 percent by weight, preferably about 5.0 and 15.0 percent of the article or material. For many articles, sufficient association or adherence of the tagging compound thereto can be achieved simply through contact, or from the aqueous system containing the dispersed compound without the need for a supplemental binding agent. Subsequent drying of the article from aqueous media will temporarily affix the compound thereto with sufficient tenacity for many subsequent monitoring purposes.

The concentration of the tagging compound with respect to the article weight can also vary widely, e.g., between about 0.0001 to about 10.0 percent, preferably 0.01 to about 3 percent by weight. The concentration is selected to give adequate reemission for the visual detection inspection or other specific purpose at hand.

It is particularly noted that the singular water dispersibility of many of the present tagging compounds offers the enormous advantage of being able to maintain the fluorescent system intact in the presence of many organic solvents which may be necessary in the various processing operations. Likewise, an aqueous wash of such organic solvent-tagged article systems readily rids the article of the tagging compound.

Thermoplastic resins which may be used according to the present invention include a wide range of resins and synthetic resin compositions which are known in the art as being essentially thermoplastic in nature. The term "thermoplastic" is used herein in its conventional sense to mean a resin "having the property of softening or fusing when heated and of hardening again when cooled" )see Webster's Seventh Collegiate Dictionary, G & C Merriam Co., 1965). Thermoplastic resins are to be clearly distinguished both in terms of their essential physical and chemical characteristics from thermosetting resins. The term "thermosetting" used herein is also used in its conventional sense to means a resin "having the property of becoming permanently rigid when heated or cured.

Examples of thermoplastic resin systems which may be employed include a wide range of polyolefin polymers, e.g., polyethylene, linear low density polyethylene, polypropylene, polybutylene and copolymers made from ethylene, propylene and/or butylene. Other thermoplastic polymers which may be employed according to the present invention include polyvinyl chloride, polyvinylidene chloride, cellulosic resins such as cellulose acetate, cellulose acetate butyrate and cellulose acetate propionate, acrylic resins such as polymethyl methacrylate, styrene acrylonitrile, polystyrene, polycarbonate and acrylonitrile butadiene styrene (therein ABS), polyamides such as nylon 6 and nylon 66 and polyesters such as polyethylene terephthalate, especially glycol modified polyethylene terephthalate and polybutylene terephthalate.

As mentioned above, the fluorescent tags may be employed in the thermoplastic resins in a minor amount sufficient to provide the desired degree of light emission in the resin. The actual amount used will, in addition to the desired intensity of emitted light, depend upon the molar extinction coefficient of the luminophore used and the overall molecular weight of the luminophore, e.g., luminophore plus poly(oxyalkylene) chain length. Typically the amount of fluorescent tag employed may be from about 0.0001 percent to about 10 percent, preferably from about 0.02 percent to about 3 percent, and most preferably from about 0.01 to about 1.0 percent by weight based upon the overall weight of the resin composition.

Other conventional additives may also be present in the resin compositions of the present invention. For instance, such additives may included plasticizers, colorants, antioxidants, stabilizers, lubricants, flame retardants, nucleating agents and other additives which will be readily identified by those skilled in the art. In general, the fluorescent tags have been observed to have little or no adverse interactions with these conventional additives.

Because the fluorescent tags if used properly ordinarily do not detract from the clarity of the resin, it has been found that additives which improve the clarity of such resins may be particularly desirable for use in combination with fluorescent tags as described herein to provide resin products that are both fluorescent and which also have excellent clarity. One particular class of additives which have been found to be useful in this regard are the benzylidene sorbitols including substituted benzylidene sorbitols such as those described in U.S. Pat. No. 4,016,118 to Hamada, et al. (E. C. Chemical); U.S. Pat. No. 4,371,645 to Mahaffey (Milliken Research Corporation); and Japanese Pat. No. SHO[1977] 53-117044 to Kobsyashi, et al. (New Japan Chemical); all of these patents being hereby incorporated herein by reference. The particular shade of fluorescence will depend primarily upon the class of luminophore and substituents present on the basic luminophore. A large variety of fluorescent colors and shades may be obtained by blending two or more luminophores. Blending the fluorescent tags of the present invention can be readily accomplished as the fluorescent tags are polymeric materials which may have substantially identical solubility characteristics, which are dictated by the nature of the polymeric chain. Therefore, the fluorescent tags are in general soluble in one another, and are also in general completely compatible with each other.

According to the process of the invention, the fluorescent tag may be incorporated into the thermoplastic resin using conventional techniques such as those employed to incorporate other additives in such resins. For instance, the fluorescent tag may be incorporated into the resin by simply adding it to the resin while the resin is in a plasticized or molten state, typically prior to formation of the polymer into its final shape, e.g., by molding, extrusion, blow-molding and the like. For instance when the thermoplastic resin to be fluorescently tagged is a polyolefin resin the process may be carried out by adding a fluorescent tag comprised of a poly(oxyalkylene) substituted luminophore group directly to the molten polymer, by tumbling it onto a pre-extruded pelletized resin, or by mixing it into the resin powder prior to extrusion. The polymer may then be molded or extruded in the usual manner, i.e., in the same way as for polyolefin resins which are not colored. Details about these procedures may be found in the relevant literature.

Alternatively, a concentrate of the fluorescent tag in an appropriate resin or vehicle may first be prepared. Such concentrate may contain an appropriately high percentage of fluorescent tag. The concentrates may be in the form of liquids, solids, e.g., powders, pellets, etc., as may be desired. These may then be incorporated into the thermoplastic resin. Obviously, liquids may have certain processing advantages over solids, and moreover liquids may, if desired, be added directly to the molten polymer and therefore contain no extraneous solvent or dispersing agents. This process may, therefore, provide unusual and advantageous properties in the final thermoplastic resin product. Alternatively, however, the fluorescent tags may be premixed with minor amounts of or solvent or dispersing agent which is compatible with the resin, thus providing certain processing advantages.

According to the process of the invention, the liquid fluorescent tag may be incorporated into the thermosetting resins by simply adding it to the reaction mixture or to one of the components of the reaction mixture before or during the polyaddition reaction. For instance, when the thermosetting resin to be fluorescently tagged is a polyurethane resin, the process may be carried out by adding the fluorescent tagging agent in the form of a liquid to the polyol or even in some instances to the polyisocyanate component of the reaction mixture either before or during polyurethane formation. The subsequent reaction may be carried out in the usual manner, ie., in the same was as for polyurethane resins which are not fluorescently tagged. Details about this procedure may be found in the relevant literature.

The present fluorescent tagging agents of one embodiment of the present invention are polymeric, liquid, and reactive. Thus, they may be added to the reaction mixture or to one of the components thereof in solvent-free form rather than in the form of solutions or dispersions in suitable solvent or dispersing medium. Obviously liquids have significant processing advantages over solids, and moreover liquids of the present invention may, if desired, be added directly to the reaction mixture and therefore contain no extraneous nonreactive solvent or dispersing agent. This process may, therefore, provide unusual and advantageous properties in the final thermoset resin product. Alternatively, however, the fluorescent tagging agent may be premixed with minor amounts of one or more of the precursors of the polymeric product, thus providing certain processing advantages.

The thermosetting resins to which the process of the present invention may be applied may be made by the reaction of a nucleophile with an electrophile. Examples of such resins include alkyds, allylics, the amines, e.g., melamine and urea, epoxies, phenolics, polyesters, silicones and urethanes. The thermosetting resin colored according to the present invention can be used in a variety of different end uses. e.g., as moldings, sealants, elastomers, films, fibers, lacquers, coating and foamed materials. It has been found in particular that the present fluorescent tags may be quite advantageously be employed for the production of foams, such as polyurethane foams which may be soft, semi-rigid or rigid foams, or the so-called polyurethane integral skin and microcellular foams. Such foams are useful for producing shaped products by injection molding, extrusion or to one of the other components, although addition to the polyol component is preferred. The polyols may be polyesters which contain hydroxyl groups, in particular reaction products of dihydric alcohols and dibasic carboxylic acids, or polyethers which contain hydroxyl groups, in particular products of the addition of ethylene oxide, propylene oxide, styrene oxide or epichlorohydrin to water, alcohols or amines, preferably dialcohols. The fluorescent tag may also be admixed with chain extending diols, e.g., ethylene glycol, diethylene glycol and butane diol. In general, it is desirable not to use more than about 20 percent by weight of fluorescent tag based on the weight of polyol. In most cases very strong fluorescent colorations are produced with a small proportion of the fluorescent tag, for example, from about 0.005 to about 2 percent, preferably 0.05 to 1 percent by weight fluorescent tag based on the weight of polyol.

Because the present fluorescent tags are, in themselves, polymeric compounds, they may be soluble, for instance, in most polyols which would be used in polyurethane manufacture, in most epoxy formulations, in polyester formulations and themselves in admixtures. This property may be particularly valuable in that this solubility may permit rapid mixing and homogeneous distribution throughout the resin, thus eliminating streaks when properly mixed, the fluorescent tag may have no tendency to settle as would be the base with fluorescent pigment dispersions, and it is possible to prepare a blend of two or more fluorescent tags which provides a wide range of fluorescent tagging availability.

In the use of the present compounds which contain hydroxyls, in the production of polyurethane foams, several reactions generally take place. First an isocyanate such as toluene diisocyanate is reacted with a polyol such as polypropylene glycol in the presence of heat and suitable catalyst. If both the isocyanate and the polyol are difunctional, a linear polyurethane results, whereas should either have functionalities greater than two, a cross linked polymer will result. If the hydroxylic compound available to react with the —NCO group is water, the initial reaction product is a carbamic acid which is unstable and breaks down into a primary amine and carbon dioxide. Since excess isocyanate is typically present, the reaction of the isocyanate with the amine generated by decarboxylation of the carbamic acids occurs, and if controlled, the liberated carbon dioxide becomes the blowing agent for the production of the foam. Further, the primary amine produced reacts with further isocyanate to yield a substituted urea which affords strength and increased firmness characteristics to the polymer.

In general, amine and tin catalysts are used to delicately balance the reaction of isocyanate with water, the blowing reaction, and the reaction of isocyanate with polymer building substituents. If the carbon dioxide is released too early, the polymer has no strength and the form collapses. If polymer formation advances too rapidly a closed cell foam results which will collapse on cooling. If the fluorescent tag or another component reacts to upset the catalyst balance poorly formed will result. It is particularly noted, as aforesaid, that the present colorants are especially stable to the tin catalysts and to excess isocyanate materials employed.

The present liquid reactive fluorescent tagging agents may also be of considerable value in reaction injection molding (RIM) applications. The RIM process is a method of producing molded polyurethanes and other polymers wherein the two reactive streams are mixed while being poured into a mold. Upon reaction, the polymer is "blown" by chemicals to produce a foam structure. This process may be hindered by the presence of solid particles, such as conventional pigments. The present invention may not cause this hinderance because there are no particles in the system and the fluorescent tag, containing free reactive groups (ie,hydroxyl) becomes part of the polymer through reaction with one of the components.

Much literature is available which shows the many organic structures suitable as organic luminescent materials and/or synthetic methods available for synthesizing them, such as the following:

H. Gold, "Fluorescent Brightening Agents," in K. Venkataraman, ed., The Chemistry of Synthetic Dyes, Vol. 5, Academic Press, Inc., New York, 1971, pp. 535–679; B. M. Krasovitskii and B. M. Bolotin, Organic Luminescent Materials, VCH Publishers, New York, 1988; D. Barton, H. Davidson, Rev. Prog. Coloration, 5(1973)3; A. E. Siegrist, et. al., Rev. Prog. Coloration, 17(1987)39; Ian H. Lever and Brian Milligan, Dyes and Pigments, 5(1984), pp. 109–144; R. Williamson, Textile Science and Technology, Vol. 4; Fluorescent Whitening Agents, Amsterdam, Elsevier(1980); R. Zweidler and H. Hefti, "Brighteners, Fluorescent," Kirk-Othmer Encycl. Chem. Technol., 3rd. Edn., Vol. 4(1978)213; D. W. Rangnekar and R. C. Phadke, Dyes and Pigments, 6(1985), pp. 293–302.; A. Dorlars, et. al., Angew. Chem. Internat. Edit., Vol. 14, No. 10(1975), pp. 665–679.; A. K. Sarkar, Fluorescent Whitening Agents., Meadow field Pr., England, 1971.

The fluorescent poly(oxyalkylene) tags of the invention are prepared according to Routes 1–11.

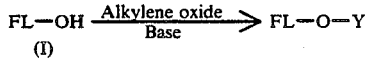

Route1 involves the hydroxalkylation of a phenol intermediate (I) with an alkylene oxide in the presence of a base catalyst. Suitable alkylene oxides include, for example, ethylene oxide, propylene oxide, butylene oxide, and mixtures of two or more of such compounds.

The hydroxyalkylation reaction may be accomplished by the reaction of alkylene oxide at about 80–150° C. The alkylene oxide is added in the presence of an inert gas such as nitrogen until the desired amount of alkylene oxide has been absorbed. This reaction is carried out with or without solvents. If solvents are desired, toluene, xylenes, nitrobenzene, and dioxane are just a few solvents that may be used. Useful base catalysts are potassium hydroxide, lithium hydroxide, calcium hydroxide, and barium hydroxide, just to name a few. The amount of basic catalyst can vary but is usually in the range of from about 0.2% to about 2% by weight. In addition, certain tertiary organic amines are useful catalysts, such as dimethylaminocyclohexane, triethylamine, and benzyldimethylamine just to name a few.

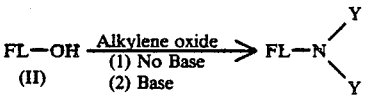

Route 2 involves the hydroxalkylation of a aromatic amine intermediate (II) with an alkylene oxide in a two step procedure. The first step can be carried out in the presence or absence of a acid catalyst. Suitable alkylene oxides include, for example, ethylene oxide, propylene oxide, butylene oxide, cyclohexane oxide, glycidyl, and mixtures of two or more of such compounds.

In the first step, hydroxyalkylation may be accomplished by the reaction of the alkylene oxide which is added in at about 80°–150° C. The alkylene oxide is added in the presence of an inert gas such as nitrogen until two or more equivalents of the desired amount of alkylene oxide have been absorbed. This reaction is carried out with or without solvents. If solvents are desired, toluene, xylenes, nitrobenzene, and dioxane are just a few solvents that may be used. Alternatively, an acid catalyst can be employed to effect the hydroxyalkylation. For example formic acid and acetic acid are just a few of such inert acids that may be used. Generally, acid-catalyzed hydroxyalkylation is performed at a lower temperature to avoid the formation of by-products.

Temperatures from about 40° C. to about 120° C. can be employed depending on the basicity of the aromatic amine intermediate (II) to be hydroxyalkylated. The amount of acid may vary widely. Generally from about 0.5 to 10 percent by weight may be employed.

In the second step, the dihydroxyalkylene intermediate (III) is prepared by the use of base catalysts such as potassium hydroxide, lithium hydroxide, calcium hydroxide, and barium hydroxide, just to name a few. The amount of basic catalyst can vary but is usually in the range of from about 0.2% to about 2% by weight. The reaction temperature can vary but may generally be in the range from 100° C. to about 150° C.

$$\underset{(III)}{FL-SO_2Cl} + \underset{(IV)}{HN(R_1)Y} \xrightarrow{Base} FL-SO_2N(R_1)-Y$$

Route 3 involves the condensation of a sulfonyl chloride intermediate (III) with at least a stoichiometric quantity of a poly(oxyalkylene) amine (IV) and a inorganic base at a temperature of from about 0° C. to about 100° C. If a solvent is desired, alcohols, glycol ethers, etc. are effective.

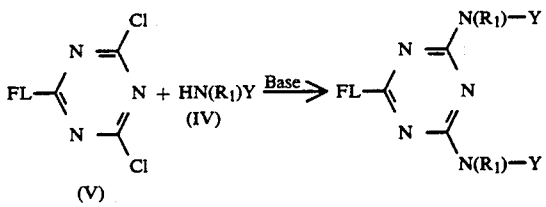

Route 4 involves the condensation of a polyhalo-1,3,5-triazinyl intermediate (V) with at least a stoichiometric quantity of a poly(oxyalkylene) amine (IV) and a inorganic base at a temperature of from about 0° C. to about 100° C. If a solvent is desired, those mentioned above for Route 3 are effective.

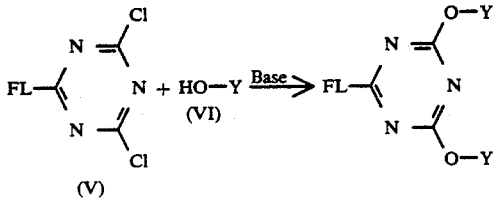

Route 5 involves the condensation of a polyhalo-1,3,5-triazinyl intermediate (V) with at least a stoichiometric quantity of a poly(oxyalkylene) glycol (VI) and a inorganic base at a temperature of from about 0° C. to about 100° C. If a solvent is desired, those mentioned above for Route 3 are effective.

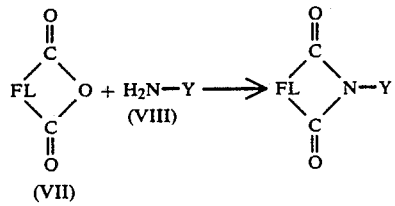

Route 6 involves the condensation of an anhydride intermediate (VII) with at least a stoichiometric quantity of poly(oxyalkylene) amine (VIII) at a temperature of from about 50° C. to about 180° C. If a solvent is desired, ethers such as dioxane or THF, N,N-dimethylformamide, toluene, xylene, etc. are effective. The reaction is facilitated by use of organic acid catalysts such as acetic acid.

$$\underset{(IX)}{Y-X-FL-NO_2} \xrightarrow[Cat.]{Hydrogen} Y-X-FL-NH_2$$

Route 7 involves the conversion of poly(oxyalkylene) nitro intermediates (IX) to amines by catalytic hydrogenation. Any suitable reduction catalyst may be used. For example, catalysts such as Raney nickel, nickel oxides, finely divided metals such as iron, cobalt, platinum, ruthenium, osmium, and rhodium may be used. Furthermore, metal catalysts supported on pumice, asbestos, kieselguhr, alumina, silica gel or charcoal work equally as well. The amount of catalyst can vary from about 0.025 to 15 percent by weight based on the nitro intermediate (IX) used.

Reduction temperatures of about 20° C. to about 90° C., although temperatures of 40° C. to 90° C. are preferred since they may provide faster reaction times and higher yields. During the reduction of the nitro intermediates(IX), pressures ranging from about 500 to about 1800 psi of hydrogen may be used.

The reduction reaction is usually carried out in the presence of a suitable solvent. Solvents include lower alcohols such as methyl alcohol, ethyl alcohol, and isopropyl alcohol; ethers such as dioxane; hydrocarbons such as benzene, toluene, xylenes, cyclohexanes, and petroleum ether; and mixtures of lower alcohols and water such as about equal parts by weight of ethyl alcohol and water. The amount of solvent is an amount of about 30 to about 80 percent by weight.

$$\underset{(X)}{FL-\overset{O}{\overset{\|}{C}}-Cl} + \underset{(IV)}{HN(R_1)-Y} \xrightarrow{Base} FL-\overset{O}{\overset{\|}{C}}-NH(R_1)-Y$$

Route 8 involves the condensation of an acid chloride intermediate (X) with at least a stoichiometric quantity of a poly(oxyalkylene) amine (IV) and an inorganic base at a temperature of from about 0° C. to about 100° C. If a solvent is desired, those mentioned above for Route 3 are effective.

$$\underset{(X)}{FL-\overset{O}{\overset{\|}{C}}-Cl} + \underset{(VI)}{H-O-Y} \longrightarrow FL-\overset{O}{\overset{\|}{C}}-O-Y$$

Route 9 involves the condensation of an acid chloride intermediate (X) with at least a stoichiometric quantity of a poly(oxyalkylene) glycol (VI) and an inorganic base at a temperature of from about 0° C. to about 100° C.

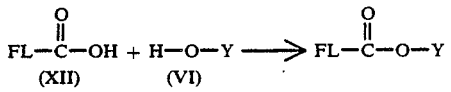

Route 10 involves the condensation of an acid intermediate (XII) with at least a stoichiometric quantity of a poly(oxyalkylene) glycol (VI) and an inorganic acid at a temperature of from about 0° C. to about 100° C.

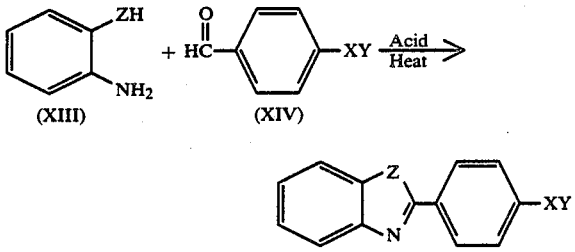

Route 11 involves the condensation of an ortho substituted aniline intermediate (XIII) which is capable of condensation with a stoichiometric quantity of poly(oxyalkylene) aldehyde intermediate (XIV) under acidic oxidative conditions at a temperature of from about 80° C. to about 150° C. If solvents are desired, toluene, xylenes, nitrobenzene, dioxane, and water are just a few solvents that may be used. A few useful organic acids are acetic, propionic and butyric.

Commercially available and preferred amines from which the present preferred colorants are prepared are the JEFFAMINE series described in Texaco Chemical Company, New Product Development brochures as the M, D, ED, DU, BUD, T, MNPA: and EDR series: the disclosures of which are incorporated herein by reference and copies of which are transmitted herewith.

The preferred amines finding special utility in the present invention are as follows:

$R_{51}—O(C_2H_4O)_a[CH_2CH(CH_3)O]_bCH_2CH(CH_3)NH_2$ $R_{51}—O(C_2H_4O)_a[CH_2CH(C_2H_5)O]_bCH_2CH(CH_3)NH_2$ $R_{51}—O(C_2H_4O)_a[CH_2CH(C_2H_5)O]_bCH_2CH(C_2H_5)NH_2$ $R_{51}—O(C_2H_4O)_a[CH_2CH(CH_3)O]_bCH_2CH(C_2H_5)NH_2$ $R_{51}—O[CH_2CH(CH_3)O]_aCH_2CH(CH_3)NH_2$ $R_{51}—O[CH_2CH(C_2H_5)O]_aCH_2CH(C_2H_5)NH_2$ $R_{51}—O[CH_2H_5)O]_aCH_2CH(CH_3)NH_2$ $R_{51}—O[CH_2CH(CH_3)O]_aCH_2CH(C_2H_5)NH_2$ wherein a=1-19; b=2-31; and $R_{51}$ is selected from $CH_3$, $C_2H_5$, N—$C_3H_7$, n—$C_4H_9$, n—$C_5H_{11}$, or n—$C_6H_{13}$.

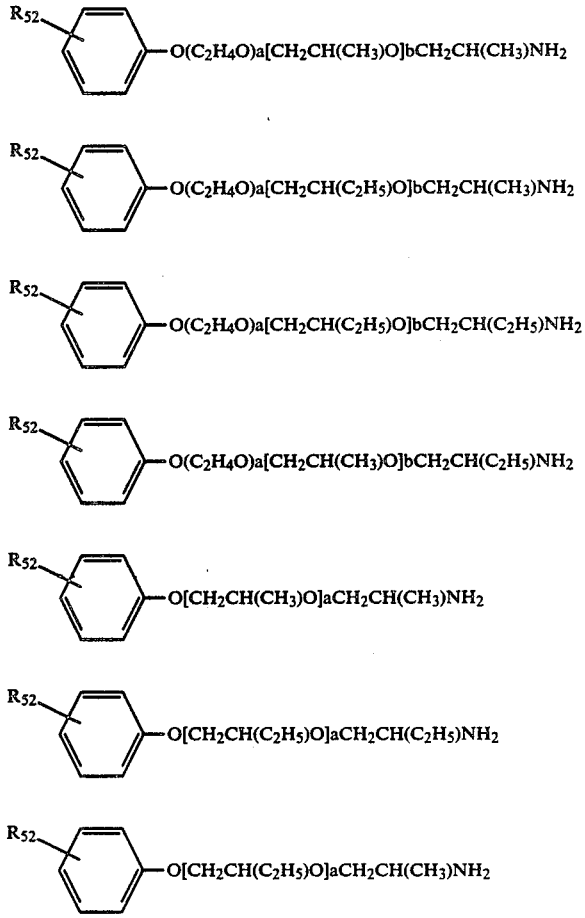

-continued
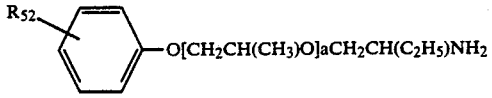
wherein a=1–19; b=2–31; and $R_{52}$ is selected from $CH_3$, $C_2H_5$, $C_4H_9$, $C_9H_{19}$, $OCH_3$, $OC_2H_5$, or $OC_4H_9$.
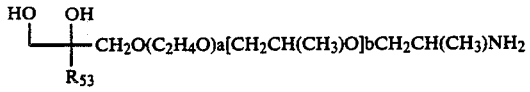
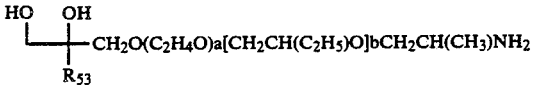
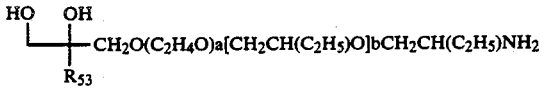
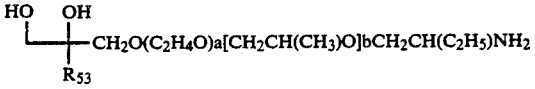
-continued
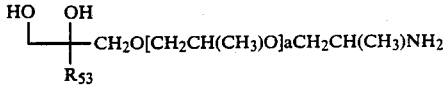
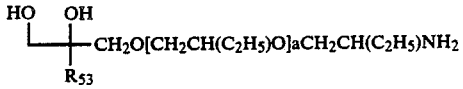
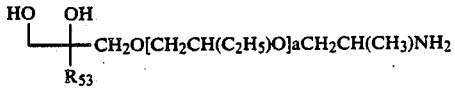
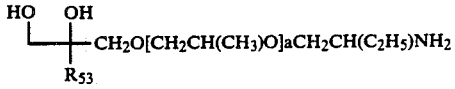
wherein a=1–19; b=2–31; and Rhd 53 is selected from hydrogen, $CH_{3l}$, or $C_2H_5$.
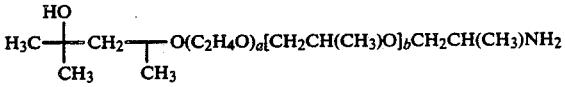
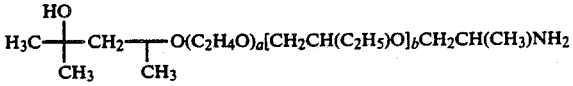
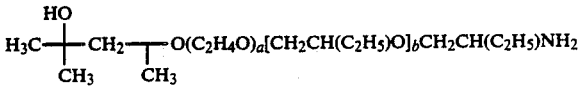
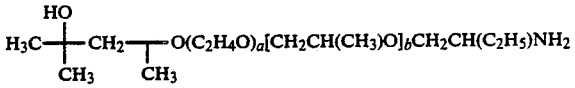
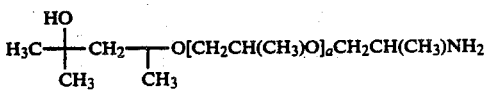
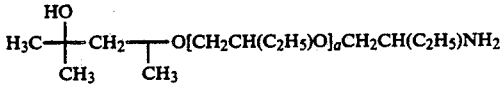
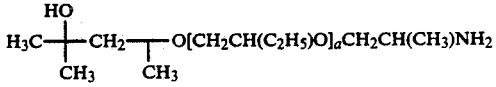
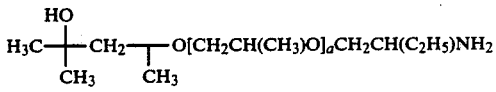
wherein a=1–19; b=2–31.

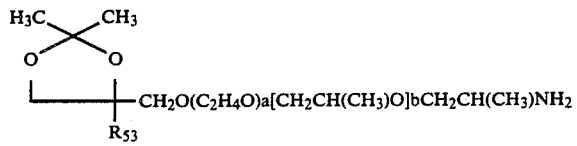

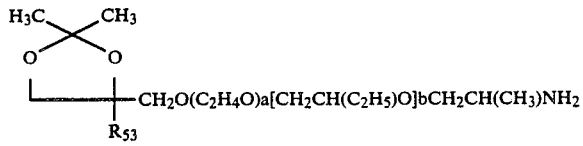

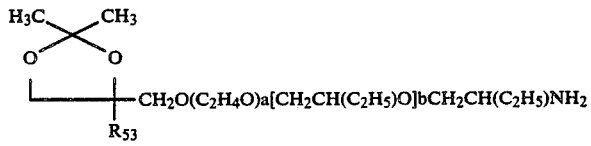

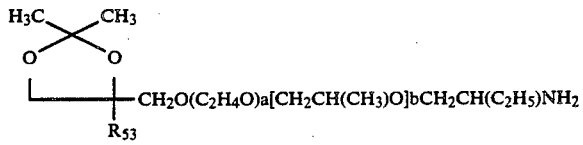

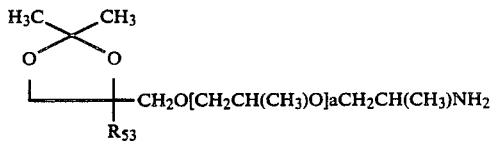

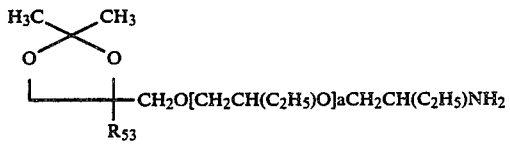

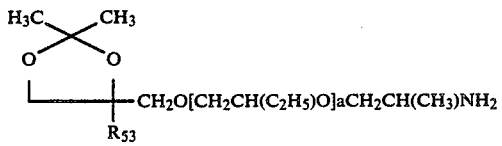

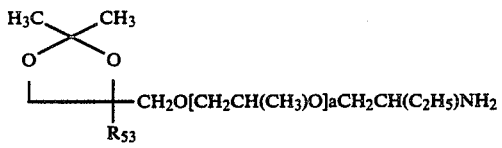

wherein a=1–19; b=2–31; and $R_{53}$ is recited above.

$H_2NCH(CH_3)CH_2[OCH(CH_3)CH_2]_a(OCH_2CH_2)_b[OCH_2CH(CH_3)]_cNH_2$ $H_2NCH(CH_3)CH_2[OCH(C_2H_5)CH_2]_a(OCH_2CH_2)_b[OCH_2CH(CH_3)]_cNH_2$ $H_2NCH(CH_3)CH_2[OCH(C_2H_5)CH_2]_a(OCH_2CH_2)_b[OCH_2CH(C_2H_5)]_cNH_2$ $H_2NCH(C_2H_5)CH_2[OCH(C_2H_5)CH_2]_a(OCH_2CH_2)_b[OCH_2CH(C_2H_5)]_cNH_2$ $H_2NCH(C_2H_5)CH_2[OCH(CH_3)CH_2]_a(OCH_2CH_2)_b[OCH_2CH(C_2H_5)_cNH_2$ $H_2NCH(CH_3)CH_2[OCH(CH_3)CH_2]_aNH_2$ $H_2NCH(C_2H_5)CH_2[OCH(C_2H_5)CH_2]_aNH_2$ wherein b=4–132; and a+c=2–15.

$H_2N(CH_3)CHCH_2[OCH_2CH(CH_3)[_aHN(CO)_{NH[CH(CH3)}CH_2O]_bCH_2CH(CH_3)NH_2$ $H_2N(C_2H_5)CHCH_2[OCH_2CH(C_2H_5)]_aHN(CO)NH[CH(C_2H_5)CH_2O]_bCH_2CH(C_2H_5)NH_2$ $H_2N(CH_3)CHCH_2[OCH_2CH(C_2H_5)]_aHN(CO)NH[CH(C_2H_5)CH_2O]_b CH_2CH(CH_3)NH_2$ $H_2N(C_2H_5)CHCH_2[OCH_2CH(CH_3)]_aHN(CO)NH[CH(CH_3)CH_2O]_bCH_2 CH(C_2H_5)NH_2$ wherein a=2–68 and b=2–68.

$HOCH(CH_3)CH_2NHCH(CH_3)CH_2[OCH_2CH(CH_3)]_aNHCH_2CH(CH_3)OH$

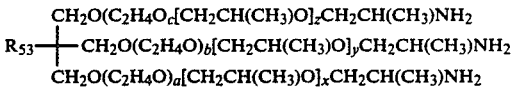

-continued $$R_{53}-\begin{array}{l} CH_2O(C_2H_4O)_c[CH_2CH(C_2H_5)O]_zCH_2CH(C_2H_5)NH_2 \\ CH_2O(C_2H_4O)_b[CH_2CH(C_2H_5)O]_yCH_2CH(C_2H_5)NH_2 \\ CH_2O(C_2H_4O)_a[CH_2CH(C_2H_5)O]_xCH_2CH(C_2H_5)NH_2 \end{array}$$

$$R_{53}-\begin{array}{l} CH_2O(C_2H_4O)_c[CH_2CH(C_2H_5)O]_zCH_2CH(CH_3)NH_2 \\ CH_2O(C_2H_4O)_b[CH_2CH(C_2H_5)O]_yCH_2CH(CH_3)NH_2 \\ CH_2O(C_2H_4O)_z[CH_2CH(C_2H_5)O]_xCH_2CH(CH_3)NH_2 \end{array}$$

$$R_{53}-\begin{array}{l} CH_2O(C_2H_4O)_c[CH_2CH(CH_3)O]_zCH_2CH(C_2H_5)NH_2 \\ CH_2O(C_2H_4O)_b[CH_2CH(CH_3)O]_yCH_2CH(C_2H_5)NH_2 \\ CH_2O(C_2H_4O)_a[CH_2CH(CH_3)O]_xCH_2CH(C_2H_5)NH_2 \end{array}$$

$$R_{53}-\begin{array}{l} CH_2O[CH_2CH(CH_3)O]_zCH_2CH(CH_3)NH_2 \\ CH_2O[CH_2CH(CH_3)O]_yCH_2CH(CH_3)NH_2 \\ CH_2O[CH_2CH(CH_3)O]_xCH_2CH(CH_3)NH_2 \end{array}$$

$$R_{53}-\begin{array}{l} CH_2O[CH_2CH(C_2H_5)O]_zCH_2CH(C_2H_5)NH_2 \\ CH_2O[CH_2CH(C_2H_5)O]_yCH_2CH(C_2H_5)NH_2 \\ CH_2O[CH_2CH(C_2H_5)O]_xCH_2CH(C_2H_5)NH_2 \end{array}$$

$$R_{53}-\begin{array}{l} CH_2O[CH_2CH(CH_3)O]_zCH_2CH(C_2H_5)NH_2 \\ CH_2O[CH_2CH(CH_3)O]_yCH_2CH(C_2H_5)NH_2 \\ CH_2O[CH_2CH(CH_3)O]_xCH_2CH(C_2H_5)NH_2 \end{array}$$

$$R_{53}-\begin{array}{l} CH_2O[CH_2CH(C_2H_5)O]_zCH_2CH(CH_3)NH_2 \\ CH_2O[CH_2CH(C_2H_5)O]_yCH_2CH(CH_3)NH_2 \\ CH_2O[CH_2CH(C_2H_5)O]_xCH_2CH(CH_3)NH_2 \end{array}$$

wherein $a+b+c=1-80$; and $x+y+z=5-85$; and $R_{53}$ is recited above.

Commercially available and preferred glycols from which the present preferred fluorescent tags are prepared are polyalkylene glycols and alkyl polyalkylene glycols. These are referred to as CARBOWAX and Methoxy CARBOWAX in the trade. The generalized formula for polyalkylene glycol is:

$$HO-[CH_2CH(R)O]_t-H$$

and for alkoxy polyalkylene glycol is:

$$R_1-O-[CH_2CH(R)O]_t-H$$

where "t" is the average number of repeating oxyalkylene groups. Carbowax polyalkylene glycols are available in average molecular weights ranging from 200 to 8000 and Carbowax alkoxy glycols are available in average molecular weights ranging from 350 to 500. These types of glycols are described in Union Carbide brochures: the disclosures of which are incorporated herein by reference and copies of which are transmitted herewith.

The uses for the present invention are essentially unlimited and include tagging solid particulate materials in essentially any type of non-aqueous media including thermoplastic and thermosetting resins and forms, liquid or solid fuels, inks, detergent, textiles, waste or feed streams in chemical plants, adhesives, and biological research or analytical media, for qualitative or quantitative detection or monitoring.

The following examples illustrate preparation of the present fluorescent tags; the parts and percentages, unless otherwise stated, are by weight. The abbreviations EO, PO, and BO refer to $-CH_2CH_2-$, $-CH(CH_3)CH_2-$, and $-CH(C_2H_5)CH_2-$, respectively. These following examples and tables further will illustrate specific embodiments of the invention.

EXAMPLE 1

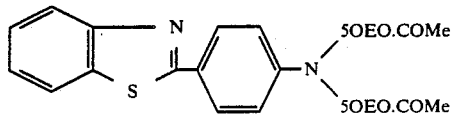

One-thousand six-hundred sixty-five grams (0.3 mole) of poly(oxyalkylene)aldehyde intermediate (80.3% solids), 123 grams acetic acid, and 37.6 grams (0.3 mole) 2-aminothiophenol are charged to a reaction vessel and heated to 190°-200° C. for four hours while the acetic acid is collected in Dean-Stark trap. The product is allowed to sit overnight. The contents of the reactor are stripped of all volatiles under reduced pressure at 110° C. for 45 minutes to give a liquid with a maximum absorbance of 362 nm. This liquid exhibits a blue fluorescence.

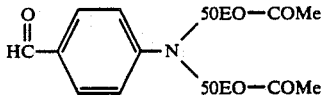

One hundred eighty three grams of N,N-bis(hydroxyethyl) aniline are allowed to react with 4400 grams (44 moles) ethylene oxide in the presence of potassium hydroxide following well-known ethoxylation procedures. The product of this reaction is allowed to react with 204 grams acetic anhydride following well-known acetylation procedures. The reaction is then vacuum stripped to remove acetic acid. The product of the acetylation reaction is allowed to react with 202.5 grams N,N-dimethylformamide and 306.8 grams phosphorus oxychloride in the presence of 20.4 grams of acetic anhydride following usual formylation procedures to yield this poly(oxyalkylene) aldehyde intermediate.

EXAMPLE 2

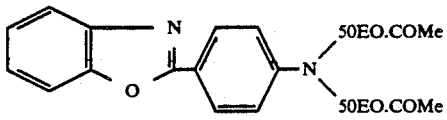

ONe hundred seventy two grams (0.03 mole) of poly(oxyalkylene)aldehyde intermediate (80.3%) solids), 30 grams acetic acid, and 3.3 grams (0.03 mole) 2-aminophenol are charged to a reaction vessel and heated to 190°-200° C. for hours while the acetic acid is collected in Dean-Stark trap. The product is allowed to sit overnight and contents of the reactor are stripped of all volatiles under reduced pressure at 110° C. for 45 minutes to give a liquid with a maximum absorbance of 352 nm. This liquid exhibits a blue fluorescence.

EXAMPLE 3

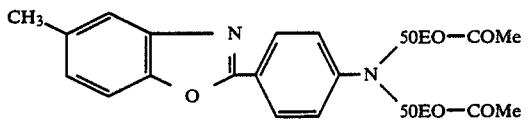

One hundred seventy two grams (0.03 mole) poly(oxyalkylene)aldehyde intermediate (80.3%) solids), 30 grams acetic acid, and 3.7 grams (0.03 mole) 2-amino-p-cresol are charged to a reaction vessel and heated to 190°-200° C. for hours while the acetic acid is collected in Dean-Stark trap. The product is allowed to sit overnight. The contents of the reactor are stripped of all volatiles under reduced pressure at 110° C. for 45 minutes to give a liquid with a maximum absorbance of 389 nm. This liquid exhibits a blue fluorescence.

EXAMPLE 4

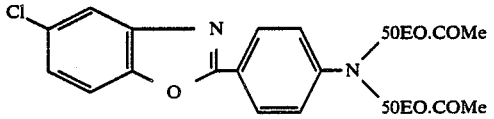

One hundred seventy two grams (0.03 mole) poly(oxyalkylene)aldehyde intermediate (80.3% solids), 30 grams acetic acid, and 4.3 grams (0.03 mole) 5-chloro-2-hydroxyaniline are charged to a reaction vessel and heated to 190°-200° C. for hours while the acetic is collected in Dean-Stark trap. The product is allowed to sit overnight. The contents of the reactor are stripped of all volatiles under reduced vacuum at 110° C. for 45 minutes to give a liquid which exhibits a blue fluorescence.

EXAMPLE 5

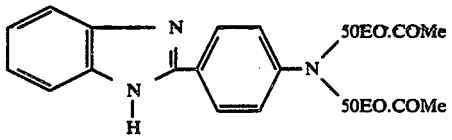

Two-hundred five grams (0.037 mole) of poly(oxyalkylene)aldehyde intermediate (80.3% solids), 19 grams acetic acid, and 3.1 grams (0.03 mole) o-phenylenediamine are charged to a reaction vessel and heated to 190°-200° C. for hours while the acetic acid is collected in Dean-Stark trap. The product is allowed to sit overnight. The contents of the reactor are stripped of all volatiles under reduced pressure at 110° C. for 45 minutes to give a liquid with a maximum absorbance of 334 nm. This liquid exhibits a blue fluorescence.

EXAMPLE 6

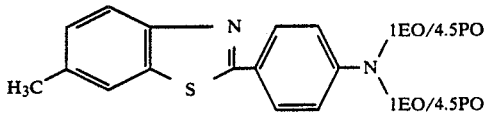

Three hundred and sixty-one grams (1.51 moles) 2-(4-aminophenyl)-6-methylbenzothiazole and 500 milliters of methylisobutyl ketone were charged into a two liter pressure reactor. The mixture was stripped at 93° C. for 15 minutes, then purged with nitrogen to 5 psi. The mixture is heated to 120° C. and 135 grams (3.1 moles) ethylene oxide are added. After 210 minutes, 3.6 grams of potassium hydroxide catalyst are added and the reaction mixture is stripped for 15 minutes. Eight hundred and seventy grams (15 moles) propylene oxide are then added to the reactor and the mixture is then heated at 121° C. for 3 hours. Afterwards, the contents of the reactor are stripped of all volatiles under reduced pressure at 118° C. for 45 minutes to give a liquid with a maximum absorbance of 364 nm. This liquid exhibits a blue fluorescence.

EXAMPLE 7

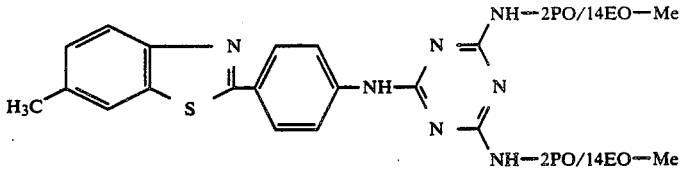

A mixture is prepared by adding 75 grams (0.105 mole) of a primary amine with an amine equivalent weight of 1.35 meq/g) to 15.8 grams of sodium carbonate (0.15 mole) in 250 grams of water. The mixture is stirred mechanically and cooled to 10°-15° C., and 17.5 grams (0.05 moles) of 2-(dichloro-1,3,5-triazinylamino-phenyl)-6-methylbenzothiazole are added to the mixture. After the addition is complete, the mixture is warmed to 50° C. for an additional two hours to insure complete reaction. The mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 337 nm and a blue-violet fluorescence.

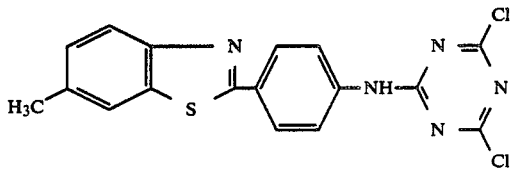

103.2 grams (0.43 mole) of 2-(4-aminophenyl)-6-methylbenzothiazole, 98 grams (0.52 mole) of cyanuric chloride, and 500 milliters of nitrobenzene are added to a 1000 milliter three necked flask equipped with thermometer, reflux condenser, Dean-Stark trap, mechanical stirrer, and heating mantle. After the initial exotherm ceases, this mixture is heated at 100°-110° C. for an additional 4 hours. The reaction mixture is then quenched while stirring in hexanes and the precipitate filtered. The crude product is washed several times with additional hexanes and vacuum dried.

EXAMPLE 8

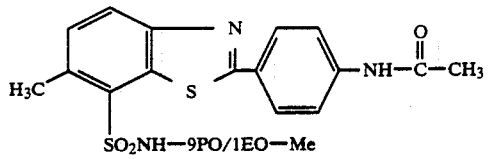

A mixture is prepared by adding 122.4 grams (0.205 mole) of Jeffamine M-600 primary amine with an amine equivalent weight of 1.66 meq/g to 86.5 grams (0.82 mole) sodium carbonate in 500 ml of water. The mixture is cooled to 10°-15° C. and 0.20 mole of an aqueous wet cake of freshly prepared 2-(4-acetamidophenyl)-6-methylbenzothiazole-7-sulfonyl chloride was added. When the addition is complete, the mixture is warmed to 50° C. to for an additional two hours to insure complete reaction. Afterwards, the mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 330 nm and a blue fluorescence.

EXAMPLE 9

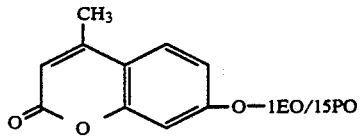

Two hundred and fifty grams (1.54 moles) 7-hydroxy-4-methylcoumarin, 2.5 grams of potassium hydroxide catalyst, and 250 milliters of methylisobutyl ketone are charged into a two liter pressure reactor. The mixture is stripped at 93° C. for 15 minutes, then purged with nitrogen to 5 psi. The mixture is heated to 120° C. and 45 grams (1.03 moles) ethylene oxide are added. After 90 minutes at 112° C., eight hundred and twenty-five grams (14.2 moles) propylene oxide are then added to the reactor. After 5 hours hold time, the contents of the reactor are stripped of all volatiles under reduced pressure at 110° C. for 45 minutes to give 634 grams of a liquid with a maximum absorbance of 318 nm. This liquid exhibits a blue fluorescence.

EXAMPLE 10

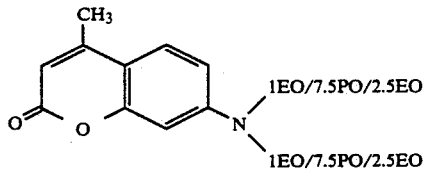

One hundred grams (0.6 mole) 7-amino-4-methylcoumarin and 500 milliters of toluene are charged into a two liter pressure reactor. The mixture is stripped at 93° C. for 15 minutes, then purged with nitrogen to 5 psi. The mixture is heated to 120° C. and 50.2 grams (1.14 moles) ethylene oxide are added. After 3 hours, 2 grams of potassium hydroxide catalyst were added and the reaction mixture is stripped for 15 minutes. Four hundred and ninety-five grams (8.6 moles) propylene oxide are then added to the reactor and the mixture is then heated at 121° C. for 3 hours. Afterwards, one hundred and twenty-five grams (2.9 moles) ethylene oxide are then added to the reactor and the mixture then heated at 121° C. for an additional 3 hours. The contents of the reactor are stripped of all volatiles under reduced pressure at 118° C. for 45 minutes to give a liquid with a maximum absorbance of 364 nm. This liquid exhibited a blue fluorescence.

EXAMPLE 11

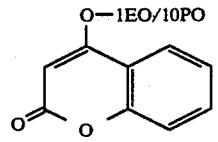

One hundred grams (0.62 mole) 4-hydroxycoumarin, 2 grams of potassium hydroxide catalyst, and 250 milliters of methylisobutyl ketone are charged into a two liter pressure reactor. The mixture is stripped at 93° C. for 15 minutes, then purged with nitrogen to 5 psi. The mixture is heated to 120° C. and 28 grams (0.62 mole) ethylene oxide are added. After 90 minutes at 120° C., three hundred and sixty grams (6.2 moles) propylene oxide are then added to the reactor. After 5 hours hold time, the contents of the reactor are stripped of all volatiles under reduced pressure at 110° C. for 45 minutes to give a liquid with a maximum absorbance of 302nm. This liquid exhibits a greenish-yellow fluorescence.

EXAMPLE 12

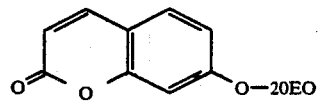

One hundred grams (0.62 mole) 7-hydroxycoumarin, 2 grams of potassium hydroxide catalyst, and 250 milliters of methylisobutyl ketone are charged into a two liter pressure reactor. The mixture is stripped at 93° C. for 15 minutes, then purged with nitrogen to 5 psi. The mixture is heated to 120° C. and 546 grams (12.4 moles) ethylene oxide are added. After 5 hours hold time, the contents of the reactor are stripped of all volatiles under reduced pressure at 110° C. for 45 minutes to give a liquid with a maxim absorbance of 318 nm. This liquid exhibits a blue fluorescence.

EXAMPLE 13

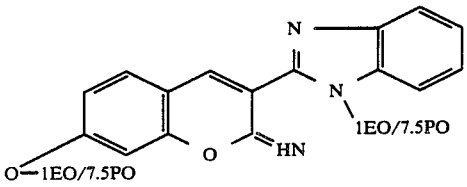

105.3 grams (0.38 mole) of iminocoumarin, 5 grams of dimethylaminocyclohexane catalyst, and 500 milliters of toluene were charged into a two liter pressure reactor. The mixture was purged with nitrogen to 5 psi and heated to 90° C. Thirty eight grams (0.9 mole) ethylene oxide was added. After 90 minutes at 90° C. three hundred and thirty-one grams (5.7 moles) propylene oxide was then added to the reactor. After 5 hours hold time, the contents of the reactor are stripped of all volatiles under reduced vacuum at 110° C. for 45 minutes to give a liquid with a maximum absorbance of 374 nm. This liquid exhibited a greenish blue fluorescence.

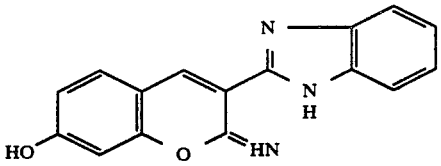

A mixture is prepared by adding 138 grams (1 mole) of a 2,4-dihydroxybenzaldehyde, 157 grams (1 mole) of 2-benzimidazylacetonitrile, and 600 milliters of ethanol. Five drops of piperidine catalyst are added and the reaction mixture exotherms. Afterwards a precipitate forms and the mixture is heated to 80° C. for several additional hours. The product is quenched in water, washed with aqueous ethanol solution several times and finally vacuum dried.

EXAMPLE 14

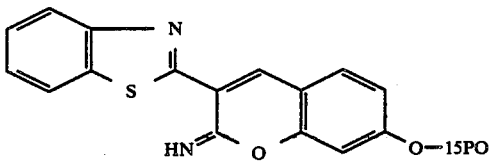

58.8 grams (0.2 mole) of iminocoumarin, 2 grams of dimethylaminocyclohexane catalyst, and 500 milliters of toluene are charged into a two liter pressure reactor. The mixture is purged with nitrogen to 5 psi and heated to 90° C. Ten grams (0.23 mole) ethylene oxide are added. After 90 minutes at 90° C. one hundred seventy four grams (3 moles) propylene oxide are then added to the reactor. After 5 hours hold time, the contents of the reactor are stripped of all volatiles under reduced pressure at 110° C. for 45 minutes to give a liquid with a maximum absorbance of 387 nm. This liquid exhibits a greenish-blue fluorescence.

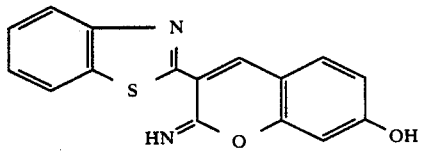

A mixture is prepared by adding 138 grams (1 mole) of a 2,4-dihydroxybenzaldehyde, 174 grams (1 mole) of 2-benzothiazolylacetonitrile, and 600 milliters of ethanol. Five drops of piperidine catalyst are added and the reaction mixture exotherms. Afterwards a precipitate forms and the mixture is heated to 80° C. for several additional hours. The product is quenched in water, washed with aqueous ethanol solution several times and finally vacuum-dried.

EXAMPLE 15

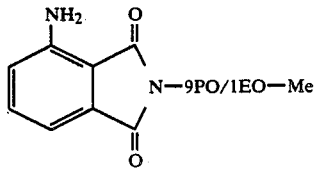

In a 2000 milliter autoclave are charged 405 grams (0.5moles) of 3-nitrophthalimide-N-poly(oxyalkylene) intermediate, 1400 milliters of ethyl alcohol and 65 grams of wet Raney nickel catalyst. The autoclave is then purged three times with hydrogen gas and heated to 85°-90° C. at a pressure of about 1300 psi. After about two hours the hydrogen uptake ceases. A sample is removed and vacuum stripped of solvent. The IR spectrum of this sample shows no nitro bands and the presence of an amine band indicating that the reaction is complete. The autoclave is cooled and vented. A total of 376 grams of liquid product are isolated by filtering the reaction mixture and stripping away the solvent under reduced pressure. The liquid has a maximum absorbance of 375 nm and a greenish-blue fluorescence.

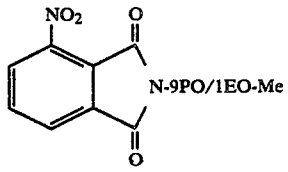

Six hundred grams (1 mole) of Jeffamine M-600 primary amine with an amine equivalent weight of 1.66 meq/g amine, 500 milliters of toluene, 193 grams (1 mole) of 3-nitrophthalic anhydride, and 129 grams of acetic acid are charged into a 2000 milliter three necked flask equipped with thermometer, reflux condenser, Dean-Stark trap, mechanical stirrer, and heating mantle. This mixture is heated to reflux for about six hours until the overhead temperature in the trap remains constant at 110° C. The resulting solution is then stripped of all volatiles under reduced pressure to give the corresponding 3-nitrophthalimide-N-poly(oxyalkylene) intermediate.

EXAMPLE 16

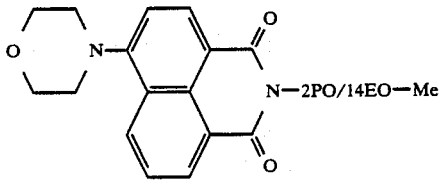

In a 250 milliter flask is added 23.3 grams (0.1 mole) of 4-chloro-1,8-naphthalic anhydride, 200 milliters of toluene, and 9.57 grams (0.11 mole) of morpholine. This mixture is heated after it exotherms to 90° C. until solution is complete. The reaction mixture is allowed to stir at 80°-90° C. for several hours. Seventy two grams (0.1 moles) of a primary amine with an amine equivalent weight of 1.35 meq/g are added and a Dean-Stark trap and condenser is attached. The reaction mixture is then heated to reflux until no more water condenses in the trap which takes about two hours. A liquid product is isolated by vacuum stripping off the excess solvent. This liquid has a maximum absorbance of 340 nm and a greenish-yellow fluorescence.

EXAMPLE 17

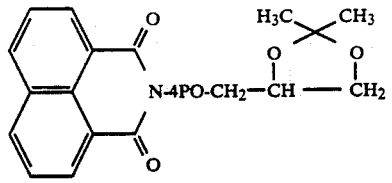

One hundred ninety eight grams (1 mole) of 1,8-naphthalic anhydride, 500 milliters of toluene, 370 grams (1 mole) of a primary amine with an amine equivalent weight of 2.7 meq/g and 129 grams of acetic acid are charged into a 2000 milliter three-necked flask equipped with thermometer, reflux condenser, Dean-Stark trap, mechanical stirrer, and heating mantle. This mixture is heated to reflux for about six hours until overhead temperature in the trap remains constant at 110° C. The resulting solution is then stripped of all volatiles under reduced pressure to give the corresponding liquid 1,8-naphthalimide-N-poly(oxyalkylene) with a maximum absorbance of 331 nm and a violet fluorescence.

EXAMPLE 18

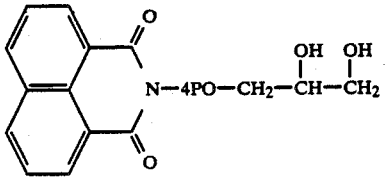

271.5 grams (0.5 mole) of the ketal prepared in Example 17 are added along with 500 ml of water to a three-necked 1000 ml flask equipped with overhead stirrer, heating mantle, and Dean-Stark trap. The mixture is heated to 80° C. and 33 grams of 70% sulfuric acid are added. This reaction mixture is maintained at 80° C. until no more acetone can be detected overhead in the trap. The mixture is then cooled and the product is extracted into methylene chloride. The methylene chloride solution is separated, washed several times with water to neutral pH, and dried over anhydrous magnesium sulfate. The dried methylene chloride solution is filtered and stripped under reduced pressure at 90° C. to give liquid containing a hydroxyl band in the IR spectrum, a maximum absorbance of 333 nm and blue-violet fluorescence.

EXAMPLE 19

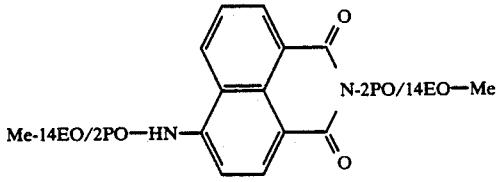

IN a 250 milliter flask are added 23.3 grams (0.1 mole) of 4-chloro-1,8-naphthalic anhydride, 144 grams (0.2 moles) of a primary amine with an amine equivalent weight of 1.35 meq/g, 31.8 grams (0.3 moles) of sodium carbonate, and 0.05 grams of tetraethylammonium bromide. A Dean-Stark trap and condenser are attached. The reaction mixture is then heated to reflux until no more water condenses in the trap, which takes about two hours. The liquid which is obtained has a maximum absorbance of 340 nm and a greenish-yellow fluorescence.

EXAMPLE 20

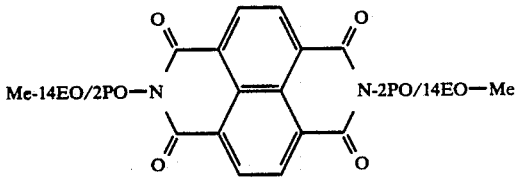

Twenty seven grams (0.1 mole) of 1,4,5,8-naphthalic tetracarboxylic dianhydride, 150 grams (0.21 mole) of a primary amine with an amine equivalent weight of 1.35 meq/g and 13 grams of acetic acid are charged into a 500 milliter three-necked flask equipped with thermometer, reflux condenser, Dean-Stark trap, mechanical stirrer, and heating mantle. This mixture is heated to reflux for about three hours until no more volatiles are collected overhead. The resulting reaction mixture is then stripped under reduced pressure to give the corresponding liquid 1,4,5,8-dinaphthalimide-N-poly(oxyalkylene) with a maximum absorbance of 378 nm and a greenish-yellow fluorescence.

EXAMPLE 21

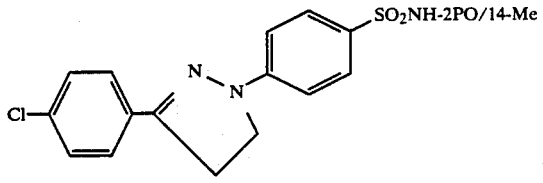

A solution of 108.9 grams(0.125 mole) of 4-(poly(alkylenoxy)sulfonamido)aniline intermediate, 45 milliters concentrated hydrochloric acid, and 90 milliters of water are cooled to 0°-5° C. Ten grams of sodium nitrite are added maintaining the mixture below 10° C. After several hours, the excess nitrite is destroyed with sulfamic acid. The diazo solution is then dripped into solution of 94 grams of sodium sulfite in 250 grams of water, stirred for one hour at room temperature and then 50 grams of concentrated sulfuric acid are added and the mixture heated for one hour at 100° C. After cooling the pH is adjusted with sodium hydroxide to 10. The organic layer is separated and mixed with 25.4 grams (0.125 moles) of 3,4'-dichloropropiophenone and heated for two hours at 100° C. The mixture is then cooled and the product is extracted into methylene chloride. The methylene chloride solution is separated, washed several times with water to neutral pH, and dried over anhydrous magnesium sulfate. The dried methylene chloride solution is filtered and stripped under reduced pressure at 90° C. to give liquid with a maximum absorbance of 365 nm and blue fluorescence.

EXAMPLE 22

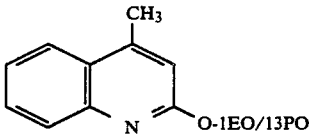

One hundred fifty nine grams (1 mole) of 2-hydroxy-4-methylquinoline, 2 grams of potassium hydroxide catalyst, and 250 milliters of methylisobutyl ketone are charged into a two liter pressure reactor. The mixture is stripped at 93° C. for 15 minutes, then purged with nitrogen to 5 psi. The mixture is heated to 120° C. and 44 grams (1 mole) ethylene oxide are added. After 90 minutes at 120° C., 754 grams (13 moles) propylene oxide are then added to the reactor. After 5 hours hold time, the contents of the reactor are stripped of all volatiles under reduced pressure at 110° C. for 45 minutes to give a liquid with a maximum absorbance of 321 nm. This liquid exhibits a blue fluorescence.

EXAMPLE 23

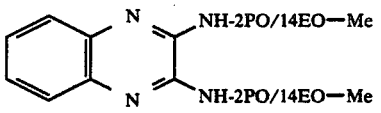

A mixture is prepared by adding 150 grams (0.21 mole) of a primary amine with an amine equivalent weight of 1.35 meq/g, 53.0 grams (0.50 mole) of sodium carbonate in 500 ml of water. The mixture is cooled to 10°-15° C. and 20 grams (0.10 mole) of 2,3,-dichloroquinoxaline are added. When the addition is complete, the mixture is warmed to 50° C. to for an additional two hours to insure complete reaction. Afterwards, the mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 337 nm and a blue fluorescence.

EXAMPLE 24

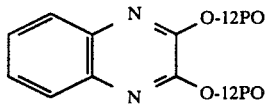

A mixture is prepared by adding 143 grams (0.2 mole) of poly(propylene glycol) and 53.0 grams (0.50 mole) of sodium carbonate to 500 milliters of water. To the mixture is added 20 grams (0.1 mole) of 2,3-dichloroquinoxaline. The mixture was heated to 120° C. for four hours. Afterwards, the mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 324nm and a bluish-violet fluorescence.

EXAMPLE 25

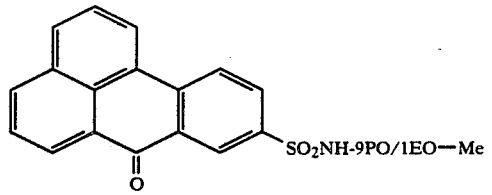

A mixture is prepared by adding 61.2 grams (0.1 mole) of Jeffamine M-600 primary amine with an amine equivalent weight of 1.66 meq/g to 43.2 grams (0.41 mole) sodium carbonate in 500 ml of water. The mixture is cooled to 10°-15° C. and 32.9 grams (0.10 mole) of sulfonyl chloride is added. When the addition is complete, the mixture is warmed to 50° C. to for an additional two hours to insure complete reaction. Afterwards, the mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 391 nm and a greenish-yellow fluorescence.

EXAMPLE 26

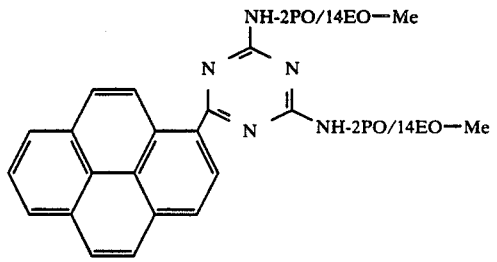

A mixture is prepared by adding 75 grams (0.105 mole) of a primary amine with an amine equivalent weight of 1.35 meq/g) to 15.8 grams of sodium carbonate (0.15 mole) in 250 grams of water. The mixture is stirred mechanically and cooled to 10°-15° C., and 17.5 grams (0.05 moles) of 1-(dichloro-1,3,5-triazinyl)pyrene are added to the mixture. After the addition is complete, the mixture is warmed to 50° C. for an additional two hours to insure complete reaction. The mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 352 nm and a greenish-yellow fluorescence.

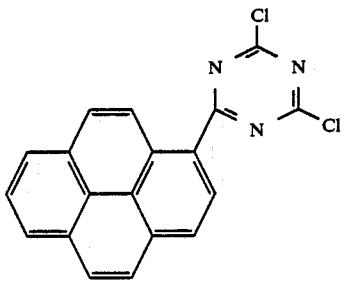

In a 1000 milliter flask are added 40.4 grams (0.2 mole)of pyrene, 36.4 grams (0.2 mole) of cyanuric chloride, and 700 milliters of benzene. This mixture is maintained at 20°-25° C. while 40 grams (0.3 mole) of aluminum chloride is added slowly. The reaction mixture is allowed to stir at room temperature for 12 hours. The reaction mixture is then quenched while stirring in 700 milliters of methyl alcohol. The precipitated crude product is washed several times with additional methanol. The crude solid is then slurried with a mixture of 500 milliters of ice water and 50 milliters of 36 percent hydrochloric acid, maintaining the temperature between 0°-5° C. for 15 minutes. The product is then washed with 200 milliters of methanol and vacuum-dried. It is recrystallized from dichlorobenzene to give a solid with a melting point of 257° C.

EXAMPLE 27

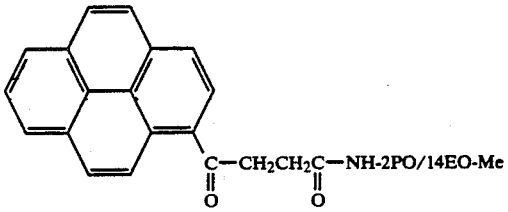

A mixture is prepared by adding 150 grams (0.21 mole) of a primary amine with an amine equivalent weight of 1.35 meq/g, 66.2 grams (0.61 mole) of sodium carbonate in 500 ml of water. The mixture is cooled to 10°—° C. and 64.2 grams (0.2 mole) acid chloride is added. When the addition was complete, the mixture is warmed to 50° C. to for an additional two hours to insure complete reaction. Afterwards, the mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 334 nm and a blue fluorescence.

EXAMPLE 28

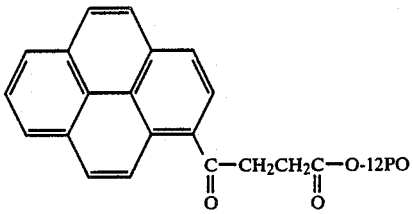

A mixture is prepared by adding 143 grams (0.2 mole) of poly(propylene glycol) to 64.2 grams (0.2 mole) of acid chloride. The mixture is heated to 120° C. to for four hours. Afterwards, the mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 344 nm and a blue fluorescence.

EXAMPLE 29

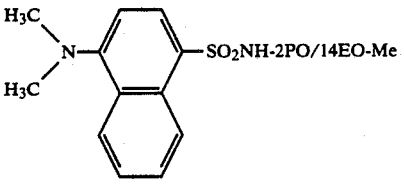

A mixture is prepared by adding 150 grams (0.21 mole) of a primary amine with an amine equivalent weight of 1.35 meq/g and 66.2 grams (0.61 mole) of sodium carbonate to 500 ml of water. The mixture is cooled to 10°-15° C. and 53.9 grams (0.20 mole) of dansyl chloride is added. When the addition is complete, the mixture is warmed to 50° C. to for an additional two hours to insure complete reaction. Afterwards, the mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 333 nm and a greenish-yellow fluorescence.

EXAMPLE 30

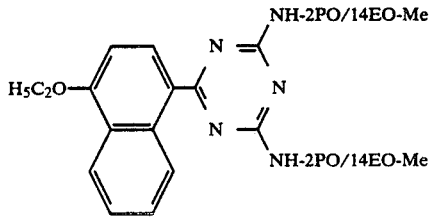

A mixture is prepared by adding 75 grams (0.105 mole) of a primary amine with an amine equivalent weight of 1.35 meq/g) to 16 grams of sodium carbonate (0.15 mole) in 250 grams of water. The mixture is stirred mechanically and cooled to 10°-15° C., and 32 grams (0.1 mole) of 1-ethoxy 4-(dichloro-1,3,5-triazinyl naphthalene are added to the mixture. After the addition is complete, the mixture is warmed to 50° C. for an additional two hours to insure complete reaction. The mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 313 nm and a blue fluorescence.

EXAMPLE 31

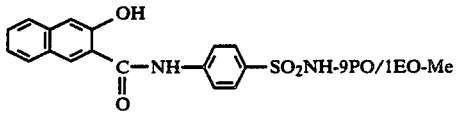

A mixture is prepared by adding 310 grams (0.41 mole) of poly(oxyalkylene)amine and 66.2 grams (0.61 mole) of sodium carbonate to 500 ml of water. The mixture is cooled to 10°-15° C. and 82.3 grams (0.4 mole) 3-hydroxy-2-naphthoic acid chloride is added. When the addition is complete, the mixture is warmed to 50° C. for an additional two hours to insure complete reaction. Afterwards, the mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 342 nm and a blue fluorescence.

EXAMPLE 32

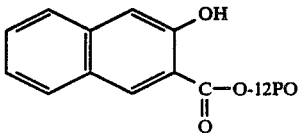

A mixture is prepared by adding 143 grams (0.2 mole) of poly(propylene glycol) and 41 grams (0.2 mole) 3-hydroxy-2-naphthoic acid chloride. The mixture is heated to 120° C. for four hours. Afterwards, the mixture is cooled and the product is extracted into methylene chloride. The methylene chloride solution is separated from the salt water solution, washed several times with water to neutral pH, and dried over anhydrous magnesium sulfate. The dried methylene chloride solution is filtered and stripped under reduced pressure at 90° C. to give a liquid with a maximum absorbance of 362 nm and a blue-violet fluorescence.

EXAMPLE 33

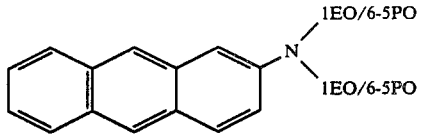

One hundred grams (0.52 mole) 2-aminoanthracene and 500 milliters of toluene are charged into a two liter pressure reactor. The mixture is stripped at 93° C. for 15 minutes, then purged with nitrogen to 5 psi. Then mixture is heated to 120° C. and 48 grams (1.1 moles) ethylene oxide is added. After 3 hours 2 grams of potassium hydroxide catalyst are added and the reaction mixture stripped for 15 minutes. Three hundred and ninety-two grams (6.8 moles) propylene oxide are then added to the reactor and the mixture then heated at 121° C. for 3 hours. Afterwards, the contents of the reactor are stripped of all volatiles under reduced pressure at 118° C. for 45 minutes to give a liquid with a maximum absorbance of 335 nm. This liquid exhibits a green fluorescence.

EXAMPLE 34

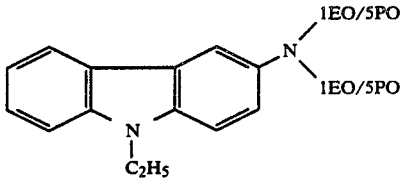

Three hundred and fifty grams (1.67moles) 3-amino-9-ethylcarbazole and 350 milliters of toluene are charged into a two liter pressure reactor. The mixture is stripped at 93° C. for 15 minutes, then purged with nitrogen to 5 psi. The mixture is heated to 120° C. and 150 grams (3.4 moles) ethylene oxide are added. After 75 minutes 2 grams of potassium hydroxide catalyst are added and the reaction mixture is stripped for 15 minutes. Nine hundred and sixty-five grams (16.6 moles) propylene oxide are then added to the reactor. After 150 minutes hold time, the contents of the reactor are stripped of all volatiles under reduced pressure at 118° C. for 45 minutes to give a liquid with a maximum absorbance of 383 nm. This liquid exhibits a blue-violet fluorescence.

EXAMPLE 35

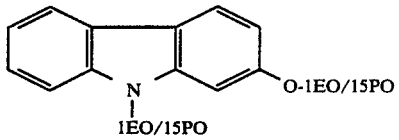

Ninety two grams (0.5 mole) of 2-hydroxycarbazole, 2 grams of dimethylaminocyclohexane catalyst, and 500 milliters of toluene are charged into a two liter pressure reactor. The mixture is purged with nitrogen to 5 psi and heated to 90° C. Forty four grams (1 mole) ethylene oxide are added. After 90 minutes at 90° C. eight hundred and seventy grams (15 moles) propylene oxide are added to the reactor. After 5 hours hold time, the contents of the reactor are stripped of all volatiles under reduced pressure at 110° C. for 45 minutes to give a liquid with a maximum absorbance of 300 nm. This liquid exhibits a blue fluorescence.

EXAMPLE 36

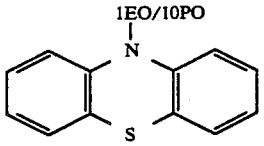

Two hundred and ninety-nine grams (1.5 moles) phenothiazine, 300 milliters of toluene, and 0.5 grams of tetrabutylammonium bromide are charged into a two liter pressure vessel. The mixture is stripped at 93° C. for 15 minutes, then purged with nitrogen to 5 psi. The mixture is heated to 120° C. and 70 grams (1.6 moles) ethylene oxide are added. After 150 minutes 2 grams of potassium hydroxide catalyst are added and the reaction mixture is stripped for 15 minutes. Eight hundred and seventy grams (15 moles) propylene oxide are then added to the reactor and the mixture is heated at 120° C. for 24 hours. Afterwards, the contents of the reactor are stripped of all volatiles under reduced pressure at 1198° C. for 45 minutes to give 1224 grams of a liquid with a maximum absorbance of 308 nm. This liquid exhibits a blue fluorescence.

EXAMPLE 37

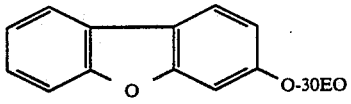

One hundred eighty three grams (1 mole) 2-hydroxydibenzofuran, 2 grams of potassium hydroxide catalyst, and 250 milliters of methylisobutyl ketone are charged into a two liter pressure reactor. The mixture is stripped at 93° C. for 15 minutes, then purged with nitrogen to 5 psi. The mixture is heated to 120° C. and 1320 grams (30 moles) ethylene oxide are added. After 5 hours hold time, the contents of the reactor are stripped of all volatiles under reduced pressure at 110° C. for 45 minutes to give a liquid with a maximum absorbance of 310 nm. This liquid exhibits a blue violet fluorescence.

TABLE I

| | $R_4$—CH=CH—$R_5$ | |
|---|---|---|
| Entry | $R_4$ | $R_5$ |
| 1 | 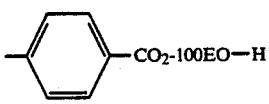  | 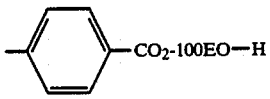  |
| 2 | 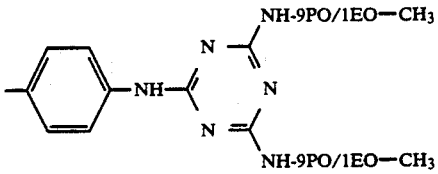  | 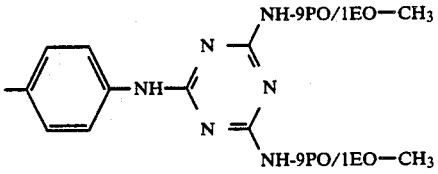  |
| 3 | 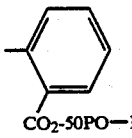  | 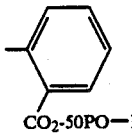  |
| 4 | 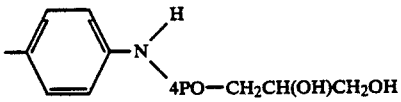  | 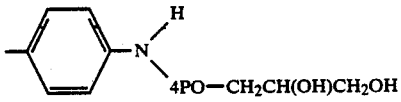  |
| 5 | 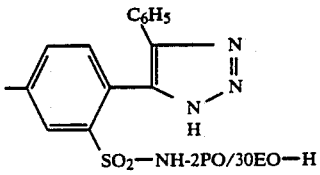  | 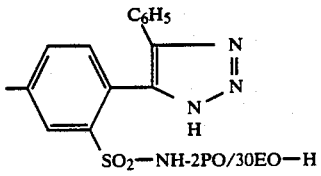  |
| 6 | 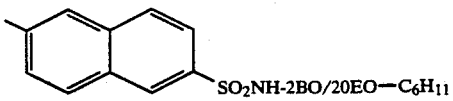  | 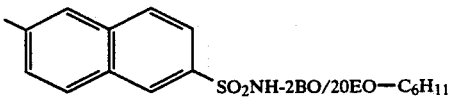  |

TABLE I-continued
| | $R_4$—CH=CH—$R_5$ | |
|---|---|---|
| 7 | 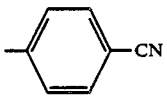 | 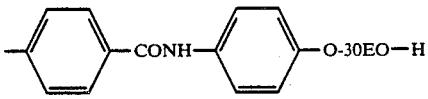 |
| 8 | 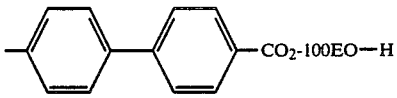 | 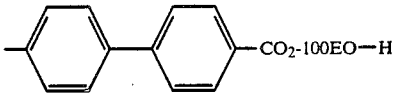 |
| 9 | 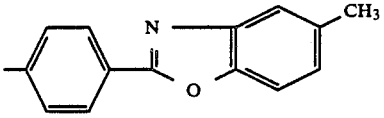 | 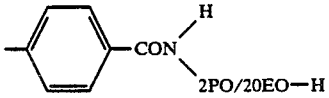 |
| 10 | 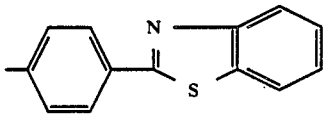 | 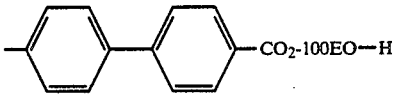 |
| 11 | 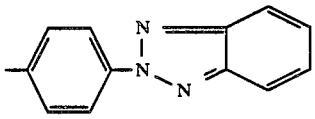 | 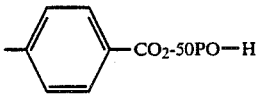 |
| **Entry** | **$R_6$** | **$R_5$** |
| 12 | 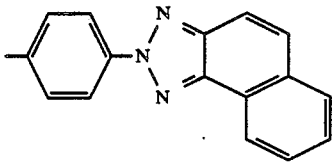 | 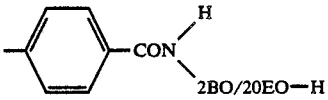 |
| 13 | 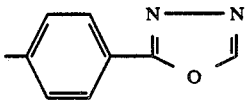 | 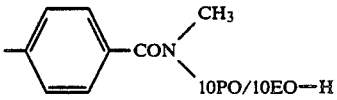 |
| 14 | 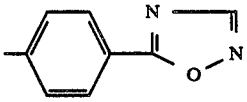 | 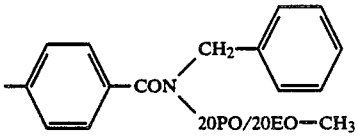 |
| 15 | 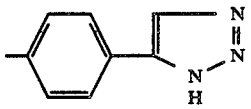 | 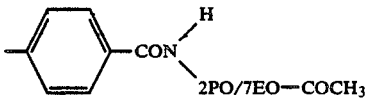 |
| 16 | 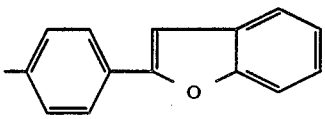 | 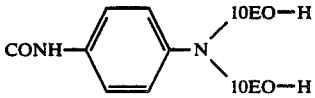 |
| 17 | 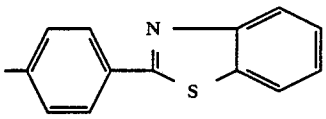 | 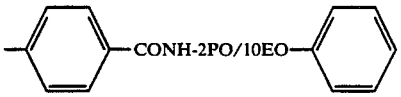 |

TABLE I-continued
| | $R_4$—CH=CH—$R_5$ | |
|---|---|---|
| 18 | 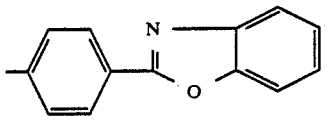 | 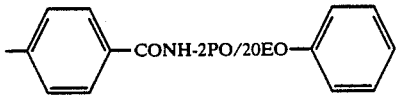 |
| 19 | 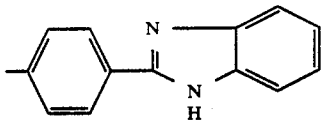 | 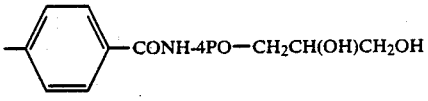 |
| 20 | 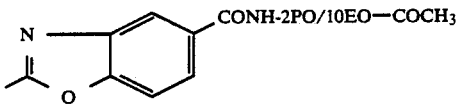 | 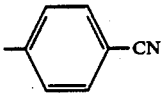 |
| 21 | 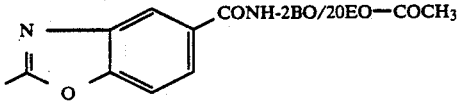 | 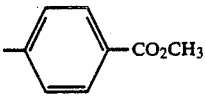 |
| 22 | 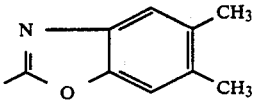 | 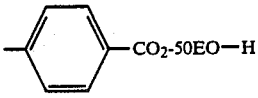 |
| 23 | 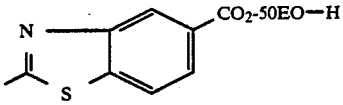 | 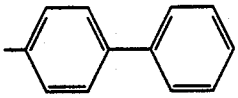 |
| 24 | 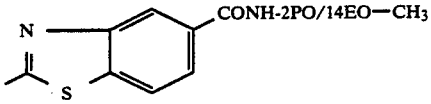 | 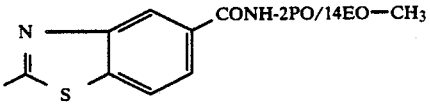 |
| 25 | 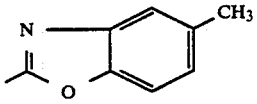 | 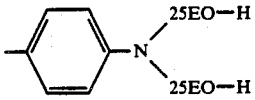 |
| 26 | 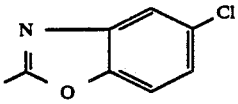 | 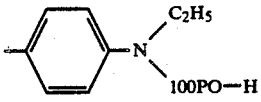 |
| 27 | 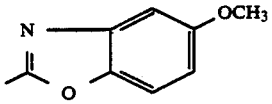 | 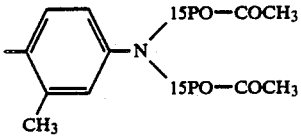 |
| 28 | 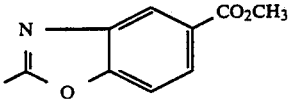 | 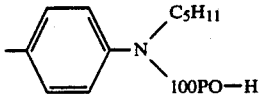 |
| 29 | 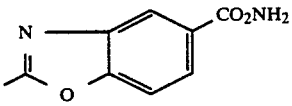 | 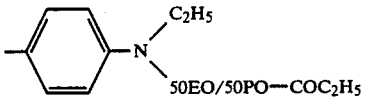 |

TABLE I-continued
| | $R_4$—CH=CH—$R_5$ | |
|---|---|---|
| 30 | 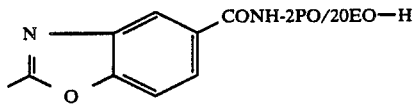 | 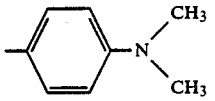 |
| 31 | 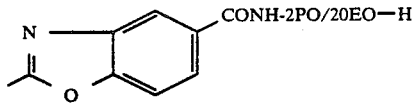 | 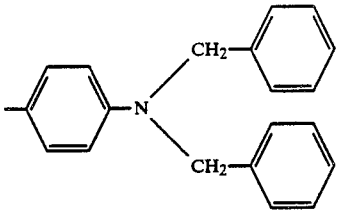 |
| 32 | 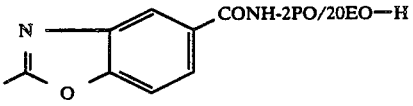 | 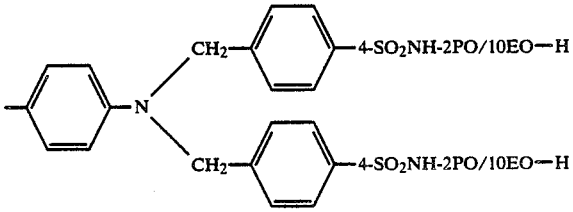 |
| 33 | 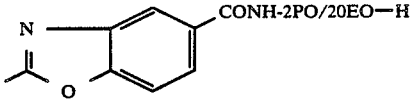 | 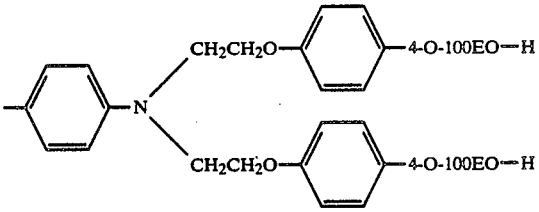 |
| 34 | 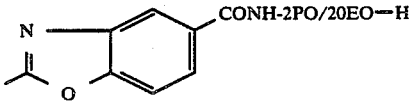 | 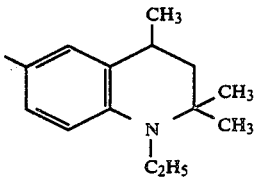 |
| 35 | 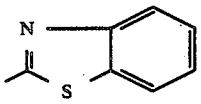 | 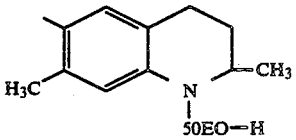 |
| 36 | 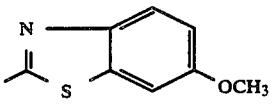 | 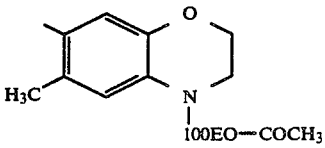 |
| 37 | 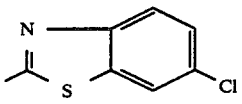 | 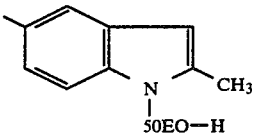 |

TABLE I-continued
| | $R_4$—CH=CH—$R_5$ | |
|---|---|---|
| 38 | 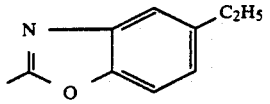 | 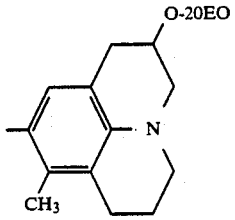 |
| 39 | 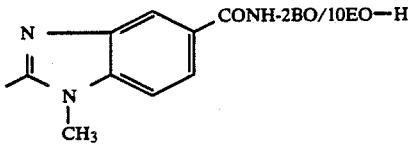 | 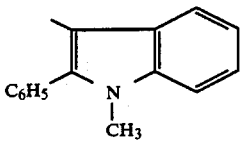 |
| 40 | 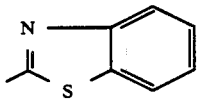 | 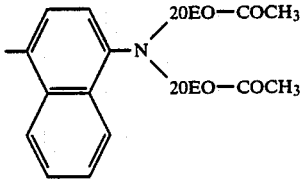 |
| 41 | 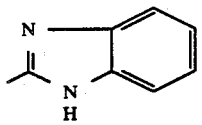 | 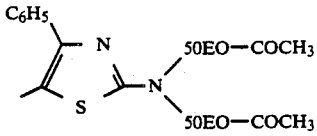 |
| 42 | 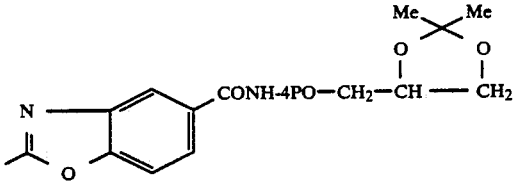 | 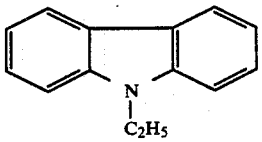 |
| 43 | 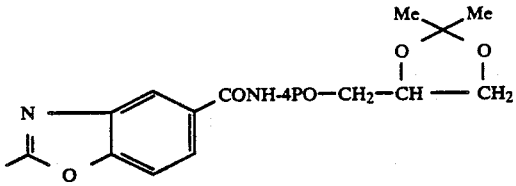 | 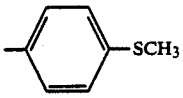 |
| 44 | 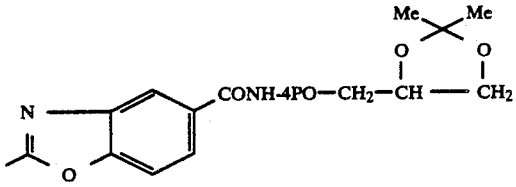 | 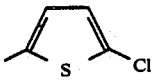 |
| 45 | 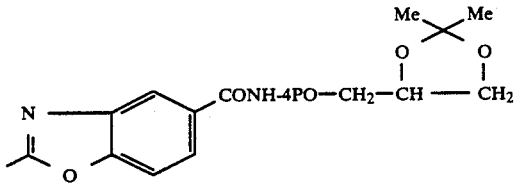 | 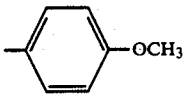 |

TABLE I-continued
| | $R_4—CH=CH—R_5$ | |
|---|---|---|
| 46 | 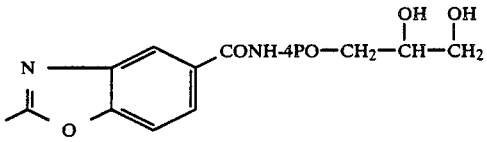 | 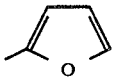 |
| 47 | 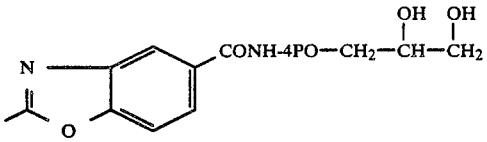 | 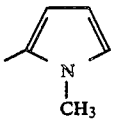 |
TABLE II
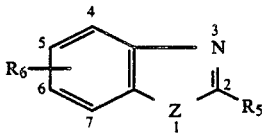
| Entry | $R_6$ | $R_5$ | Z |
|---|---|---|---|
| 1 | H | 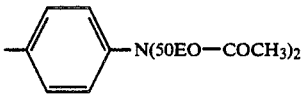 | O |
| 2 | 5,6-dimethyl | 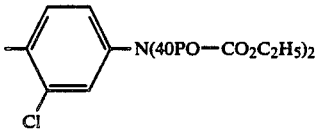 | O |
| 3 | 5-chloro | 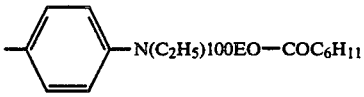 | O |
| 4 | 5-phenyl | 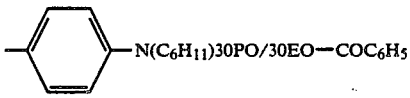 | O |
| 5 | $5\text{-}OC_2H_5$ | 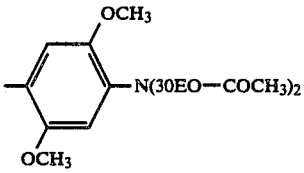 | O |
| 6 | $5\text{-CONH-2PO/14EO—}CH_3$ | 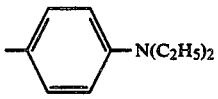 | O |
| 7 | $5\text{-CONH-4POCH}_2\text{CH(OH)CH}_2\text{OH}$ | 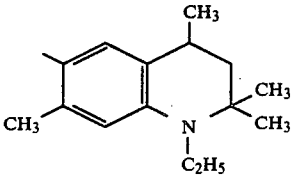 | O |

TABLE II-continued
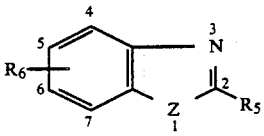
| Entry | $R_6$ | $R_5$ | Z |
|---|---|---|---|
| 8 | 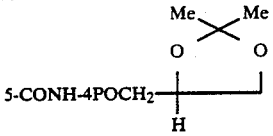 | 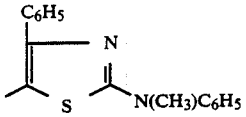 | O |
| 9 | H | 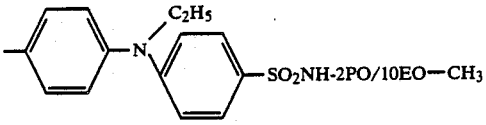 | O |
| 10 | 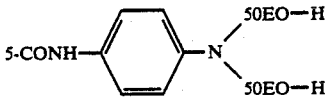 | 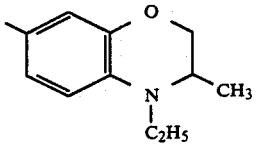 | O |
| 11 | 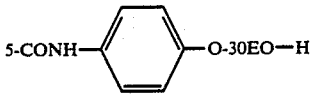 | 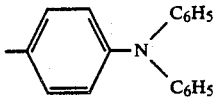 | O |
| 12 | H | 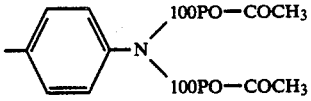 | S |
| 13 | H | 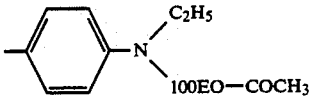 | S |
| 14 | H | 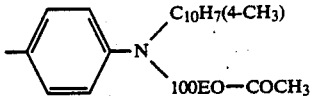 | S |
| 15 | H | 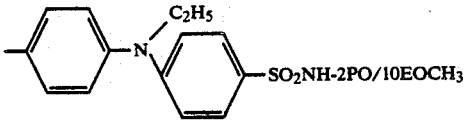 | S |
| 16 | H | 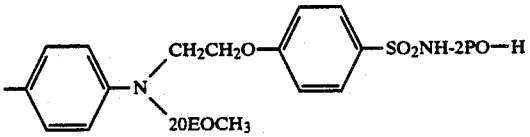 | S |
| 17 | 6-Br | 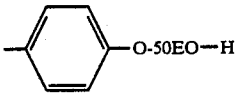 | S |
| 18 | 6-$CH_3$ | 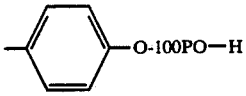 | S |

TABLE II-continued
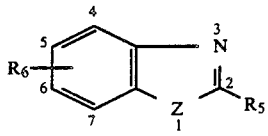
| Entry | $R_6$ | $R_5$ | Z |
|---|---|---|---|
| 19 | 5-$CO_2$-10EO—H | 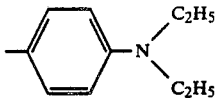 | S |
| 20 | 5-CONH-2EO/20EO—$CH_3$ | 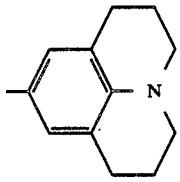 | S |
| 21 | 5-CONH-2PO/14EO—$CH_3$ | 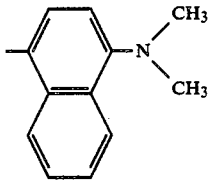 | S |
| 22 | 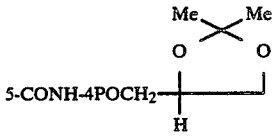 | 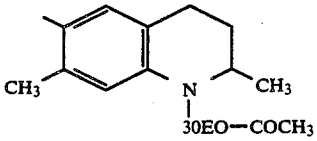 | S |
| 23 | 5-CONH-2PO/13EO—H | 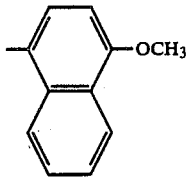 | S |
| 24 | 6-$SCH_3$ | 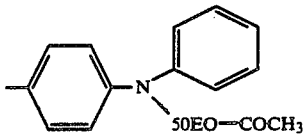 | S |
| 25 | 6-$C_6H_5$ | 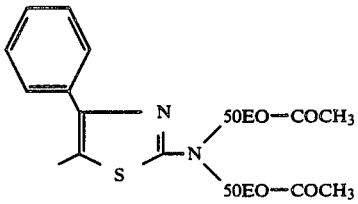 | S |
| 26 | 5-CONH-2PO/10EO—$CH_3$ | 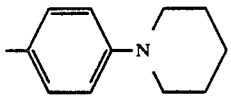 | S |

TABLE II-continued
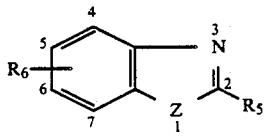
| Entry | $R_6$ | $R_5$ | Z |
|---|---|---|---|
| 27 | H | 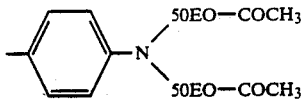 | NH |
| 28 | H | 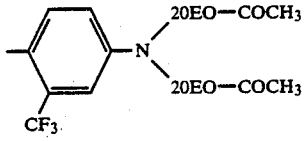 | $N(CH_3)$ |
| 29 | H | 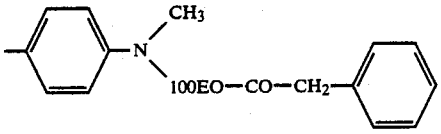 | $N(C_2H_5)$ |
| 30 | H | 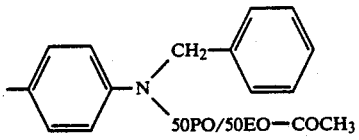 | $N(C_6H_5)$ |
| 31 | 5,6-di$CH_3$ | 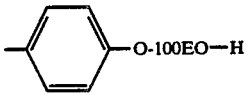 | $N(C_6H_{11})$ |
| 32 | 5-chloro | 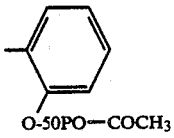 | $N(CH_2C_6H_5)$ |
| 33 | 5-CONH-2PO/10EO—$CH_3$ | 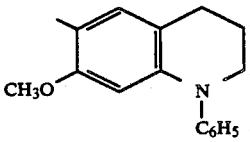 | NH |
| 34 | 5-$CO_2$-100EO—H | 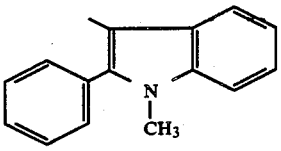 | NH |
| 35 | 5-CONH-4POCH$_2$CH(OH)CH$_2$CH | 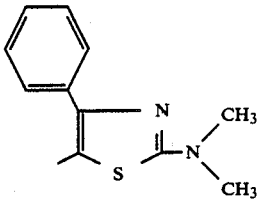 | NH |

TABLE II-continued
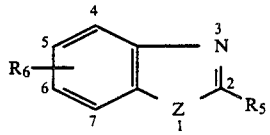
| Entry | $R_6$ | $R_5$ | Z |
|---|---|---|---|
| 36 | 5-CONH-4POCH$_2$CH(OH)CH$_2$CH | 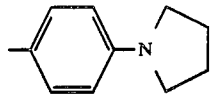 | NH |
| 37 | 5-CONH-4POCH$_2$CH(OH)CH$_2$CH | 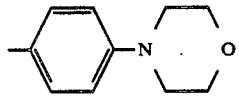 | NH |
| 38 | 5-CONH-4POCH$_2$CH(OH)CH$_2$CH | 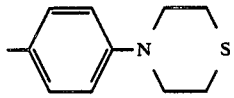 | NH |
| 39 | 5-CONH-4POCH$_2$CH(OH)CH$_2$CH | 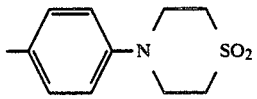 | NH |
| 40 | 5-CONH-4POCH$_2$CH(OH)CH$_2$CH | 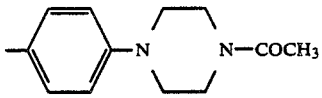 | NH |
| 41 | 5-CONH-4POCH$_2$CH(OH)CH$_2$CH | 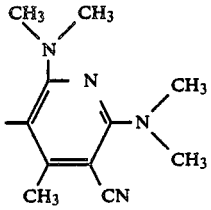 | NH |
| 42 | H | 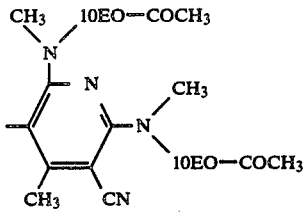 | NH |
| 43 | H | 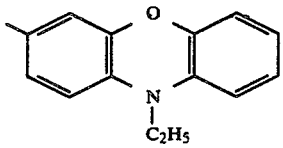 | NH |
| 44 | H | 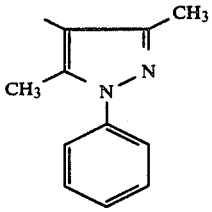 | NH |

TABLE II-continued
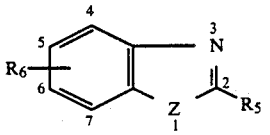
| Entry | $R_6$ | $R_5$ | Z |
|---|---|---|---|
| 45 | 5-$CO_2$-100EO—H | 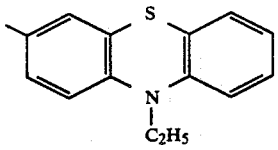 | O |
| 46 | 5-CONH-2PO/20EO—$CH_3$ | 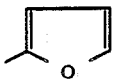 | O |
| 47 | 5-CONH-2PO/20EO—$CH_3$ | 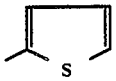 | O |
| 48 | 5-CONH-2PO/20EO—$CH_3$ | 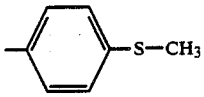 | O |
| 49 | 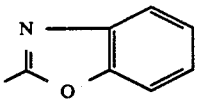 | 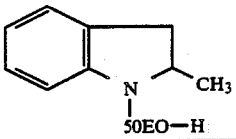 | O |

TABLE III
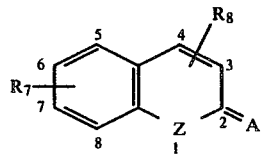
| Entry | $R_7$ | $R_8$ | A | Z |
|---|---|---|---|---|
| 1 | 7-O—40EO—H | 3-CN | O | O |
| 2 | 6,7-di-O—20EO—H | 3-$CO_2CH_3$ | O | O |
| 3 | 7-[—O—$C_6H_4$—$SO_2$—N(H)(2PO/10EO—$CH_3$)] | 3-$CONH_2$ | NH | O |
| 4 | 7-[—N(50EO—$COCH_3$)(50EO—$COCH_3$)] | 4-$CH_3$ | O | O |
| 5 | 7-[—N($C_2H_5$)(30EO/20PO—H)] | 4-$C_5H_6$ | O | O |
| 6 | 7-[—N($CH_2$—$C_6H_5$)(50PO—$CO_2C_2H_5$)] | 4-$CH_2CO_2CH_3$ | O | O |
| 7 | 7-[—N($C_6H_{11}$)(20EO—CON(H)($C_6H_5$))] | 3-$SO_2CH_3$ | O | O |

TABLE III-continued
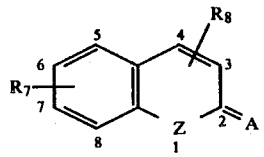
| Entry | $R_7$ | $R_8$ | A | Z |
|---|---|---|---|---|
| 8 | 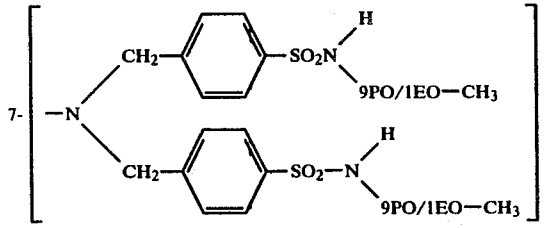 | 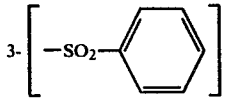 | O | O |
| 9 | 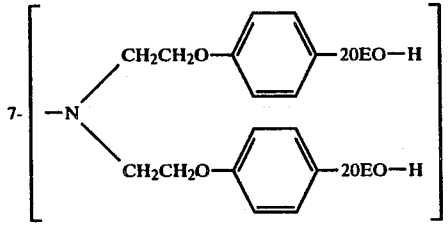 | 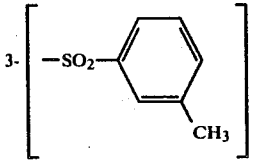 | NH | O |
| 10 | 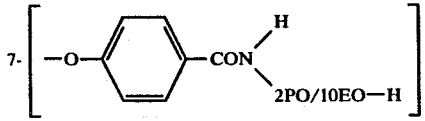 | 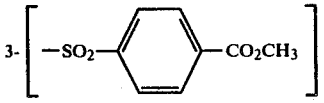 | O | O |
| 11 | 7-[—$OCH_2CO_2$—100-EO—H] | 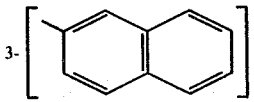 | O | O |

TABLE III-continued
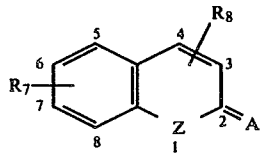
| Entry | $R_7$ | $R_8$ | A | Z |
|---|---|---|---|---|
| 12 | 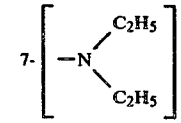 | 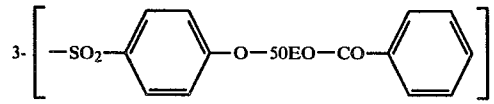 | O | O |
| 13 | 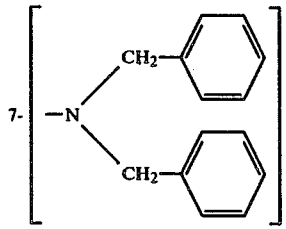 | 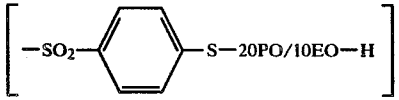 | O | S |
| 14 | 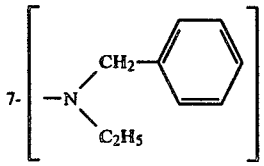 | 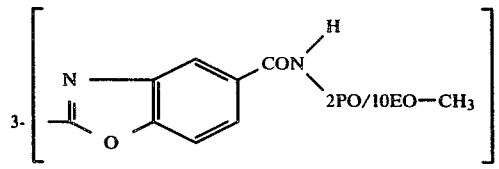 | O | O |
| 15 | 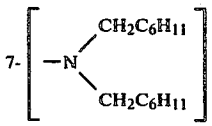 | 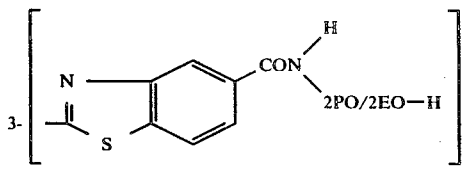 | O | O |

TABLE III-continued
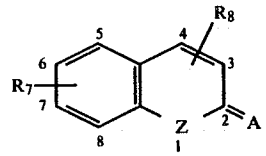
| Entry | $R_7$ | $R_8$ | A | Z |
|---|---|---|---|---|
| 16 | 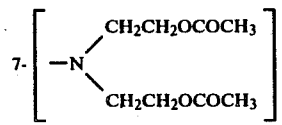 | 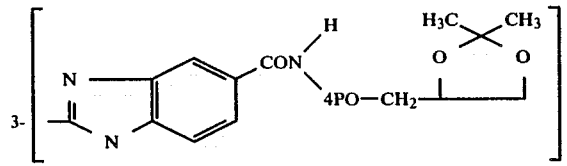 | O | O |
| 17 | 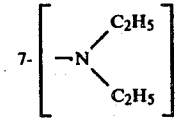 | 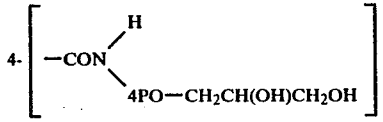 | O | O |
| 18 | 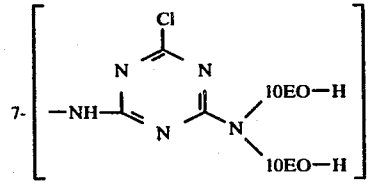 | 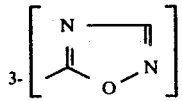 | O | O |
| 19 | 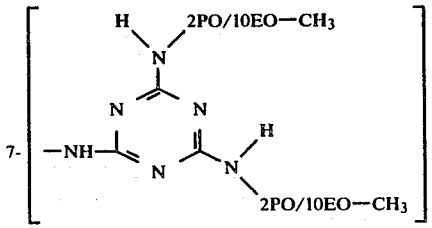 | 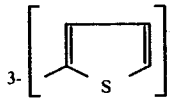 | O | O |

TABLE III-continued
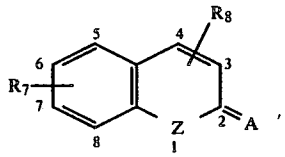
| Entry | $R_7$ | $R_8$ | A | Z |
|---|---|---|---|---|
| 20 | 6,7-di-OH | 3-[—CON(H)—2PO/20EO—H] | O | O |
| 21 | 6,7-di-$OC_2H_5$ | 3-[—CON($CH_3$)—10PO/10EO—H] | O | O |
| 22 | H | 3-[—CON(H)—$C_6H_4$—4-O—30EO—H] | O | O |
| 23 | 7-[ 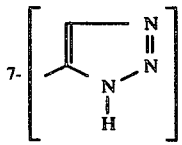 | 3-[—CONH— 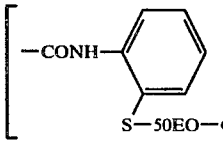 S—50EO—$CH_3$] | O | O |
| 24 | 7-[ 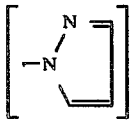 | 3-[—CON(H)—$CH_2$— 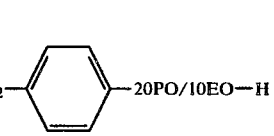 —20PO/10EO—H] | O | O |
| 25 | 7-[ 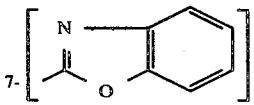 | 3-$CO_2$—100EO—H | O | O |

TABLE III-continued
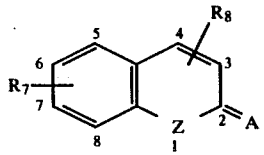
| Entry | $R_7$ | $R_8$ | A | Z |
|---|---|---|---|---|
| 26 | 7-O—20PO/20EO— 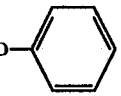 | 3- 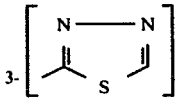 | O | O |
| 27 | 7- 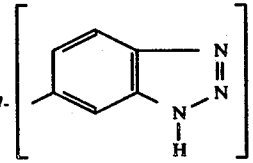 | 3- 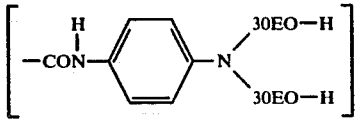 | O | O |
| 28 | 7- 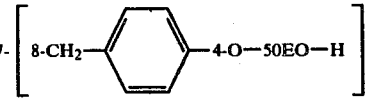 | 3-$C_6H_5$ | O | O |
| 29 | 7- 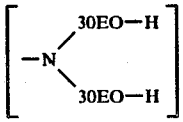 | 3- 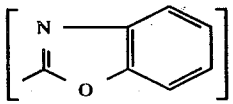 | O | $N(C_2H_5)$ |
| 30 | 7- 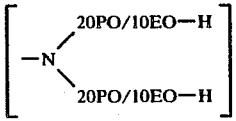 | 3- 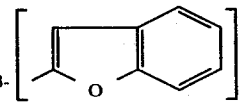 | O | $N(CH_3)$ |

TABLE III-continued
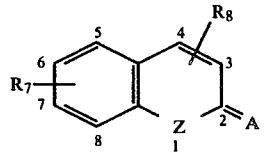
| Entry | $R_7$ | $R_8$ | A | Z |
|---|---|---|---|---|
| 31 | 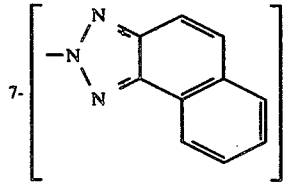 | 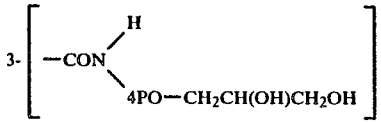 | O | O |
| 32 | 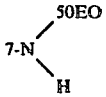 | H | O | O |
| 33 | H | 8-O—50EO—H | O | O |

TABLE IV
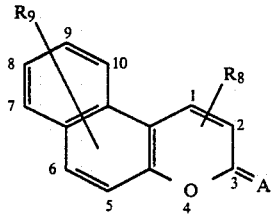
| Entry | $R_8$ | $R_9$ | A |
|---|---|---|---|
| 1 | H | 8-O—50EO—H | O |
| 2 | 1-$C_6H_5$ | 8-O—30PO—$CH_3$ | O |
| 3 | 1-$CH_3$ | 8-O—20EO/30PO— 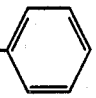 | O |
| 4 | 2-$CO_2CH_3$ | 8-O—100EO—H | O |
| 5 | 2-CN | 6-O—50EO—$COCH_3$ | O |
| 6 | 2-$CONH_2$ | 6-O— 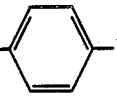 —30EO—H | O |
| 7 | 2-CON(H)$C_6H_5$ | 6- [ —O— 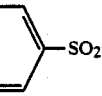 —$SO_2$—N(H)—2PO/10EO—$CH_3$ ] | O |
| 8 | 2-$SO_2CH_3$ | 8-O—$CH_2CH_2OH$ | O |
| 9 | 2-$SO_2$— 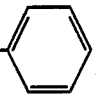 | 7- [ —O— 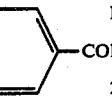 —CON(H)—2PO/20EO—$CH_3$ ] | O |
| 10 | 2- [ 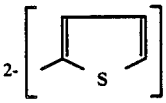 ] | 8- [ —$OCH_2$—CON(H)—2PO/10EO— 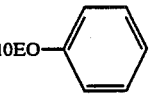 ] | O |
| 11 | 3- [ 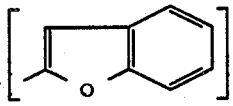 ] | 8-O—10EO/20BO—H | O |
| 12 | 3- [ 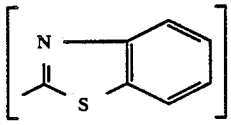 ] | 6-O—20EO—$COOC_2H_5$ | N($CH_3$) |
| 13 | 3- [ 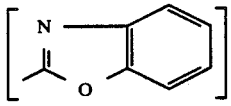 ] | 6- [ —O—30EO—CO— 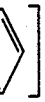 ] | O |
| 14 | 3-$CO_2$—100EO—H | H | O |
| 15 | 3-$CO_2$—50EO—H | 8-$CH_3$ | NH |

TABLE IV-continued
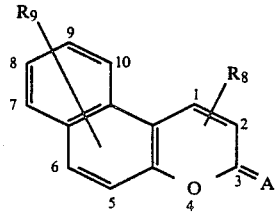
| Entry | $R_8$ | $R_9$ | A |
|---|---|---|---|
| 16 | 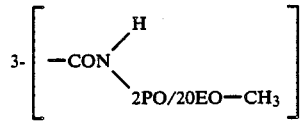 | 6-O—$C_2H_5$ | O |
| 17 | 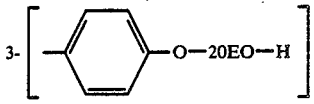 | H | O |
| 18 | 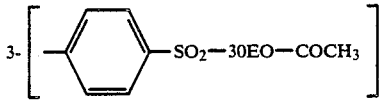 | H | O |
| 19 | 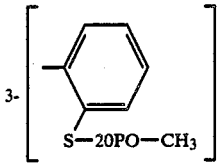 | H | O |
| 20 | 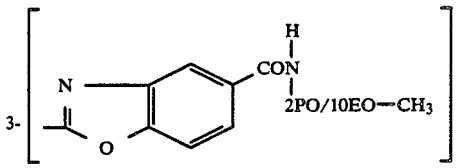 | H | O |
| 21 | 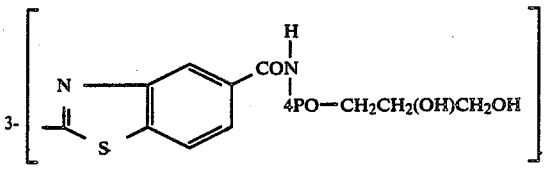 | H | O |
| 22 | 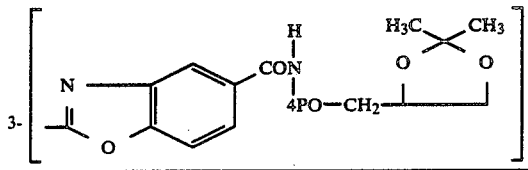 | H | O |

TABLE V

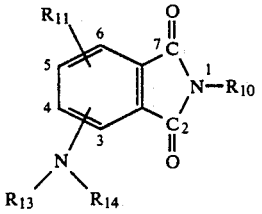

| Entry | $R_{10}$ | $R_{11}$ | p* | $R_{13}$ | $R_{14}$ |
|---|---|---|---|---|---|
| 1 | 2PO/14EO—$CH_3$ | H | 4 | H | H |
| 2 | 4PO/$CH_2CH(OH)CH_2OH$ | H | 4 | $CH_3$ | $CH_3$ |
| 3 | 9PO/1EO—$CH_3$ | H | 4 | $CH_3$ | $C_6H_{11}$ |
| 4 | 2PO/14EO—$CH_3$ | H | 3 | $CH_2CH_2OH$ | $CH_2CH_2OH$ |
| 5 | 2PO/10EO—$CH_3$ | H | 3 | H | $CH_2C_6H_{11}$ |
| 6 | 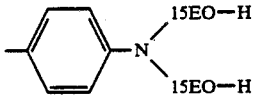 | H | 3 | H | $CH_2C_6H_5$ |
| 7 | 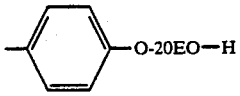 | H | 4 | $CH_2C_6H_5$ | $CH_2C_6H_5$ |
| 8 | 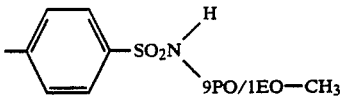 | 4-$CH_3$ | 3 | $CH_2CH_2OCH_3$ | $CH_2CH_2OCH_3$ |
| 9 | 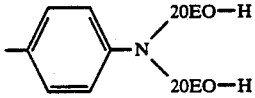 | 3,6-di-$CH_3$ | 4 | $CH_2CH_2OCOCH_3$ | $CH_2CH_2OCOCH_3$ |
| 10 | 4PO—$CH_2CH(OH)CH_2OH$ | 3-Cl | 4 | $CH_2CH_2CO_2CH_3$ | H |
| 11 | 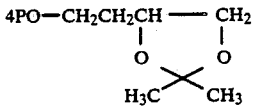 | 3-Br | 4 | 20EO—H | 20EO—H |
| 12 | 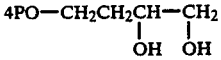 | 4,5-diCl | 3 | 30PO—$COCH_3$ | $C_2H_5$ |
| 13 | H | H | 4 | 50EO—$COCH_3$ | $C_6H_{11}$ |
| 14 | H | H | 4 | 25EO/10PO—H | $CH_2C_6H_5$ |
| 15 | $CH_3$ | H | 4 | $CH_2CH_2O$-10PO—H | $C_6H_5$ |
| 16 | $C_6H_5$ | H | 4 | 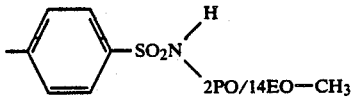 | $CH_3$ |
| 17 | $CH_2C_6H_5$ | H | 4 | 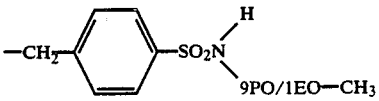 | $C_2H_5$ |
| 18 | $CH_2CH_2O$-10PO—$COCH_3$ | H | 3 | $CH_2CH_2OH$ | $CH_2CH_2OH$ |
| 19 | 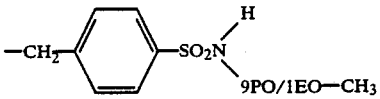 | H | 3 | $CH_2CH_2NHCOCH_3$ | $C_2H_5$ |

TABLE V-continued
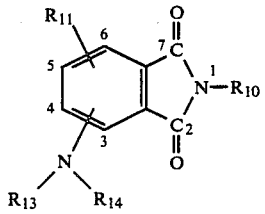
| Entry | $R_{10}$ | $R_{11}$ | p* | $R_{13}$ | $R_{14}$ |
|---|---|---|---|---|---|
| 20 | 4PO—CH₂CH—CH₂ (O, O; H₃C, CH₃) | H | 4 | OCH₃; N, N, N; 20EO—H, 20EO—H | H |
| 21 | -4PO—CH₂CH(OH)CH₂OH | H | 4 | H, 9PO/1EO—CH₃; N, N, N; 9PO/1EO—CH₃, H | H |
| 22 | -4POCH₂CH(OCOCH₃)OCOCH₃ | H | 4 | $COCH_3$ | H |
| 23 | N, 15EO—H, 15EO—H | H | H | $COC_6H_5$ | H |
| 24 | S-20EO—$COCH_3$ | H | H | CON, H, $C_6H_5$ | H |
| 25 | $SO_2N$, H, 9PO/1EO—$CH_3$ | H | H | $SO_2CH_3$ | H |
| 26 | N, 20EO—$COCH_3$, 20EO—$COCH_3$ | H | H | $SO_2$—$CH_3$ | H |
| 27 | -4PO—$CH_2CH(OCO_2C_2H_5)CH_2OCO_2C_2H_5$ | H | H | $CO_2C_2H_5$ | H |
p*indicates position of N—$(R_{13})R_{14}$ on phthalimide ring.

TABLE VI

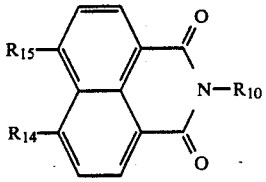

| Entry | $R_{10}$ | $R_{14}$ | $R_{15}$ |
|---|---|---|---|
| 1 | -2PO/14EO—$CH_3$ | H | H |
| 2 | -4PO—$CH_2CH(Cl)CH_2Cl$ | $OCH_3$ | H |
| 3 | -2PO/14EO—$CH_2CH_3$ | $CH_3$ | $CH_3$ |
| 4 | -4PO—$CH_2CH$—$CH_2$ (O, O; $H_3C$, $CH_3$) | $OC_2H_5$ | $OC_2H_5$ |
| 5 | -4PO—$CH_2CH(OH)CH_2OH$ | $OC_6H_5$ | $OC_6H_5$ |
| 6 | -4PO—$CH_2CH(OCOCH_3)CH_2OCOCH_3$ | $SC_6H_5$ | H |
| 7 | —O-20EO—H | —S—Cl | —S—Cl |
| 8 | —N(15EO—$COCH_3$)(15EO—$COCH_3$) | $SCH_2CH_3$ | $SCH_2CH_3$ |
| 9 | —$SO_2N$(H)(2PO/14EO—$CH_3$) | $NHCOCH_3$ | H |
| 10 | —N(15EO—H)(15EO—H) | $NHCOC_6H_{11}$ | H |
| 11 | —O—20EO—H | $NHCO_2C_2H_5$ | H |
| 12 | —$CH_2CH_2$O-20EO—H | $NHSO_2$-n-$C_4H_9$ | H |
| 13 | —$CH_2$—$SO_2N$(H)(2PO/14EO—$CH_3$) | —NH—(N)(N)—$OCH_3$, $OCH_3$ | H |
| 14 | -4PO—$CH_2CH$—$CH_2$ (O, O; $H_3C$, $CH_3$) | Cl | H |
| 15 | —H | —O—$SO_2N$(H)(2PO/14EO—$CH_3$) | H |

TABLE VI-continued
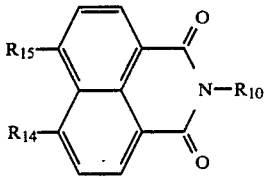
| Entry | $R_{10}$ | $R_{14}$ | $R_{15}$ |
|---|---|---|---|
| 16 | $-CH_3$ | 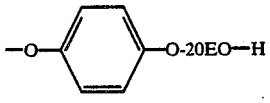 | 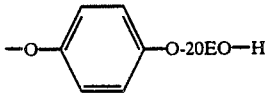 |
| 17 | $-CH_2CH(C_2H_5)$-n-$C_4H_9$ | $-O-CH_2CH_2O$-20PO$-COCH_3$ | H |
| 18 | $-CH_2CH_2CH_2OCH_3$ | 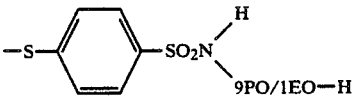 | H |
| 19 | -n-$C_4H_9$ | 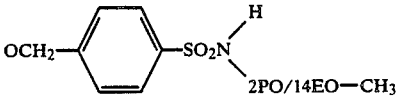 | H |
| 20 | $-C_6H_5$ | 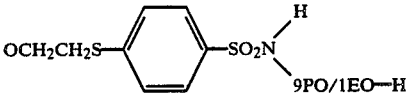 | H |
| 21 | $-C_6H_{11}$ | 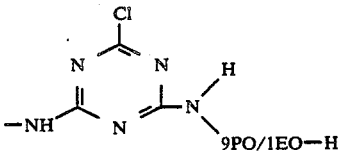 | H |
| 22 | 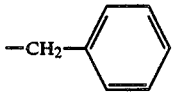 | 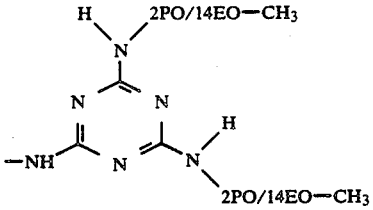 | H |
| 23 | 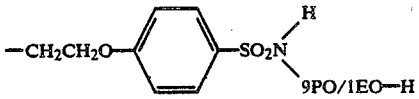 | 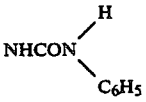 | H |
| 24 | 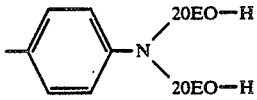 | CN | CN |
| 25 | 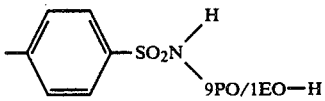 | $CO_2CH_3$ | $CO_2CH_3$ |
| 26 | 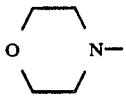 | H | 2PO/14EO$-CH_3$ |

TABLE VI-continued

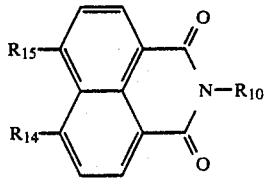

| Entry | $R_{10}$ | $R_{14}$ | $R_{15}$ |
|---|---|---|---|
| 27 | -2PO/14EO—$CH_3$ | H | 2PO/14EO—$CH_3$ |

TABLE VII

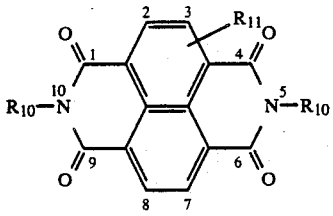

| Entry | $R_{10}$ | $R_{11}$ |
|---|---|---|
| 1 | -4PO—$CH_2CH$—$CH_2$ (O, O; Me, Me) | H |
| 2 | -4PO—$CH_2CH(OH)CH_2OH$ | 2-$CH_3$ |
| 3 | -4PO—$CH_2CH(OCOCH_3)CH_2OCOCH_3$ | 2,6-di-Cl |
| 4 | -2PO/14EO—$CH_3$ | 2-$OCH_3$ |
| 5 | —$CH_2CH_2S$-20EO—H | H |
| 6 | —$CH_2CH_2CH_2SO_2$—(C6H4)—O-20EO—H | H |
| 7 | —(C6H4)—N(20EO—H)(20EO—H) | H |
| 8 | —(C6H4)—$SO_2$-30EO—$COCH_3$ | H |

TABLE VII-continued

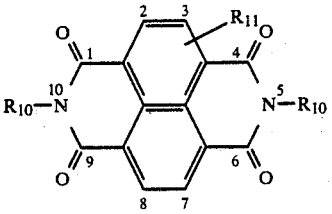

| Entry | $R_{10}$ | $R_{11}$ |
|---|---|---|
| 9 | —$CH_2CH_2S$—(C6H4)—$SO_2N$($CH_3$)(20EO—$COCH_3$) | H |
| 10 | —$CH_2$—(C6H4)—$SO_2N$(H)(2PO/14EO—$CH_3$) | H |
| 11 | —(C6H4)—$SO_2$-4PO—$CH_2CH$—(O, O; Me, Me) | H |
| 12 | —(C6H4)—$SO_2$-4PO—$CH_2CH$(OH)—$CH_2$(OH) | H |

TABLE VIII

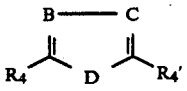

| Entry | $R_4$ | $R_4'$ | B | C | D |
|---|---|---|---|---|---|
| 1 | —(C6H4)—$CO_2$-100EO—H | —(C6H4)—$CO_2$-100EO—H | N | N | O |
| 2 | —(C6H4)—CONH(2PO/14EO—$CH_3$) | —(C6H4)—CON(H)(20PO/14EO—$CH_3$) | N | N | O |
| 3 | —(C6H4)—$SO_2N$(H)(9PO/1EO—$CH_3$) | —(C6H4)—$SO_2N$(H)(9PO/1EO—$CH_3$) | N | N | S |

TABLE VIII-continued
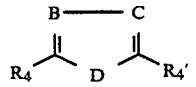
| Entry | $R_4$ | $R_4'$ | B | C | D |
|---|---|---|---|---|---|
| 4 | 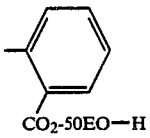  | 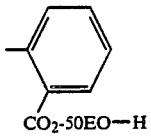  | N | N | S |
| 5 | 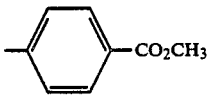  | 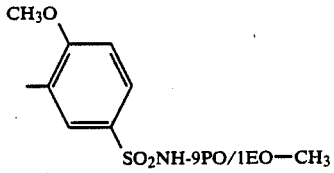  | N | N | O |
| 6 | 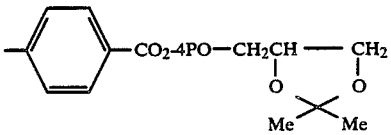  | 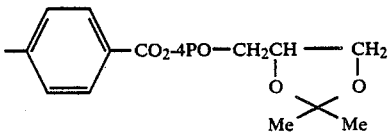  | CH | CN | S |
| 7 | 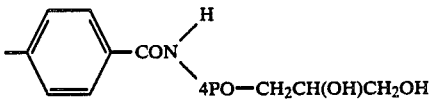  | 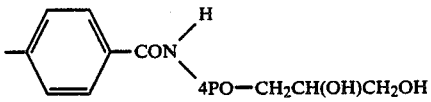  | CH | CN | O |
| 8 | 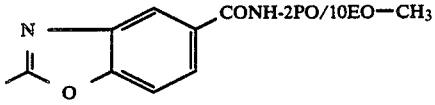  | 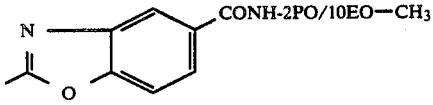  | N | N | O |
| 9 | 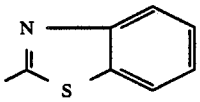  | 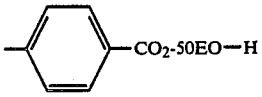  | N | N | S |
| 10 | 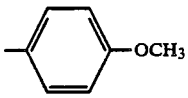  | 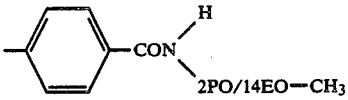  | N | N | O |
| 11 | 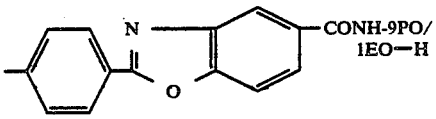  | 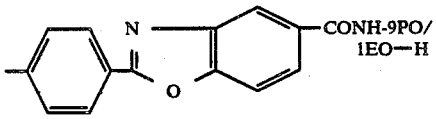  | N | N | O |
| 12 | 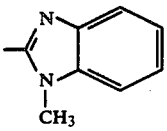  | 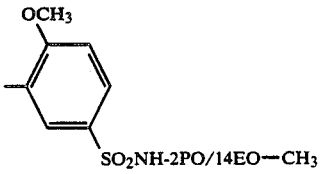  | CH | CN | O |
| 13 | 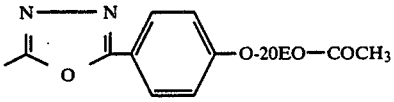  | 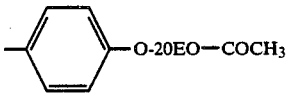  | N | N | O |

TABLE IX

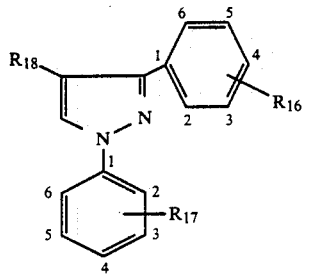

| Entry | $R_{16}$ | $R_{17}$ | $R_{18}$ |
|---|---|---|---|
| 1 | 4-Cl | 4-N(20EO—H)$_2$ | H |
| 2 | 3,4-di $CH_3$ | 4-O-(30EO—$COCH_3$)$_2$ | H |
| 3 | 2-$OCH_3$-5-$SO_2$NH-2PO/14EO—$CH_3$ | 2-$OCH_3$-5-$SO_2$NH-2PO/14EO—$CH_3$ | $CH_3$ |
| 4 | 2-$CH_3$-4,5-di-Cl | 4-$SO_2$NH-4PO—$CH_2CH(OH)CH_2OH$ | $C_6H_5$ |
| 5 | 4-Cl | 4-$SO_2$-20EO—$COCH_3$ | 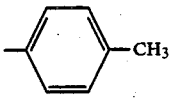 |
| 6 | 4-Cl | 4-Cl | $SO_2$NH-2PO/14EO—$CH_3$ |
| 7 | 4-$OCH_3$ | 4-N(50EO—H)$_2$ | H |
| 8 | H | 4-CONH2PO/14EO—$CH_3$ | H |
| 9 | H | 4-$CO_2$-100EO—H | $SO_2N(CH_3)$ |
| 10 | 4-Cl | 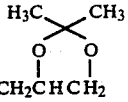 4-$SO_2$NH-4POCH$_2$CHCH$_2$ | H |
| 11 | H | 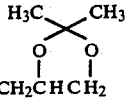 4-$SO_2$NH-4POCH$_2$CHCH$_2$ | H |
| 12 | 4-Cl | HO OH 4-$SO_2$NH-4POCH$_2$CHCH$_2$ | H |
| 13 | H | HO OH 4-$SO_2$NH-4POCH$_2$CHCH$_2$ | H |

TABLE X

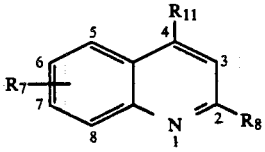

| Entry | $R_{11}$ | $R_7$ | $R_8$ |
|---|---|---|---|
| 1 | H | H | $CO_2$NH-9PO/1EO—Me |
| 2 | H | $SO_2$NH-2PO/14EO—Me | H |
| 3 | 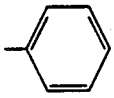 | H | $CO_2$NH-2PO/10EO—Me |
| 4 | 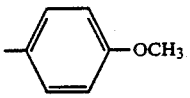 | H | $CO_2$NH-2PO/10EO—Me |

TABLE X-continued
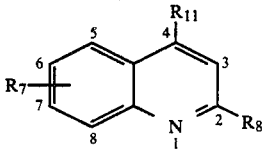
| Entry | $R_{11}$ | $R_7$ | $R_8$ |
|---|---|---|---|
| 5 | $-CH_2-CH_2-$ 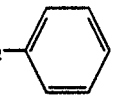 | H | $CO_2NH$-2PO/10EO—Me |
| 6 | $CH_3$ | H | $CO_2NH$-2PO/10EO—Me |
| 7 | 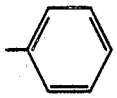 | 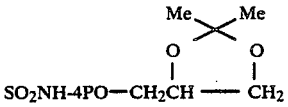 | H |
| 8 | 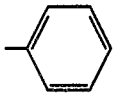 | 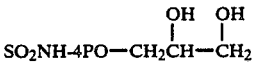 | H |
| 9 | $C_2H_5$ | $SO_2NH$-9PO/1EO—$CH_3$ | H |
| 10 | H | $SO_2NH$-2PO/30EO—$CH_3$ | H |
| 11 | —O-1EO/20PO | H | $CH_3$ |
TABLE XI
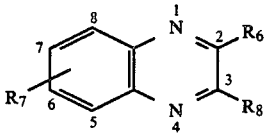
| Entry | $R_7$ | $R_6$ | $R_8$ |
|---|---|---|---|
| 1 | H | —NH-2PO/14EO—$CH_3$ | —NH-2PO/14EO—$CH_3$ |
| 2 | H | —O-12PO—H | —O-12PO—H |
| 3 | 6[—N(10EO)$_2$] | —O—$CH_3$ | —O—$CH_3$ |
| 4 | 6[(—N($C_2H_5$)$_2$] | —NH-9PO/1EO—$CH_3$ | —NH-9PO/1EO—$CH_3$ |
| 5 | H | 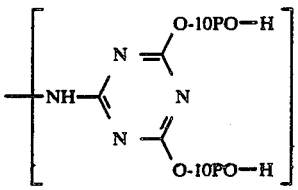 | 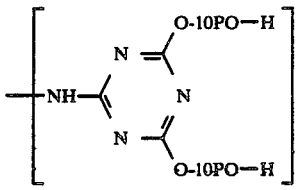 |
| 6 | H | 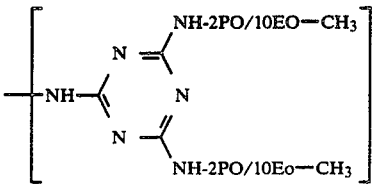 | 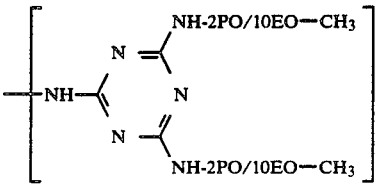 |
| 7 | 6[N(5PO)$_2$] | —O—$CH_2CH_2O$— | —O—$CH_2CH_2O$— |
| 8 | 6($NH_2$) | -(10EO)—H | -(10EO)—H |
| 9 | 6($NH_2$) | -(10EO—$CH_3$) | -(10EO—$CH_3$) |
| 10 | 6[N(5EO)$_2$] | —(NH-9PO/1EO—$CH_3$) | —(NH-9PO/1EO—$CH_3$) |

TABLE XI-continued
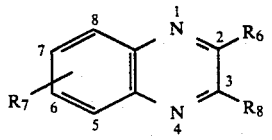
| Entry | $R_7$ | $R_6$ | $R_8$ |
|---|---|---|---|
| 11 | H | 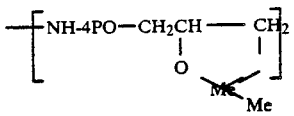 | 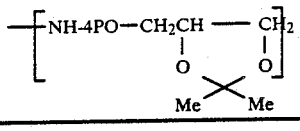 |
TABLE XII
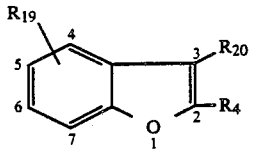
| Entry | $R_4$ | $R_{19}$ | $R_{20}$ |
|---|---|---|---|
| 1 | 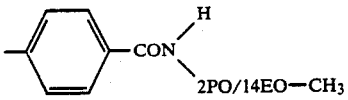 | H | H |
| 2 | 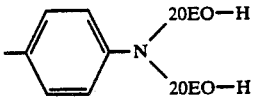 | 5,6-diCH$_3$ | H |
| 3 | 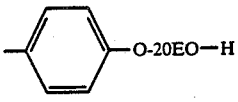 | 6-Cl | H |
| 4 | 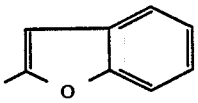 | 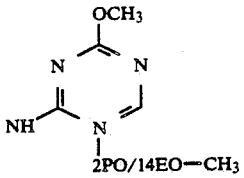 | CH$_3$ |
| 5 | 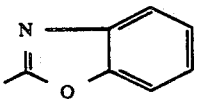 | 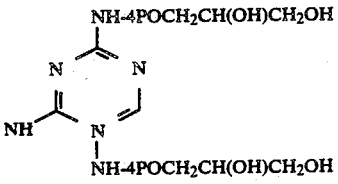 | H |
| 6 | 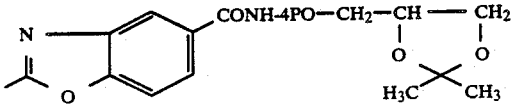 | 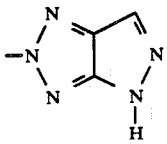 | H |
| 7 | 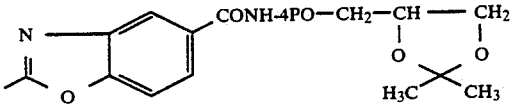 | 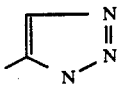 | H |

TABLE XII-continued
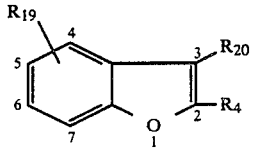
| Entry | $R_4$ | $R_{19}$ | $R_{20}$ |
|---|---|---|---|
| 8 | 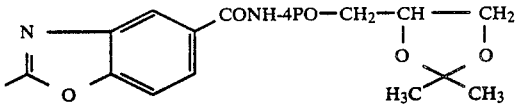 | 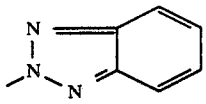 | H |
| 9 | 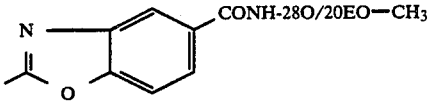 | H | H |
| 10 | 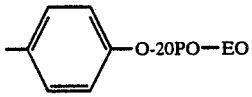 | 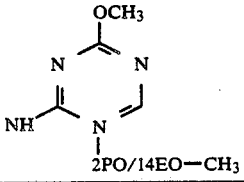 | H |
TABLE XIII
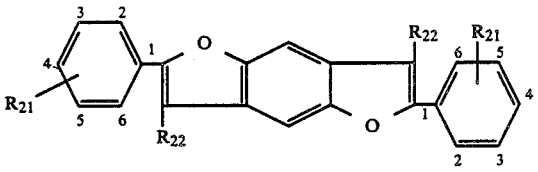
| Entry | $R_{21}$ | $R_{22}$ |
|---|---|---|
| 1 | 4-$SO_2NH$-2PO/14EO—$CH_3$ | H |
| 2 | 4-$SO_2NH$-4PO—$CH_2CH(OH)$—$CH_2(OH)$ | $CO_2CH_3$ |
| 3 | 4-O-20EO—$COCH_3$ | $CONH_2$ |
| 4 | 4-CONH-2PO/20EO— 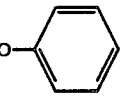 | $CO_2$— 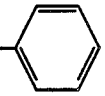 |
| 5 | H | $CO_2$-100EO—H |
| 6 | 4-$CH_3$ | CONH-2PO/14EO—$CH_3$ |
| 7 | 3,4-di-Cl | $SO_2NH$-9PO/1EO—$CH_3$ |
| 8 | 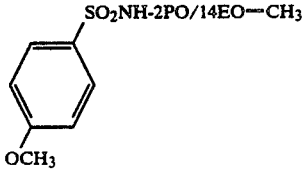 | $SO_2CH_3$ |
| 9 | 4-$CO_2$50EO—H | $SO_2N(CH_3)_2$ |
| 10 | 4-$CO_2$-20PO—H | $SO_2NH$-9PO/1EO—Me |
| 11 | 3-Cl | 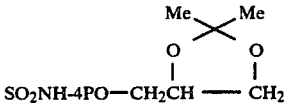 |

TABLE XIII-continued
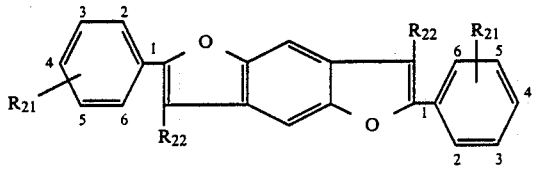
| Entry | $R_{21}$ | $R_{22}$ |
|---|---|---|
| 12 | H | $SO_2NH$-4PO—$CH_2CH(OH)$—$CH_2(OH)$ |
TABLE XIV
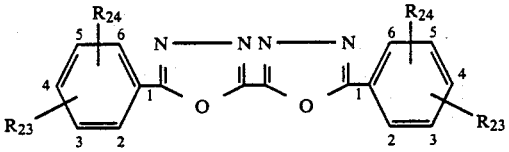
| Entry | $R_{23}$ | $R_{24}$ |
|---|---|---|
| 1 | 4-CONH-4PO—$CH_2$—CH(O—C(Me)(Me)—O)—$CH_2$ | H |
| 2 | 4-$CO_2$-100EO—H | H |
| 3 | 5-$SO_2N$(H)—2PO/14EO—$CH_3$ | 2-$CH_3$ |
| 4 | 5-$SO_2N$(H)—4PO$CH_2CH(OH)CH_2OH$ | 2-$OCH_3$ |
TABLE XIV-continued
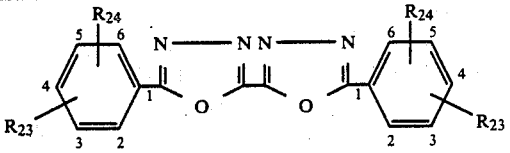
| Entry | $R_{23}$ | $R_{24}$ |
|---|---|---|
| 5 | 4-$SO_2N$(H)—9PO/1EO—$CH_3$ | 2,5-di-$CH_3$ |
| 6 | 4-O-20EO—H | 2-Cl |
| 7 | 4-$SO_2N$(H)—30PO—$COCH_3$ | H |
| 8 | 4-$SO_2N$(H)—12PO/14EO—$CH_3$ | 2-$OCH_3$ |
| 9 | 4-$CO_2N$(H)—15PO—H | H |
| 10 | 4-$CO_2N$(H)—5EO/10PO—H | H |

TABLE XV
$R_4—CH=CH—R_{25}—CH=CH—R_5$
| Entry | $R_4$ | $R_5$ | $R_{25}$ |
|---|---|---|---|
| 1 | 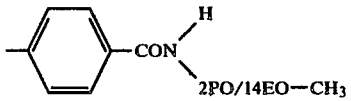 | 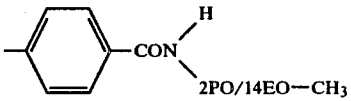 | 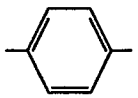 |
| 2 | 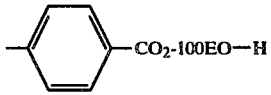 | 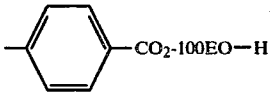 | 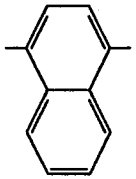 |
| 3 | 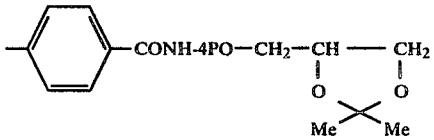 | 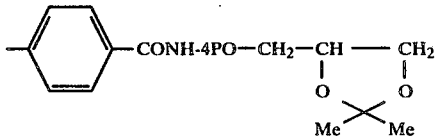 | 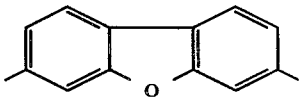 |
| 4 | 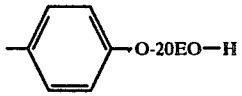 | 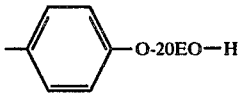 | 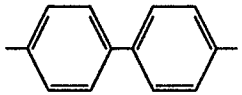 |
| 5 | 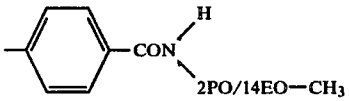 | 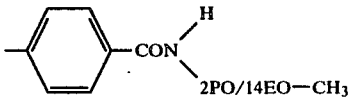 | 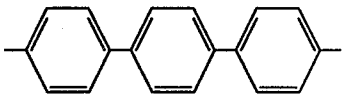 |
| 6 | 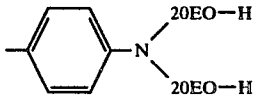 | 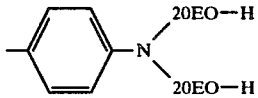 | 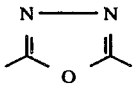 |
| 7 | 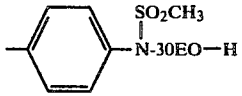 | 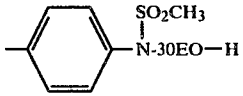 | 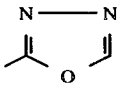 |

TABLE XV-continued
$R_4—CH=CH—R_{25}—CH=CH—R_5$
| Entry | $R_4$ | $R_5$ | $R_{25}$ |
|---|---|---|---|
| 8 | 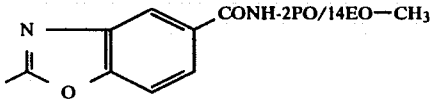 | 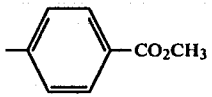 | 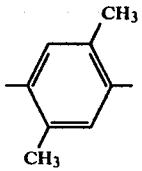 |
| 9 | 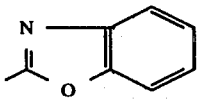 | 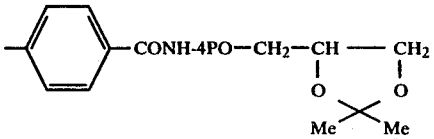 | 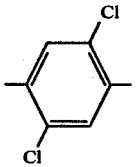 |
| 10 | 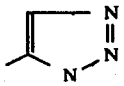 | 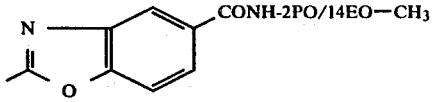 | 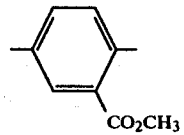 |

TABLE XVI
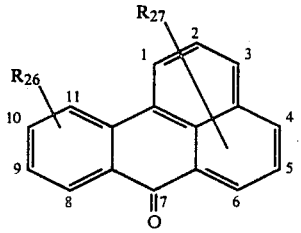
| Entry | $R_{26}$ | $R_{27}$ |
|---|---|---|
| 1 | H | 3-O-5EO/10PO—H |
| 2 | H | 3-O-30EO—H |
| 3 | 9-O-15PO—H | 3-Br |
| 4 | 5-O-5EO/10EO | 3-Cl |
| 5 | 9-$SO_2N$(H)(9PO/1EO—$CH_3$) | 3-H |
| 6 | 9-O-10PO—H | 3-O-10PO—H |
| 7 | 9-Br | 3-O-5EO/15PO—H |
| 8 | 9-$SO_2$NH-4PO—$CH_2$—CH(O—C(Me)(Me))—$CH_2$ | H |
| 9 | 9-$SO_2$NH-4PO—$CH_2$—CH(OH)—$CH_2$(OH) | H |
| 10 | H | 1-$CO_2$NH-9PO/1EO—$CH_3$ |
TABLE XVII
$R_{28}$—AR—$R_{29}$
| Entry | $R_{28}$ | AR | $R_{29}$ |
|---|---|---|---|
| 1 | 4-N($C_2H_5$) | 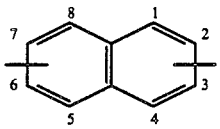 | 1-$SO_2$N(1EO/9PO)$_2$ |
| 2 | 4-N($CH_3$)$_2$ | 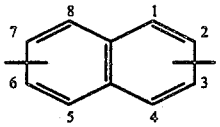 | 1(-$SO_2$NH-9PO/1EO—$CH_3$) |
| 3 | 4-N(5EO—$COCH_3$)$_2$ | 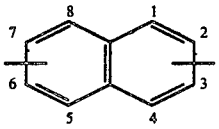 | 1(-$SO_2NHC_2H_4OH$) |
| 4 | 4-N(5EO—H)$_2$ | 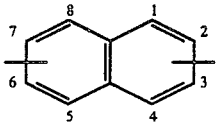 | 1-$SO_2NHC_2H_5$ |
| 5 | 4-N(10PO—H)$_2$ | 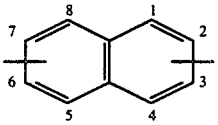 | 1-$SO_2NHC_6H_5$ |

TABLE XVII-continued
| | $R_{28}$—AR—$R_{29}$ | | |
|---|---|---|---|
| Entry | $R_{28}$ | AR | $R_{29}$ |
| 6 | 4-N(1EO/5PO—$COCH_3$)$_2$ | 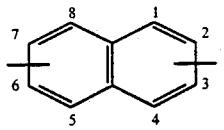 | 1($SO_2$NH-2PO/14EO—$CH_3$) |
| 7 | 4-$OCH_3$ | 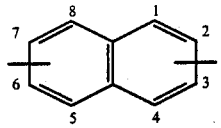 | 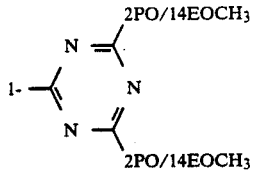 |
| 8 | 4-$OCH_2CH_3$ | 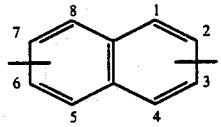 | 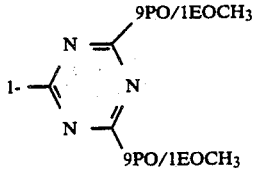 |
| 9 | 4-$OCH_2CH_2OH$ | 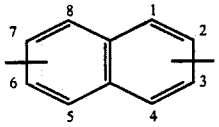 | 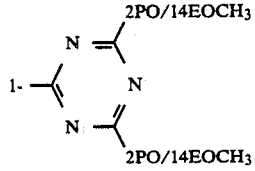 |
| 10 | 2-OH | 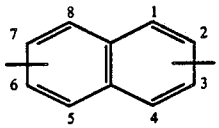 | 3(-CNH-2PO/14EO—$CH_3$) |
| 11 | 2-OH | 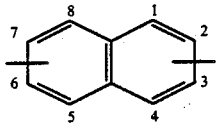 | 3(-CNH-2PO/1E$OCH_3$) |
| 12 | 2-OH | 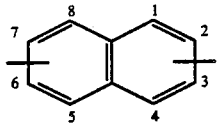 | 3-(CO-10EO—H) |
| 13 | 2-OH | 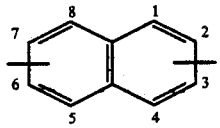 | 3-(CO-5EO/15PO—H) |
| 14 | H | 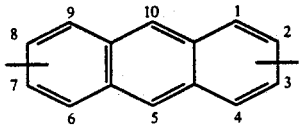 | 2-N(1EO/10PO)$_2$ |
| 15 | H | 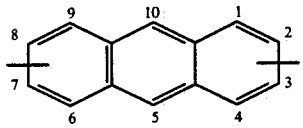 | 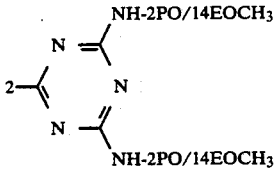 |

TABLE XVII-continued
| Entry | $R_{28}$ | AR | $R_{29}$ |
|---|---|---|---|
| | | $R_{28}$—AR—$R_{29}$ | |
| 16 | H | 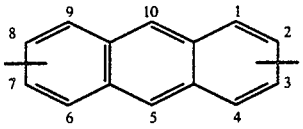 | 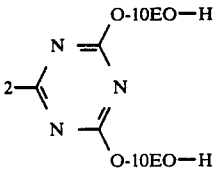 |
| 17 | 1-$OCH_3$ | 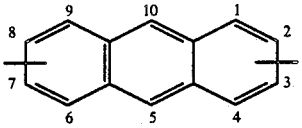 | 4-($SO_2NH$-2PO/14$EOCH_3$) |
| 18 | 1-$OCH_2CH_3$ | 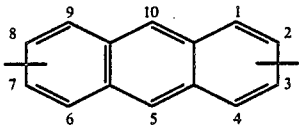 | 4-($SO_2NH$-9PO/1$EOCH_3$) |
| 19 | H | 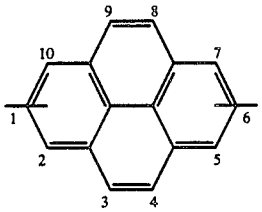 | 1-N(1EO/10PO—H)$_3$ |
| 20 | H | 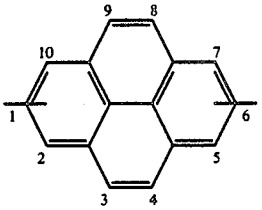 | 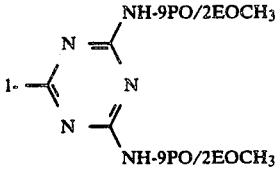 |
| 21 | H | 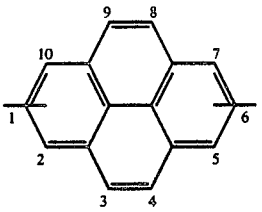 | 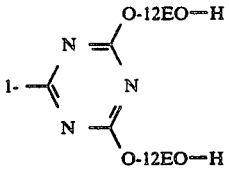 |
| 22 | H | 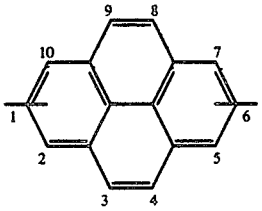 | 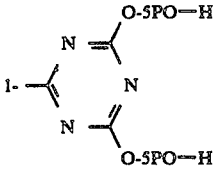 |
| 23 | H | 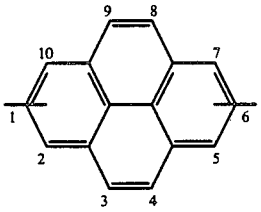 | 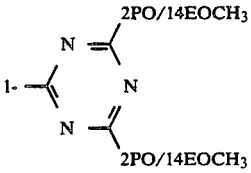 |

TABLE XVII-continued
| Entry | $R_{28}$ | AR | $R_{29}$ |
|---|---|---|---|
| | | $R_{28}$—AR—$R_{29}$ | |
| 24 | H | 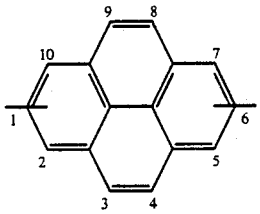 | 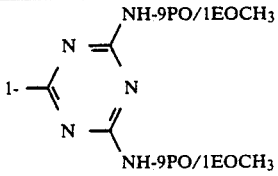 |
| 25 | H | 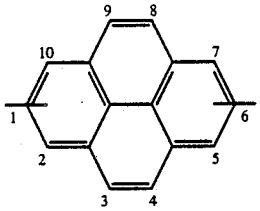 | 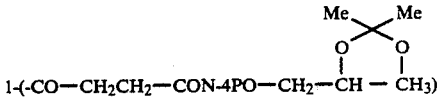 |
| 26 | H | 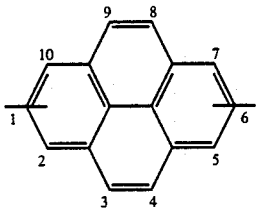 | 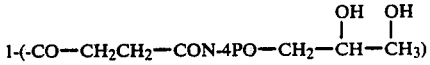 |
| 27 | H | 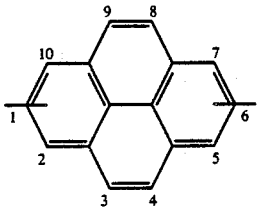 | 1-(COCH$_2$CH$_2$CO$_2$-20PO—H) |
| 28 | 9-CH$_2$CH$_3$ | 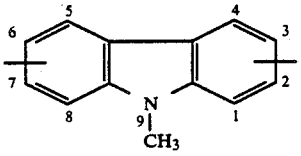 | 3-N(1EO/5PO—H) |
| 29 | 9-CH$_2$CH$_3$ | 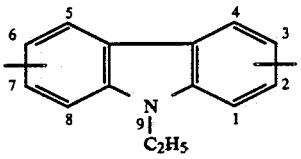 | 3-N(10EO—COCH$_3$) |
| 30 | 9-CH$_2$CH$_3$ | 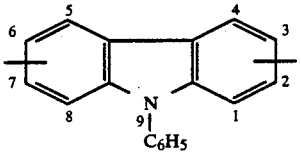 | 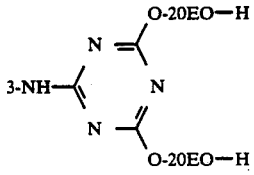 |
| 31 | 9-CH$_2$CH$_3$ | 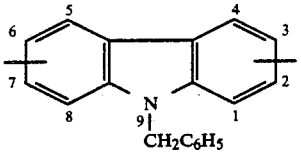 | 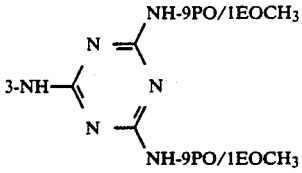 |

TABLE XVII-continued
| Entry | $R_{28}$ | AR | $R_{29}$ |
|---|---|---|---|
| 32 | 9-$CH_2CH_3$ | 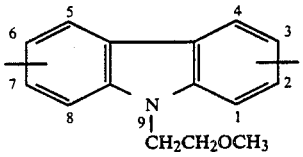 | 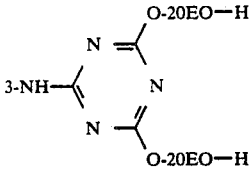 |
| 33 | 9-$CH_2CH_2OH$ | 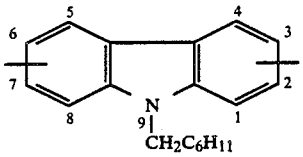 | 3-N(10EO—$COCH_2CH_3$) |
| 34 | 9-10EO—H | 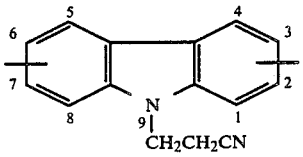 | 3-N(1EO/5PO—H) |
| 35 | 9-$CH_2CH_3$ | 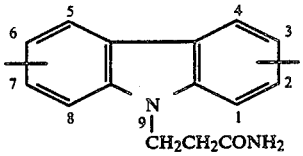 | 2-O-20EO—H |
| 36 | 9-10EO—H | 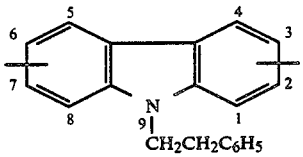 | 2-O—$CH_2CH_3$ |
| 37 | 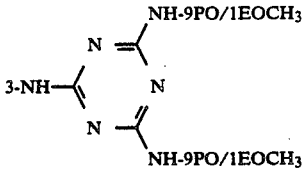 | 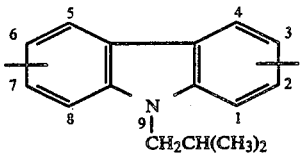 | 2-O-5EO—H |
| 38 | 9(-$COCH_3$) | 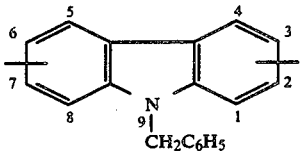 | 2(-O-20EO—H) |
| 39 | H | 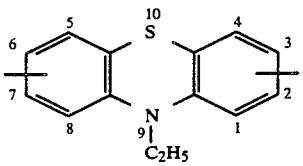 | 9-(1EO/20PO—H) |

TABLE XVII-continued

| Entry | $R_{28}$ | AR | $R_{29}$ |
|---|---|---|---|
| | | $R_{28}$—AR—$R_{29}$ | |
| 40 | H | 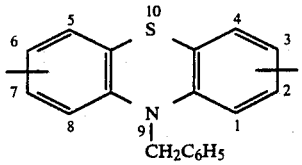 | 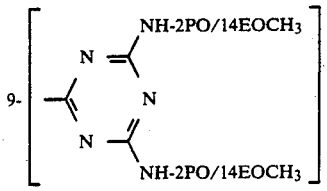 |
| 41 | H | 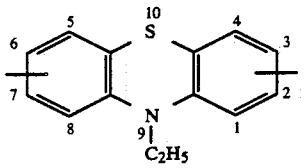 | 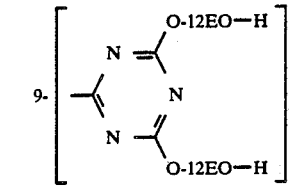 |
| 42 | H | 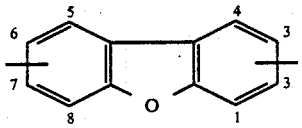 | 2(-O-15EO—H) |
| 43 | H | 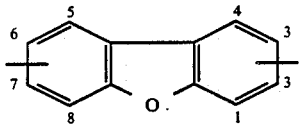 | 2(-O-1EO/20PO—$COCH_3$) |
| 44 | 2-$OCH_3$ | 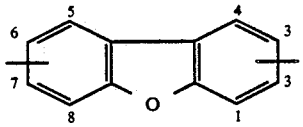 | 3(-$SO_2NH$-9PO/1$EOCH_3$) |
| 45 | 2-$OCH_3$ | 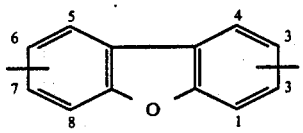 | 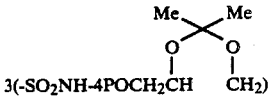 |
| 46 | 2-$CH_2CH_2OH$ | 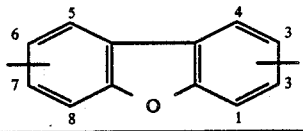 | 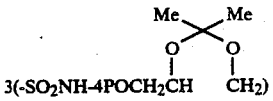 |

EXAMPLE #38

The Fluorescent Tag as a Method for Identifying Dyed Yarns during Slashing, Warping and Weaving The fluorescent tag prepared according to Example #1 is applied to dyed wool yarns by adding the tag to one of the size baths in the slasher. Two dissimilar yarns are run on the slasher. One yarn is allowed to run through the size bath containing the tag, and the other yarn is allowed to run through a size bath without the tag. An ultraviolet light is mounted above the section beam to monitor the yarns as they are wound onto the section beam. When a break in one of the yarns occurs, it is then possible to distinguish which type of yarn it is. When the section beam is completed, it is placed in warping. During warping, another ultraviolet light is placed above the loom beam. When breaks occur in the yarns which are being wound onto the loom beam, it is possible to distinguish between yarns which do not have the fluorescent tag and yarns which fluoresce under the ultraviolet light because they are coated with size containing the tag. Another ultraviolet light is placed above the weaving loom. When the yarns are run from the loom beam to the weaving loom, it is possible to distinguish between the yarns with the fluorescent tag and yarns without the fluorescent tag, making it easier to repair breaks that occur during weaving. The woven fabric is then scoured to remove the size and the fluorescent tag. Nonpolymeric fluorescent materials do not wash off during the scour, making them unsuitable for this application. The entire experiment is repeated using convention fugitive tints which do not fluoresce under ultraviolet light. It is difficult to distinguish between yarn types using conventional fugitive tints because of the dark shade of the dyed wool yarns.

EXAMPLE #39

The Fluorescent Tag as a Method for Identifying Polyurethane Foamed Articles The fluorescent tag prepared according to Example #1 is incorporated into polyurethane foamed system along with a control. The polyurethane foams are prepared according to the formulations shown below:

| System Component | A | B (Control) |
|---|---|---|
| Niax 16-56 Polyol(Union Carbide Corp.) | 100 g | 100 g |
| Water | 4.8 ml | 4.8 ml |
| Dabco 33 LV(Air Products) | 0.31 ml | 0.31 ml |
| T-9 Catalyst(MIT Chemical Co.) | 0.2 ml | 0.2 ml |
| L-520 Silicone(Union Carbide Corp.) | 1.5 ml | 1.5 ml |
| Methylene Chloride | 5.4 ml | 5.4 ml |
| Toluene Diisocyanate | 55 ml | 55 ml |
| Colorant(Example #1) | .05 g | — |

These foams are cured for one hour at 160° F. to give formed articles of uniform shape. The cured articles are irradiated with an ultraviolet light. Formulation A, containing the fluorescent tag of Example #1, emits intense bluish visible light, whereas the control (formulation B) remains dark.

Additional fluorescent tags are incorporated into polyurethane foamed systems according to the formulation given above and irradiated with ultraviolet light.

Table 18 below summarizes the results for these compositions.

TABLE 18

| Entry | Fluorescent Tag | Emission Shade |
|---|---|---|
| 1 | Example #2 | bluish |
| 2 | Example #3 | bluish |
| 3 | Example #4 | bluish |
| 4 | Example #6 | bluish |
| 5 | Example #10 | bluish |
| 6 | Example #15 | bluish |
| 7 | Example #16 | greenish-yellow |
| 8 | Example #19 | greenish-yellow |
| 9 | Example #20 | greenish-yellow |
| 10 | Example #21 | bluish |
| 11 | Example #26 | greenish-yellow |

EXAMPLE #40

The Fluorescent Tag as a Method for Identifying Thermoplastic Formed Articles The fluorescent tag prepared according to Example #1 is incorporated into polyolefin systems along with a control. The following formulations are preblended using a paddle type mixer and the colorant of Example #26:

| *INGREDIENT | Formulation 1 (Control) |
|---|---|
| 4MF Polypropylene resin (Exxon 9142G) | 99.47% |
| Irganox 1010 (Ciba-Geigy) | 800 ppm |
| Millad 3940 | 2500 ppm |

-continued

| *INGREDIENT | |
|---|---|
| Calcium stearate | 1000 ppm |
| | Formulation 2 |
| 4MF Polypropylene resin (Exxon 9142G) | 99.47% |
| Irganox 1010 (Ciba-Geigy) | 800 ppm |
| Millad 3940 | 2500 ppm |
| Calcium stearate | 1000 ppm |
| Polymeric colorant (Example #26) | 500 ppm |
| | Formulation 3 |
| 4MF Polypropylene resin (Exxon 9142G) | 99.62% |
| Irganox 1010 (Ciba-Geigy) | 800 ppm |
| $TiO_2$ | 1000 ppm |
| Calcium stearate | 1000 ppm |
| Polymeric colorant (Example #26) | 500 ppm |

*Calcium stearate functions as a stabilizer; Irganox 1010 is a registered trademark of Ciba-Geigy Corporation for a hindered phenol stabilizer; Millard 3940 is a clarifier for polyolefins; $TiO_2$ is a white pigment which serves as an opacifier; 4MF Polypropylene resin (Exxon 9142G) is a random copolymer of propylene and ethylene.

After mixing, the formulations shown above are melt compounded on a Brabender Twin Screw Mixer with a stock temperature of 245°-250° C. The compounded samples are then injection molded on a small toggle clamp machine into two-step plaques with thickness of 50 and 85 mils.

The processed thermoplastic plaques are irradiated with an ultraviolet light. Formulations 2 and 3 containing the fluorescent tag of Example #26 emit intense greenish-yellow visible light while the control (formulation 1) remains dark.

Additional fluorescent tags are incorporated into polyurethane foamed systems according to the formulation given above and irradiated with ultraviolet light. Both formulations process well in addition to having properties such as excellent heat stability, non-nucleation, non-migration and ease of resin clean up.

EXAMPLE #38

The Fluorescent Tag as a Method for Identifying Epoxy Formed Articles

The fluorescent tag prepared according to Example #1 is incorporated into an epoxy cured system along with a control. The system is prepared according to the following procedure: To a beaker containing 100 grams of epoxy resin based on diglycidyl ether of bisphenol A(N=0.2, WPE=185−195) of the formula:

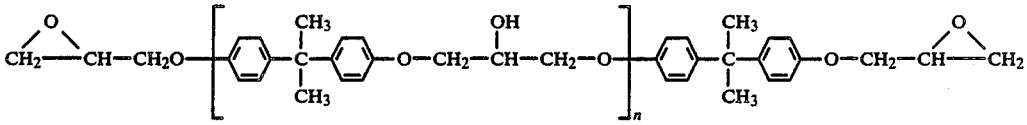

are added 0.05 grams of the fluorescent tag prepared according to Example #1 and 15.5 grams of 1,2-diaminocyclohaxane. After mixing thoroughly in a beaker for two minutes and centrifuging at a speed of 300 rpm, the resin mixture is placed in an aluminum mold and cured for two hours at 100° C. The above procedure is repeated without the addition of the fluorescent tag to generate a control.

These formed epoxy articles are irradiated with an ultraviolet light. The formed article containing the fluorescent tag of Example #1 emits intense bluish visible light and the control emits faint blue visible light.

Additional fluorescent tags are incorporated into polyurethane foamed systems according to the formulation given above and irradiated with ultraviolet light.

Table 19 below summarizes the results for these compositions.

TABLE 19

| Entry | Fluorescent Tag | Emission Shade |
|---|---|---|
| 1 | Example #2 | bluish |
| 2 | Example #3 | bluish |
| 3 | Example #4 | bluish |
| 4 | Example #6 | bluish |
| 5 | Example #10 | bluish |
| 6 | Example #15 | bluish |
| 7 | Example #16 | greenish-yellow |
| 8 | Example #19 | greenish-yellow |
| 9 | Example #20 | greenish-yellow |
| 10 | Example #21 | bluish |
| 11 | Example #26 | greenish-yellow |

EXAMPLE #39

The Fluorescent Tag as a Method for Identifying Silicone Formed Articles

Ten grams of Syloff 23 and 1.6 grams of 23 A catalyst (both products of Dow Corning) are mixed in a glass vessel. The fluorescent tag (0.58gm) prepared according to Example #1 is added and the resulting mixture is mechanically applied to one side of a piece of uncoated paper. A control paper is also prepared according to the above procedure without the fluorescent tag and applied to the other side of the paper. The sheet of paper is then cured in an oven at for 30 seconds at 175° C.

The sheet of paper containing the formed silicone coatings is then irradiated with an ultraviolet light. The side containing the fluorescent tag of Example #1 emits intense bluish visible light and the control side remains dark.

This invention has been described in detail with particular reference to preferred embodiments thereof, but it will be understood that variations and modifications can be effected within the spirit and scope of this invention.

We claim:

1. A method for tagging one or a mixture of natural or synthetic materials comprising contacting the same with one or a mixture of substantially colorless tagging compounds, each of which is comprised of one or more non-ionic luminophore moieties (L) attached to at least one poly(oxyalkylene) moiety (—Y) by means of linking moiety (—X) selected from a convalent bond, —O—, —S—, —CON($R_1$)—, —$SO_2$N($R_1$)—, —COO—, —N($R_2$)—, —N—, or 1, 2, 5-triazin-2, 4-diylamino, wherein $R_1$, is selected from hydrogen, Y, unsubstituted or substituted alkyl, cycloalkyl, or phenyl, wherein $R_2$ is selected from $R_1$, or —$SO_2R_3$, wherein $R_3$ is selected from unsubstituted or substituted alkyl, cycloalkyl or phenyl; wherein said tagging compound has substantial UV radiation absorbance within the range of from about 300 to about 400 nm and reemits substantial visible light, said contacting effecting at least a temporary association between said material and said compound, and wherein said compound is present in an amount between about 0.0001 and about 10 percent by weight of said material.

2. The method of claim 1 wherein each said luminophore moiety is selected from; 1, 2-diarylethenes; 2-arylbenzazoles; 2(H)-1-benozypyran-2-ones (coumarins); 2(H)-1-benzoypyrane-2-imines (iminocoumarins); carbostyrils; 3(H)-1-naphtho[2,1-b]pyran -3-ones; 3(H)-naphthos[2,1-b]pyran-3-imines; aminophthalimides; 1, 8-naphthalenedicarboximides; 1, 4, 5, 8-naphthalenetetracarboxylic acid diimides; 2, 5-diarylthiophenes; 2, 5-diarylfurans; 2,5 diaryl-1,3,4-thiadiazoles; 2-arylbenzofurans; 2, 6-diphenylbenzodifurans; 2, 2-bis(5-phenyl-1,3,4-oxadiazoles); quinolines; quinoxalines; 3, 4diarylfuranones; distyrylarenes; 7(H)-benzanthracene-7-ones(benzanthrones); or polyarenes; and wherein Y is a poly(oxyalkylene) moiety comprised of at least 50 mole percent of monomeric units or mixtures thereof of the formula (-RO-) wherein R is selected from substituted or unsubstituted straight chain alkylenes of two to four carbons; wherein X linking moiety is selected from a convalent bond, —O—, —S—, —$SO_2$—, —CON($R_1$)—, —$SO_2$N($R_1$)—, —COO—, —N($R_2$)—, or 1, 3, 5-triazin-2, 4-diylamino; wherein $R_1$ is selected from hydrogen, Y, unsubstituted or substituted alkyl; unsubstituted or substituted cycloalkyl; unsubstituted or substituted phenyl; wherein $R_2$ is $R_1$ or —$SO_2R_3$; wherein $R_3$ is selected from unsubstituted or substituted alkyl, cycloalkyl or phenyl.

3. The method of claim 2 wherein the luminescent compound is selected from compounds of the formulae;

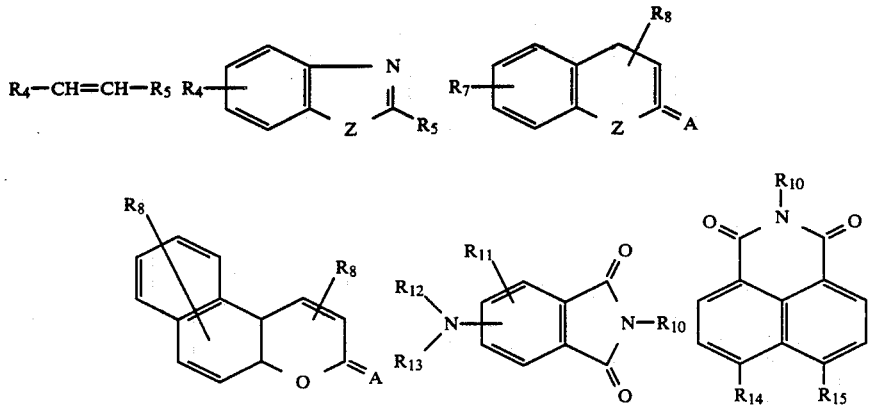

-continued

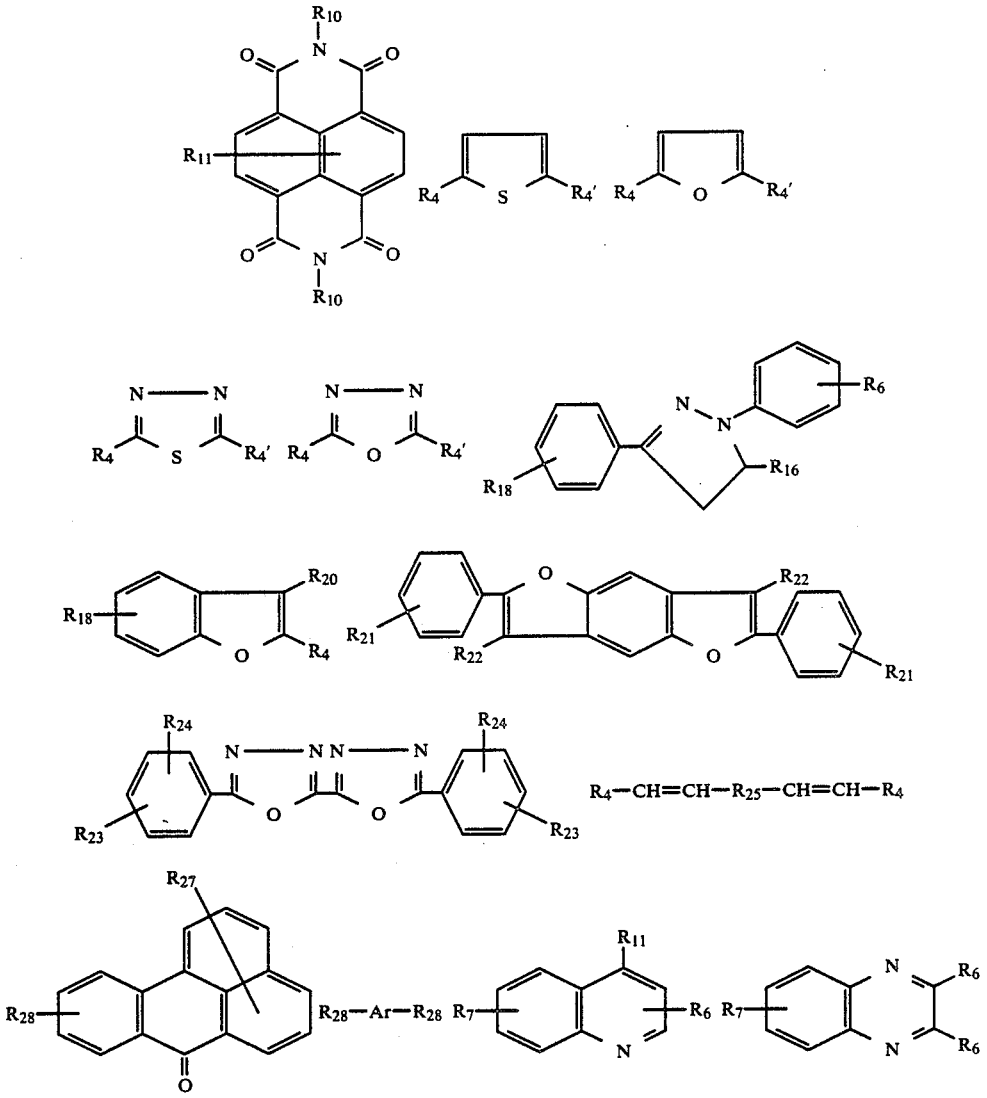

wherein $R_4$ and $R_{4'}$ are independently selected from phenyl or phenyl substituted with one or more groups selected from lower alkyl, lower alkoxy, halogen, cyano, -X-Y, unsubstituted or substituted sulfamoyl, benzoxazol-2-yl, benzothiazol-2-yl, benzimidazol-2-yl, benzofuran-2-yl, isoxazol-2-yl, 1,2-benzisoxazol-3-yl, pyrazol-1-yl, 1,2,3-triazol-2-yl, 1,2,4-oxadiazol-5-yl, 1,3,4-oxadiazol-2-yl, 1,3,4-thiadiazol-2-yl, 1,2,4-thiadiazol-5-yl, 1,3,5-triazin-5-yl, 2(H)-tetrazol-5-yl, pyrimidin-2-yl, benzotriazol-2-yl, naphthotriazol-2-yl, or trifluoromethyl; benzoxazol-02-yl; benzothiazol-2-yl, benzimidazol-2-yl; benzotriazol-2-yl; 1,3,4-oxadiazol-2-yl; 1,3,4-thiadiazol-2-yl and these azole moieties substituted with lower alkyl, lower alkoxy, phenyl, arylene-X-Y, -O-arylene-X-Y, -X-Y, lower alkylthio, cyano, carboxylate ester, unsubstituted or substituted carbamoyl, benzoxazol-2-yl, benzothiazol-2-yl or 1,3,4-oxadiazol-2-yl; wherein $R_5$ is selected from groups listed above for $R_4$or an optionally substituted electron rich aryl moiety derived from anilines, 1,2,3,4-tetrahydroquinolines, 3,4,-dihydro-2(H)-1,4-benzoxazines, 2,3-dihydroindoles, naphthylamines, 2-aminthiazoles, carbazoles, indoles, phenoxazines, phenothiazines, thiophenes, furans, julolidines, 2,3,3-trimethylinodolenines, diphenylamines, 3-cyano-2,6-diamino-4-methylpyridines, pyrazoles, pyrroles, oxybenzenes, thiobenzenes or oxynaphthalenes; wherein $R_6$ is selected from hydrogen, -X-Y, alkylene-X-Y, alkylene-X-Y, arylene-X-Y, -O-arylene-X-Y, lower alkyl, lower alkoxy, halogen, phenyl, cyano, carboxylate ester, unsubstituted or substituted carbamoyl, unsubstituted or substituted sulfamoyl, trifluoromethyl, alkylthio, alkylsulfonyl, benzoxazol-2-yl, benzothiazol-2-yl, 1,3,4-oxadiazol-2-yl; wherein Z is selected from —O—, —S—, —$SO_2$—, —N($R_1$)—; wherein $R_7$ is selected from —X—Y; hydrogen; hydroxy; hyroxyalkoxy; lower alkyl; lower alkoxy; amino; amino substituted optionally with alkyl, cycloalkyl, phenyl or 1,3,5-triazin-2-yl; 1,2,3,-triazol-2-yl; benzoxazol-2-yl; benzotriazol-2-yl; pyrazol-1-yl; naphtho[1,2,-d]triazol-2-yl; alkylene-X-Y; arylene-X-Y; -O-alkylene-X-Y or -O-arylene-X-Y; wherein $R_8$ is selected from hydrogen; -X-Y; lower alkyl; cyano; unsubstituted or substituted carbamoyl; unsubstituted or substituted sulfamoyl; alkylsulfonyl; arylsulfonyl; carboxylate ester; aryl moiety selected from phenyl; naphthyl, thienyl, furanyl, benzofuran-2-yl, benzoxazol-2-yl, benzothiazol-2-yl, benzimidazol-2-yl, 1,3,4-oxadiazol-2-yl, 1,3,4-thiadiazol-2-yl, and these aryl moieties substituted with -X-Y, lower alkyl, lower alkoxy, carboxylate ester, carbamoyl, phenyl, or halogen; wherein A is selected from =O or =N—$R_1$; wherein $R_9$ is hydrogen or one or more groups selected from -X-Y, lower alkyl, alkoxy, hydroxy, halogen or hydroxyalkoxy; wherein $R_{10}$ is selected from -Y, alkylene-X-Y, arylene-X-Y, alkylenearylene-X-Y, or $R_1$; wherein $R_{11}$ is hydrogen or 1-2substituents selected from lower alkyl, lower alkoxy or halogen; wherein $R_{12}$ and $R_{13}$ are independently selected from hydrogen, acyl, 1,3,5-triazin-2-yl, alkylene-X-Y, arylene-X-Y, or substituents represented by $R_1$; wherein $R_{14}$ and $R_{15}$ are independently selected from hydrogen, lower alkyl, lower alkoxy, halogen, acylamino, aryloxy, alkylthio, arylthio, carbalkoxy, cyano, -O-alkylene-X-Y; -O-arylene-X-Y, -S-arylene-X-Y, -O-alkylenearylene-X-Y, -O-alkylene-O-arylene-X-Y, or 1,3,5-triazin-2-ylamino; wherein $R_{16}$ and $R_{17}$ are hydrogen or one or more groups selected from lower alkyl, lower alkoxy, carbalkoxy, halogen, cyano, unsubstituted or substituted sulfamoyl, alkylsulfonyl or -X-Y; wherein $R_{18}$ is selected from hydrogen, lower alkyl, aralkyl, aryl, alkoxy, cyano or substituted or substituted sulfamoyl; wherein $R_{19}$ is selected from hydrogen, lower alkyl, lower alkoxy, carbalkoxy, halogen, 1,3,5-triazin-2-ylamino, naphtho[1,2-d]triazol-2-yl, pyrazalo[3,4-d]1,2,3,-triazol-2-yl, benzotriazol-2-yl or halogen; wherein $R_{20}$ is selected from hydrogen or lower alkyl; wherein $R_{21}$ is selected from hydrogen, alkyl, alkoxy, halogen or -X-Y; wherein $R_{22}$ is selected from hydrogen, cyano, carboxylate ester, alkylsulfonyl, acyl, unsubstituted or substituted sulfamoyl, unsubstituted or substituted carbamoyl, —$SO_2(R_1)Y$, or —$CON(R_1)Y$; wherein $R_{23}$ is selected from -X-Y; wherein $R_{24}$ is selected from hydrogen, lower alkyl, lower alkoxy or halogen; wherein $R_{25}$ is selected from 1,4-phenylene; 1,4-phenylene substituted with lower alkyl, lower alkoxy, halogen, cyano, carboxylate ester, unsubstituted or substituted carbamoyl or alkylsulfonyl; biphenylene; terphenylene; dibenzofuran-3,8-diyl; 1,3,4-oxadiazol-2,5-diyl; 1,3,4-thiadiazol-2,5,-diyl; naphthalene-1,4,-diyl; wherein $R_{26}$ and $R_{27}$ are independently selected from phenyl or phenyl substituted with one or more groups selected from hydrogen, lower alkyl, lower alkoxy, halogen, cyano, hydroxy, amino, amino substituted optionally substituted with alkyl, cycloalkyl or phenyl; 1,3,5,-triazin-2-yl; -O-alkylene-X-Y; -O-arylene-X-Y; -S-alkylene-X-Y; -O-alkylenearylen-X-Y; unsubstituted or substituted sulfamoyl; unsubstituted or substituted carbamoyl; or -X-Y; wherein;

Ar is one or more fused aromatic moieties selected from naphthalenes, acenaphthenes, anthracenes, phenanthrenes, perylenes, fluorenes, triphenylenes, pyrenes, chrysenes, naphthacenes, 1,2-benzanthrenes, 2,3-benzanthracenes, 1,12-benzoperylenes, 3,4-benzopyrenes, 4,5-benzopyrenes, decacylenes, carbazoles, indoles, 2,3-benzofurans, dibenzofurans, 2,3-benzothiophenes, dibenzothiophenes, dibenzothiophene dioxides, phenothiazines, phenoxazines or non-fused polyaromatic moieties selected from biphenyls, terphenyls, quaterphenyls, or binaphthyls; wherein $R_{28}$ and $R_{29}$ are independently selected from hydrogen; lower alkyl; lower alkoxy; acyl; halogen; cyano; hydroxy; amino; amino substituted optionally substituted with alkyl, cycloalkyl, or phenyl; 1,3,5triazin-2-yl; -O-alkylene-X-Y; -O-arylene-X-Y; -S-alkylene-X-Y; -O-alkylenearylen-X-Y; unsubstituted or substituted sulfamoyl; unsubstituted or substituted carbamoyl or -X-Y; with the proviso that at least one -X-Y group be present in the structure.

4. The method of claim 3 wherein the 2-arylbenzazole has the following structure:

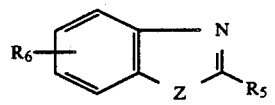

wherein:

$R_5$ is an electron rich aromatic moiety selected from the following structures:

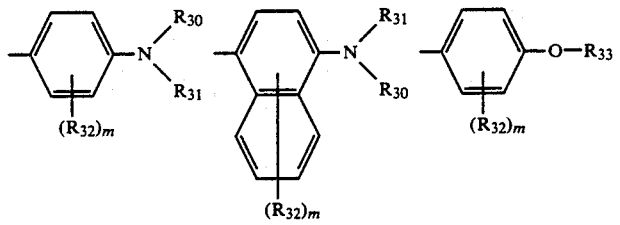

-continued

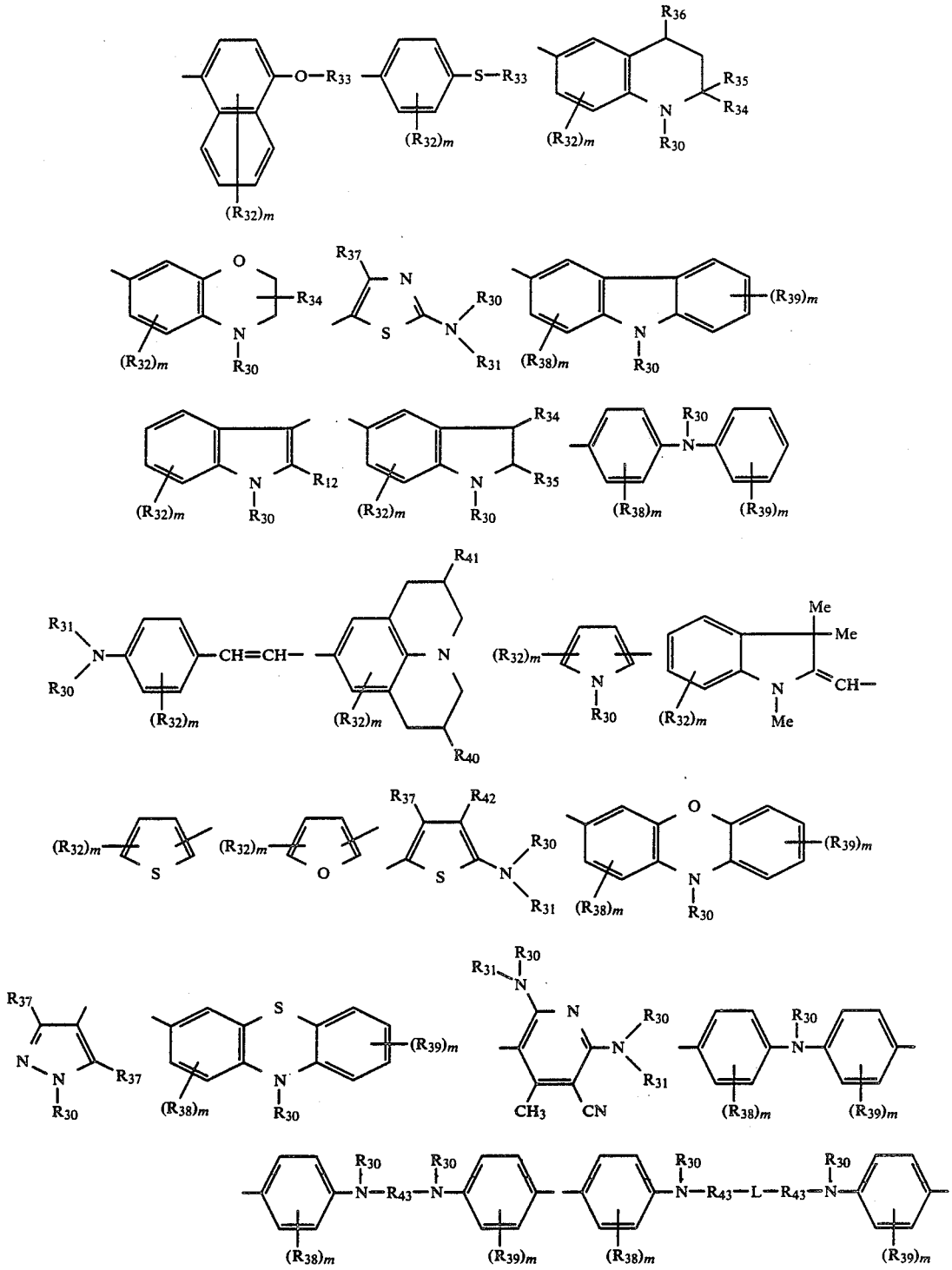

wherein:

$R_{30}$ and $R_{31}$ are selected from hydrogen; Y (as defined above); straight or branched lower alkenyl; cycloalkyl; cycloalkyl substituted with hydroxy, alkoxy, halogen or alkanoyloxy; phenyl; phenyl substituted with one or more groups selected from lower alkyl, lower alkoxy, halogen, hydroxy, alkanoylamino, carbalkoxy, carboxy, cyano, alkylanoyloxy or -X-Y (as defined above); straight or branched chain alkyl of 1-12 carbons and such alkyl substituted with one or more of the following: -X-Y; groups of the following formula:

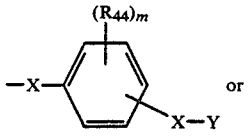

or

-continued

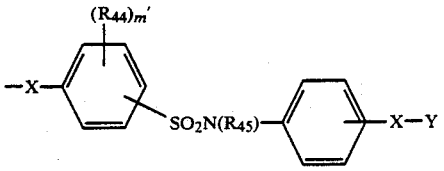

wherein X and Y are as defined above; wherein $R_{44}$ is selected from hydrogen; lower alkyl; lower alkoxy; halogen; lower alkanoylamino; cycloalkyl; cycloalkyl substituted with hydroxy, alkoxy, halogen, or alkanoyloxy; phenyl; phenyl substituted with lower alkyl, lower alkoxy, halogen, alkanoylamino, carboalkoxy, carboxy, hydroxy, cyano, or alkanoyloxy;

groups of the formulae: $—OR_{45}$, $—SO_2R_{46}$, $—CON(R_{45})(R_{47})$, $—SO_2N(R_{45})(R_{47})$, $—N(R_{45})SO_2R_{46}$, $—O—X'—R_{46}$, $—SR_{48}$, and $—SO_2C_2H_4SR_{46}$;

$R_{45}$ and $R_{47}$ are selected from hydrogen; lower alkyl; lower alkyl substituted with hydroxy, acyloxy, halogen, cycloalkyl, alkoxy, or phenyl; cycloalkyl; phenyl substituted with lower alkyl, lower alkoxy, halogen, hydroxy, alkanoylamino, carbalkoxy, carboxy, cyano, or alkanoyloxy, wherein $R_{46}$ represents the same substituents listed for $R_{45}$ and $R_{47}$ excepting hydrogen; wherein X' is selected from —CO—, or $—CON(R_{45})—$; wherein $R_{48}$ is selected from the groups listed above for $R_{45}$ and $R_{47}$ plus benzothiazolyl, benzimidazolyl, pyridyl, pyrimidinyl, 1,3,4-thiadiazolyl, 1,3,4-oxadiazolyl, naphthyl, or triazolyl;

cyano, halogen, 2-pyrrolidino, phthalimidino, vinylsulfonyl, acryamido, -o-benzoylsulfonimido, groups of the formula:

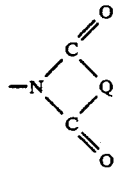

wherein Q is lower alkylene of 1–3 carbons; lower alkylene substituted with hydroxy, halogen, alkoxy or acyloxy; vinyl; 1,2-phenylene; 1,2-phenylene substituted with lower alkyl; lower alkoxy, halogen, carboxy or carbalkoxy; 1,2-cyclohexylene; $—O—CH_2—$; $—CH_2OCH_2—$; $—S—CH_2—$; $—N(R_{45})CH_2—$; $—N(R_{45})CH_2\ CH_2—$ or $—CH_2N(R_{45})CH_2—$; wherein $R_{30}$ and $R_{31}$ can be a single combined group such as pentamethylene, tetramethylene, ethyleneoxyethylene, ethylenesulfonylethylene, ethylenethioethylene, ethylene-$N(R_{45})$ethylene, ethylene-$N(-X'-R_{46})$ethylene, or ethylene$(SO_2R_{47})$ethylene which, with the nitrogen to which it is attached, forms a ring;

$R_{32}$, $R_{38}$, and $R_{39}$ are selected from hydrogen, chlorine, bromine, fluorine, iodine, lower alkyl, trifluoromethyl, lower alkoxy, alkoxy substituted with hydroxy, aryl, aryloxy, arylthio, alkylene-X-Y or -O-alkylene-X-Y;

m and m' are 1 or 2;

$R_{33}$ is selected from hydrogen, or one or two groups selected from $R_{30}$ or Y;

$R_{34}$, $R_{35}$, and $R_{36}$ are each independently selected from hydrogen and lower alkyl;

$R_{37}$ is hydrogen, lower alkyl, halogen, aryl, or -O-arylene-X-Y;

$R_{40}$ and $R_{41}$ are selected from hydrogen, lower alkyl, lower alkoxy, halogen, hydroxy, or acyloxy;

$R_{42}$ is selected from hydrogen, cyano, $—COOR_{45}$, $—CON(R_{45})(R_{47})$, $—SO_2R_{46}$, $—COR_{46}$, or $—CON(R_2)—Y$;

$R_{43}$ is alkylene; arylene; aralkylene; alkyleneoxy; alkyleneoxyalkylene; alkylene; alkylene substituted with hydroxy, acyloxy, alkoxy, halogen, aryloxy, -X-Y, or -X-arylene-X-Y;

L is a divalent single covalent bond, —O(C=O)O—, —(C=O)—O—, —(C=O)—, —O—, —S—, $—SO_2—$, $—N(SO_2R_{46})—$, —S—S—, —O—(C=O)-alkylene-(C=O)—O—, —O(C=O)-arylene-(C=O)—O—, —O—(C=O)NH-alkylene-NH(C=O)—O—, —O(C=O)NH-arylene-NH(C=O)—O—, -O-alkylene-O-, -O-arylene-O-, cycloalkylene or arylene.

5. The method of claim 4 wherein said tagging compound is selected from those of the formulae:

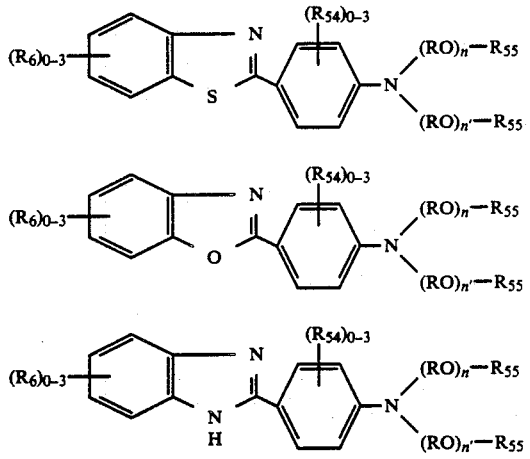

wherein each R is divalent ethylene, propylene, or butylene; each $R_6$ and $R_{54}$ is selected from alkyl of 1–8 carbons, alkoxy of 1–8 carbons, or halogen; each $R_{55}$ is selected from hydrogen, acyl of 1–8 carbons or alkyl of 1–8 carbons; and n+n' is an integer of from about 20 to 200.

6. The method of claim 4 wherein said tagging compound is selected from those of the formulae:

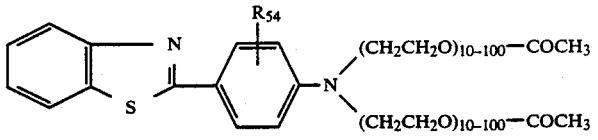

-continued
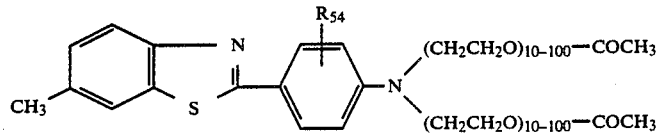
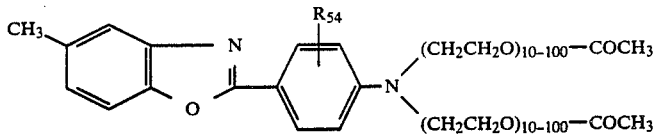
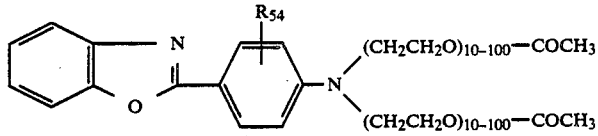
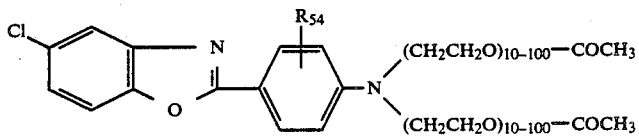
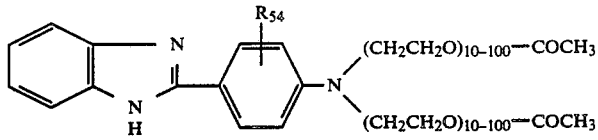
7. The method of claim 4 wherein said tagging compound is selected from those of the formulae:
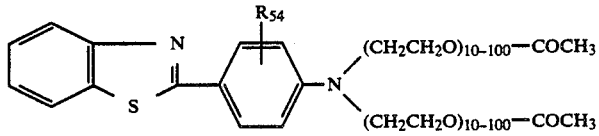
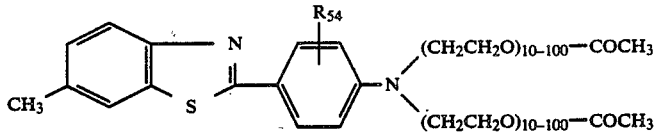
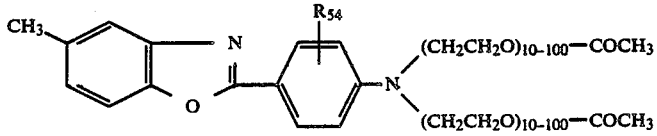
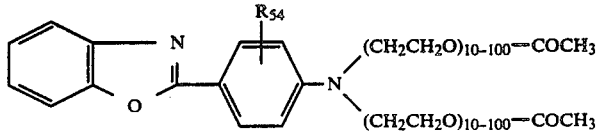
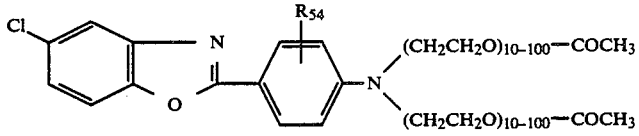

-continued

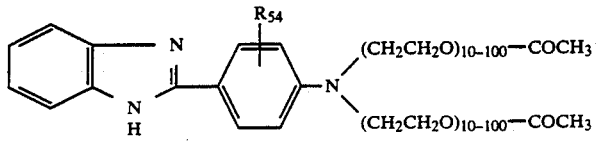

8. The method of claim 3 wherein the 1,2-diarylethane has the following structure:

$R_4—CH=CH—R_5$ wherein:

$R_4$ is selected from phenyl or phenyl substituted with one or more groups selected from lower alkyl, lower alkoxy, halogen, cyano, -X-Y, unsubstituted or substituted sulfamoyl, benzoxazol-2-yl, benzothiazol-2-yl, benzimidazol-2-yl, benzofuran-2-yl, isoxazol-2-yl, 1,2-benzisoxazol-3-yl, pyrazol-1-yl, 1,2,3-triazol-2-yl, 1,2,4-oxadiazol-5-yl, 1,3,4-oxadiazol-2-yl, 1,3,4-thiadiazol-2-yl, 1,2,4-thiadiazol-5-yl, 1,3,5-triazin-5-yl, 2(H)-tetrazol-5-yl, pyrimidin-2-yl, benzotriazol-2-yl, naphtho[1,2-d]triazol-2-yl, or trifluoromethyl; benzoxazol-2-yl; benzothiazol-2-yl; benzimidazol-2-yl; benzotriazol-2-yl; 1,3,4-oxadiazol-2-yl; 1,3,4-thiadiazol-2-yl and these azole moieties substituted with lower alkyl, lower alkoxy, phenyl, phenylene-X-Y, -O-phenylene-X-Y, -X-Y, lower alkylthio, cyano, carboxylate ester, unsubstituted or substituted carbamoyl, benzoxazol-2-yl, benzothiazol-2-yl or 1,3,4-oxadiazol-2-yl; wherein $R_5$ is selected from the groups listed above in claim 4

9. The method of claim 3 wherein the coumarin has the following structure:

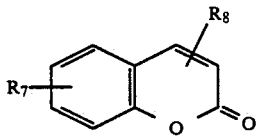

wherein:

$R_7$ is selected from -X-Y; hydrogen; hydroxy; hydroxyalkoxy; lower alkyl; lower alkoxy; amino; amino substituted optionally with alkyl, cycloalkyl, phenyl or 1,3,5-triazin-2-yl; 1,2,3-triazol-2-yl; pyrazol-1-yl; benzoxazol-2-yl; benzotriazol-2-yl; naphtho[1,2-d]triazol-2-yl; alkylene-X-Y; arylene-X-Y; -O-alkylene-X-Y; or -O-arylene-X-Y; wherein $R_8$ is selected from hydrogen; -X-Y; lower alkyl; cyano; unsubstituted or substituted carbamoyl; unsubstituted or substituted sulfamoyl; alkylsulfonyl;arylsulfonyl; carboxylate ester; aryl moiety selected from phenyl, naphthyl, thienyl, furanyl, benzofuran-2-yl, benzoxazol-2-yl, benzothiazol-2-yl, benzimidazol-2-yl, 1,3,4-oxadiazol-2-yl, 1,3,4-thiadiazol-2-yl, and these aryl moieties substituted with -X-Y, lower alkyl, lower alkoxy, carboxylate ester, carbamoyl, phenyl, or halogen.

10. The method of claim 3 wherein the iminocoumarin has the following structure:

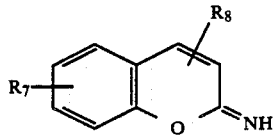

wherein $R_7$ and $R_8$ are selected from the groups of claim 8 above.

11. The method of claim 3 wherein the aminophthalimide has the following structure:

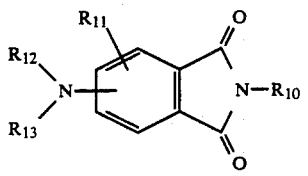

wherein:

$R_{10}$ is selected from -Y, alkylene-X-Y, arylene-X-Y, alkylenearylene-X-Y, or $R_1$ (as defined in claim 1); wherein $R_{11}$ is selected from hydrogen or 1–2 substituents selected from lower alkyl, lower alkoxy or halogen; wherein $R_{12}$ and $R_{13}$ are independently selected from hydrogen, acyl, 1,3,5-triazin-2-yl, alkylene-X-Y, arylene-X-Y, or substituents represented by $R_1$ (as defined in claim 1).

12. The method of claim 3 wherein the 1,8naphthalenedicarboximide has the following structure:

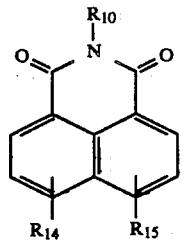

wherein:

$R_{14}$ and $R_{15}$ are independently selected from hydrogen, lower alkyl, lower alkoxy, halogen, acylamino, aryloxy, alkylthio, arylthio, carbalkoxy, cyano, -O-alkylene-X-Y, -O-arylene-X-Y, -S-arylene-X-Y, -O-alkylenearylene-X-Y, -O-alkylene-O-arylene-X-Y, or 1,3,5-triazin-2-ylamino; wherein wherein $R_{10}$ is selected from the groups of claim 10 above.

13. The method of claim 3 wherein the 1,4,5,8-naphthalenetetracarboxylic acid diimide has the following structure:

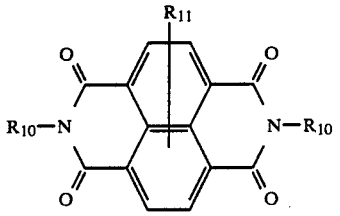

wherein $R_{10}$ and $R_{11}$ are selected from the groups listed above.

14. The method of claim 3 wherein the 1,3-diphenyl-2-pyrazoline has the following structure:

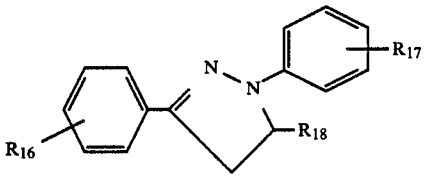

wherein:

$R_{16}$ and $R_{17}$ are hydrogen or one or more groups selected from lower alkyl, lower alkoxy, carbalkoxy, halogen, cyano, unsubstituted or substituted sulfamoyl, alkylsulfonyl or -X-Y; wherein $R_{18}$ is selected from hydrogen, lower alkyl, aralkyl, aryl, alkoxy, cyano or unsubstituted or substituted sulfamoyl.

15. The method of claim 3 wherein the quinoline has the following structure:

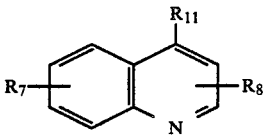

wherein $R_7$, $R_8$, and $R_{11}$ are selected from the groups listed above.

16. The method of claim 3 wherein the quinoxaline has the following structure:

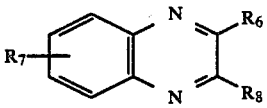

wherein $R_6$, $R_7$, and $R_8$ are selected from the groups listed above.

17. The method of claim 3 wherein the 7(H)-benz[-d,e]anthracene-7-ones has the following structure:

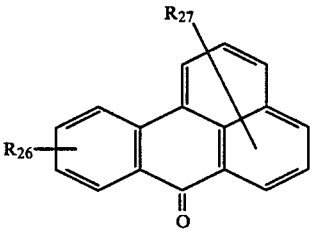

$R_{26}$ and $R_{27}$ are independently selected from phenyl or phenyl substituted with one or more groups selected from hydrogen, lower alkyl, lower alkoxy, halogen, cyano, hydroxy, amino, amino substituted optionally substituted with alkyl, cycloalkyl or phenyl; 1,3,5-triazin-2-yl; -O-alkylene-X-Y; -O-arylene-X-Y; -S-alkylene-X-Y; -O-alkylenearylen-X-Y; unsubstituted or substituted sulfamoyl, unsubstituted or substituted carbamoyl, -Y or -X-Y.

18. The method of claim 3 wherein the polyarene has the following structure:

$R_{28}$—Ar—$R_{29}$

Ar is one or more fused aromatic moieties selected from naphthalenes, acenaphthenes, anthracenes, phenanthrenes, perylenes, fluorenes, triphenylenes, pyrenes, chrysenes, naphthacenes, 1,2-benzanthrenes, 2,3-benzanthracenes, 1,12-benzoperylenes, 3,4-benzopyrenes, 4,5-benzopyrenes, decacylenes, carbazoles, indoles, 2,3-benzofurans, dibenzofurans, 2,3-benzothiophenes, dibenzothiophenes, dibenzothiophene dioxides, phenothiazines, phenoxazines or non-fused polyaromatic moieties selected from biphenyls, terphenyls, quaterphenyls, or binaphthyls; wherein $R_{28}$ and $R_{29}$ are independently selected from hydrogen; lower alkyl; lower alkoxy; acyl; halogen; cyano; hydroxy; amino; amino; substituted optionally substituted with alkyl, cycloalkyl or phenyl; phenyl; 1,3,5-triazin-2-yl; -O-alkylene-X-Y; -O-arylene-X-Y; -S-alkylene-X-Y; -O-alkylenearylen-X-Y; unsubstituted or substituted sulfamoyl; unsubstituted or substituted carbamoyl or -X-Y.

19. The method as in any one of claims 2 thru 18 wherein the poly(oxyalkylene) moiety Y is comprised of at least three monomeric units or mixtures thereof of the formula, (—RO—), wherein R is selected from ethylene, propylene, or butylene and wherein the said monomeric units may be interconnected by one or more linking groups, which make up to 20 mole percent of Y, selected from alkyleneoxy, aryleneoxy, alkylenedioxy, alkylenetrioxy, or —N($R_{48}$) (C=O) N($R_{48}$)—, wherein $R_{48}$ is selected from hydrogen, or substituted and unsubstituted lower alkyl, cycloalkyl or aryl; wherein Y is terminated by hydrogen, or by branch substituents, 1,3-groups selected from lower alkyl, cycloalkyl, acyl, or aryl, wherein any of the above recited hydrocarbon groups, moieties or substituents may themselves be substituted with one to four groups selected from alkyl, halogen, alkyoxycarbonyl, mercapto, alkoxy, aryloxy, —N($R_{48}$) (C=O)$R_{48}$—, —N($R_{48}$)$SO_2R_{48}$—, —($R_{48}$) (C=O)N($R_{48}$) ($R_{48}$), —N($R_{40}$) ($R_{40}$), acyl or acyloxy.

20. The method according to any one of claims 2 thru 18 wherein each poly(oxyalkylene) moiety Y has an average molecular weight of from about 200 to about 90,000 and the monomeric units are selected from ethyleneoxy, propyleneoxy, or butyleneoxy or mixtures thereof and wherein Y is terminated with hydrogen; alkyl, cycloalkyl, aryl, or acyl.

21. The method of any one of claims 1 thru 18 wherein a water disposable polymeric material is employed as a binding agent for said compound and is selected from polyvinyl alcohol, polyacrylic acid,acrylic polymers, carboxymethylcellulose, styrene maleic-anhydride copolymers, sulfopolyesters and starch.

22. The method of claim 21 wherein said material, is a natural or synthetic fiber or yarn.

23. The method of claim 22 wherein said polymeric material is selected from polyvinyl alcohol, polyacrylic acid,acrylic polymers, carboxymethylcellulose, styrene-maleic anhydride copolymers, sulfopolyesters and starch.

24. The method of any one of claims 1 thru 18 wherein said tagging compound is delivered in an aqueous system to said material.

25. The method of claim 1 wherein said material is solid, particulate, polymeric material.

26. The method of claim 1 wherein said material is thermoplastic.

27. The method of claim 1 wherein said material is thermosetting.

28. A material having markedly enhanced visibility under irradiation within the range of from about 300 to about 400 nm and comprising natural or synthetic material associated with one or more tagging compounds containing one or more non-ionic luminophore moieties linked to at least one poly(oxyalkylene) moiety, wherein said tagging compound has substantial absorbance within the range of from about 300 to about 400 nm and reemits substantial visible light.

29. The material of claim 28 wherein said compound is affixed thereto by one or more binding agents selected from polyvinyl alcohol, polyacrylic acid, acrylic polymers, carboxymethylcellulose, styrene maleic anhydride copolymers, sulfopolyesters and starch.

30. The material of claim 29 wherein said luminescent moiety is selected from 1,2,-diarylethanes; 2-arylbenzazoles; 2(H)-1-benozpyran-2-ones (coumarins); 2(H)-1-benzopyrane-2-imines (iminocoumarins); carbostyrils; 3(H)-1-naphtho[2,1-b]pyran-3-ones; 3(H)-naphtho[2,1-b]pyran-3-imines; aminophthalimides; 1,8-naphthalenedicarboximides; 1,4,5,8-naphthalenetetracarboxylic acid diimides; 2,5-diarylthiophenes; 2,5-diarylfurans; 2,5-diaryl-1,3,4-thiadiazoles; 2,5-diaryl-1,3,4-oxadiazoles; 1,3-diphenyl-2-pyrazolines; 2-arylbenzofurans; 2,6-diphenylbenzodifurans; 2,2'-bis (5-phenyl-1,3,4-oxadiazoles); quinolines; quinoxalines; 3,4-diarylfuranones; distyrylarenes; 7(H)-benz[de]anthracene-7-ones(benzanthrones); or polyarenes.

31. The material of claim 30 comprising fiber or yarn.

32. A composition of matter having the empirical formula (L-X-Y) and comprised of one or more luminophore moieties (L) selected from: 1,2-diarylethanes; 2-arylbenzazoles; 2(H)-1-benzopyran-2-ones(coumarins); 2(H)-1-benzopyrane-2-imines (iminocoumarins); carbostyrils; 3(H)-1-naphtho[2,1-b]pyran-3-ones; 3(H)-naphtho[2,1-b]pyran-3 -imines; aminophthalimides; 1,8-naphthalenedicarboximides; 1,4,5,8-naphthalienetetracarboxylic acid diimides; 2,5-diarylthiophenes; 2,5-diarylfurans; 2,5-diaryl-1,3,4-thiadiazoles; 2,5-diaryl-1,3,4-oxadiazoles; 1,3-diphenyl-2-pyranzolines; 2-arylbenzofurans; 2,6-diphenylbenzodifurans; 2,2',bis(5-phenyl-1,3,4-oxadiazoles); quinolines; quinoxalines; 3,4-diarylfuranones; distyrylarenes; 7(H)-benzanthracene-7-ones(benzanthrones); or polyarenes;

wherein each said (L) moiety is linked to at least one poly(oxyalkylene) moiety (Y) comprised of at least 50 mole percent of monomeric units or mixtures thereof the formula (—RO—), wherein R is selected from substituted or unsubstituted straight or branched chain alkylenes of two to four carbons;

and wherein (L) is linked to (Y) through a linking moiety (X) selected from a covalent bond, —O—, —SO—, —$SO_2$—, —CON($R_1$)—, —$SO_2$N($R_1$)—, —COO—, —N($R_2$)—, or 1,3,5-triazin-2,4 diylamino; wherein $R_1$ is selected from hydrogen, Y, unsubstituted or substituted alkyl; unsubstituted or substituted cycloalkyl; unsubstituted or substituted phenyl;

$R_2$ is selected from $R_1$ or —$SO_2R_3$; and $R_3$ is selected from unsubstituted or substituted alkyl, cycloalkyl or phenyl.

33. A composition of matter of claim 32 comprising one or more luminescent moieties selected from the following general formulae:

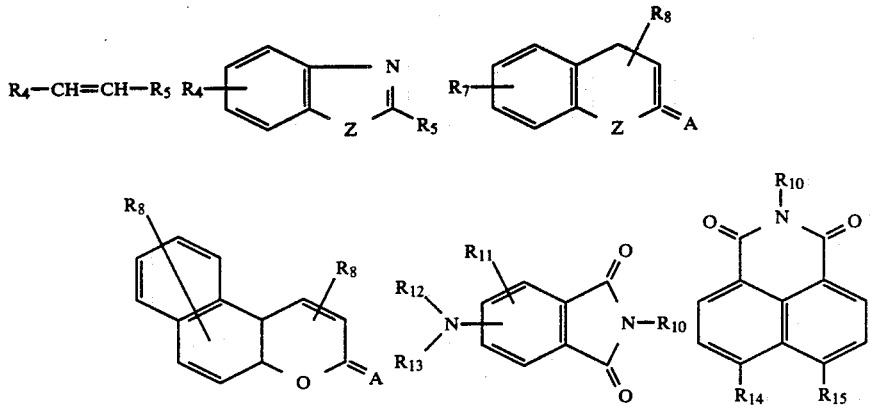

-continued

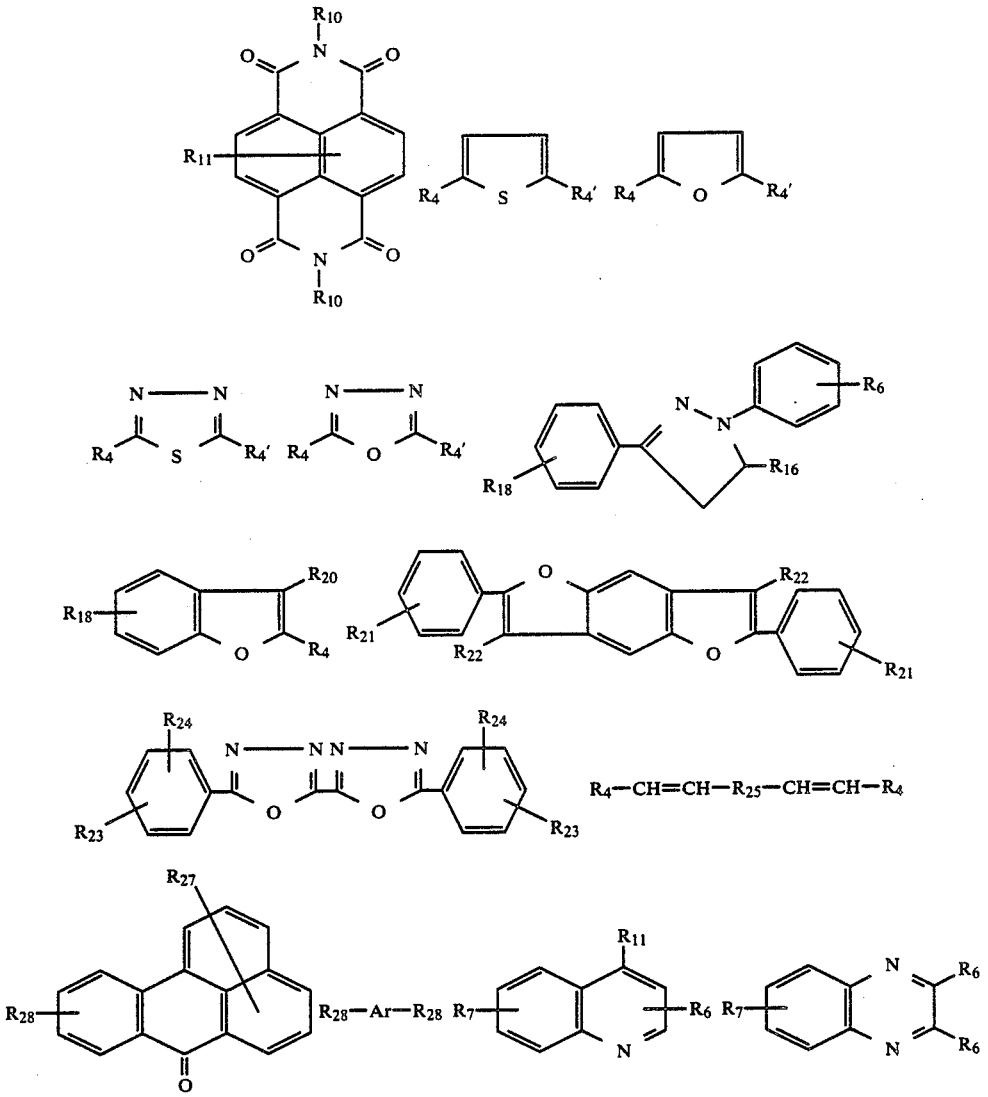

wherein $R_4$ and $R_{4'}$ are independently selected from phenyl or phenyl substituted with one or more groups selected from lower alkyl, lower alkoxy, halogen, cyano, -X-Y, unsubstituted or substituted sulfamoyl, benzoxazol-2-yl, benzothiazol-2-yl, benzimidazol-2-yl, benzofuran-2-yl, isoxazol-2-yl, 1,2-benzisoxazol-3-yl, pyrazol-1-yl, 1,2,3-triazol-2-yl, 1,2,4-oxadiazol-5yl, 1,3,4-oxadiazol-2-yl, 1,3,4-thiadiazol-2-yl, 1,2,4-thiadiazol-5-yl, 1,3,5-triazin-5-yl, 2(H)-tetrazol-5-yl, pyrimidin-2-yl, benzotriazol-2-yl, naphtho[1,2-d]triazol-2-yl, or trifluoromethyl; benzoxazol-2-yl; benzothiazol-2-yl; benzimidazol-2-yl; benzotriazol-2-yl; 1,3,4-oxadiazol-2-yl; 1,3,4-thiadiazol-2-yl and these azole moieties substituted with lower alkyl, lower alkoxy, phenyl, arylene-X-Y, -O-arylene-X-Y, -X-Y, lower alkylthio, cyano, carboxylate ester, unsubstituted or substituted carbamoyl, benzoxazol-2-yl, benzothiazol-2-yl or 1,3,4-oxadiazol-2-yl; wherein $R_5$ is selected from the groups listed above for $R_4$ or an optionally substituted electron rich aryl moiety derived from anilines, 1,2,3,4-tetrahydroquinolines, 3,4-dihydro-2(H)-1,4-benzoxazines, 2,3,-dihydroindoles, naphthylamines, 2-aminthiazoles, carbazoles, indoles, phenoxazines, phenothiazines, thiophenes, furans, julolidines, 2,3,3,-trimethylindolenines, diphenylamines, 3-cyano-2,6-diamino-4-methylpyridines, pyrazoles, pyrroles, oxybenzenes, thiobenzenes or oxynaphthalenes; wherein $R_6$ is selected from hydrogen, -X-Y, alkylene-X-Y, alkylene-X-Y, arylene-X-Y, -O-arylene-X-Y, lower alkyl, lower alkoxy, halogen, phenyl, cyano, carboxylate ester, unsubstituted or substituted carbamoyl, unsubstituted or substituted sulfamoyl, trifluoromethyl, alkylthio, alkylsulfonyl, benzoxazol-2-yl, benzothiazol-2-yl, 1,3,4-oxadiazol-2-yl; wherein Z is selected from —O—, —S—, —$SO_2$—, —N($R_1$)—; wherein $R_7$ is selected from -X-Y; hydrogen; hydroxy; hyroxyalkoxy; lower alkyl; lower alkoxy; amino; amino substituted optionally with alkyl, cycloalkyl, phenyl or 1,3,5-triazin-2-yl, 1,2,3-triazol-2-yl; benzoxazol-2-yl; benzotriazol-2-yl; pyrazol-1-yl; naphtho[1,2-d]triazol-2-yl; alkylene-X-Y; arylene-X-Y; -O-alkylene-X-Y or -O-arylene-X-Y; wherein $R_8$ is selected from hydrogen; -X-Y; lower alkyl; cyano; unsubstituted or substituted carbamoyl; unsubstituted or substituted sulfamoyl; alkylsulfonyl; arylsulfonyl; carboxylate ester; aryl moiety selected from phenyl, naphthyl, thienyl, furanyl, benzofuran-2-yl, benzoxazol-2-yl, benzothiazol-2-yl, benzimidazol-2-yl, 1,3,4-oxadiazol-2-yl, 1,3,4-thiadiazol-2-yl, and these aryl moieties substituted with -X-Y, lower alkyl, lower alkoxy, carboxylate ester, carbamoyl, phenyl, or halogen; wherein A is selected from =O or =N—$R_1$; wherein $R_9$ is hydrogen or one or more groups selected from -X-Y, lower alkyl, alkoxy, hydroxy, halogen or hydroxyalkoxy; wherein $R_{10}$ is selected from -Y, alkylene-X-Y, arylene-X-Y, alkylenearylene-X-Y, or $R_1$; wherein $R_{11}$ is hydrogen or 1–2 substituents selected from lower alkyl, lower alkoxy or halogen; wherein $R_{12}$ and $R_{13}$ are independently selected from hydrogen, acyl, 1,3,5-triazin-2-yl, alkylene-X-Y, arylene-X-Y, or substituents represented by $R_1$; wherein $R_{14}$ and $R_{15}$ are independently selected from hydrogen, lower alkyl, lower alkoxy, halogen, acylamino, aryloxy, alkylthio, arylthio, carbalkoxy, cyano, -O-alkylene-X-Y, -O-arylene-X-Y, -S-arylene-X-Y, -O-alkylenearylene-X-Y, -O-alkylene-O-arylene-X-Y, or 1,3,5-triazin-2-ylamino; wherein $R_{16}$ and $R_{17}$ are hydrogen or one or more groups selected from lower alkyl, lower alkoxy, carbalkoxy, halogen, cyano, unsubstituted or substituted sulfamoyl, alkylsulfonyl or -X-Y; wherein $R_{18}$ is selected from hydrogen, lower alkyl, aralkyl, aryl, alkoxy, cyano or unsubstituted or substituted sulfamoyl; wherein $R_{19}$ is selected from hydrogen, lower alkyl, lower alkoxy, carbalkoxy, halogen, 1,3,5-triazin-2-ylamino, naphtho[1,2-d]triazol-2-yl, pyrazalo[3,4-d]1,2,3-triazol-2-yl, benzotriazol-2-yl or halogen; wherein $R_{20}$ is selected from hydrogen or lower alkyl; wherein $R_{21}$ is selected from hydrogen, alkyl, alkoxy, halogen or -X-Y; wherein $R_{22}$ is selected from hydrogen, cyano, carboxylate ester, alkylsulfonyl, acyl, unsubstituted or substituted sulfamoyl, unsubstituted or substituted carbamoyl, —$SO_2(R_1)Y$, or —$CON(R_1)Y$; wherein $R_{23}$ is selected from -X-Y; wherein $R_{24}$ is selected from hydrogen, lower alkyl, lower alkoxy or halogen; wherein $R_{25}$ is selected from 1,4-phenylene; 1,4-phenylene substituted with lower alkyl, lower alkoxy, halogen, cyano, carboxylate ester, unsubstituted or substituted carbamoyl or alkylsulfonyl; biphenylene; terphenylene; dibenzofuran-3,8-diyl; 1,3,4-oxadiazol-2,5-diyl; 1,3,4-thiadiazol-2,5-diyl; naphthalene-1,4-diyl; wherein $R_{26}$ and $R_{27}$ are independently selected from phenyl or phenyl substituted with one or more groups selected from hydrogen, lower alkyl, lower alkoxy, halogen, cyano, hydroxy, amino, amino substituted optionally substituted with alkyl, cycloalkyl or phenyl; 1,3,5-triazin-2-yl; -O-alkylene-X-Y; -O-arylene-X-Y; -S-alkylene-X-Y; -O-alkylenearylen-X-Y; unsubstituted or substituted sulfamoyl; unsubstituted or substituted carbamoyl; or -X-Y; wherein;

Ar is one or more fused aromatic moieties selected from naphthalenes, acenaphthenes, anthracenes, phenanthrenes, perylenes, fluorenes, triphenylenes, pyrenes, chrysenes, naphthacenes, 1,2-benzanthrenes, 2,3-benzanthracenes, 1,12-benzoperylenes, 3,4-benzopyrenes, 4,5-benzopyrenes, decacylenes, carbazoles, indoles, 2,3-benzofurans, dibenzofurans, 2,3-benzothiophenes, dibenzothiophenes, dibenzothiophene dioxides, phenothiazines, phenoxazines or non-fused polyaromatic moieties selected from biphenyls, terphenyls, quaterphenyls, or binaphthyls; wherein $R_{28}$ and $R_{29}$ are independently selected from hydrogen; lower alkyl; lower alkoxy; acyl; halogen; cyano; hydroxy; amino; amino substituted optionally substituted with alkyl, cycloalkyl, or phenyl; 1,3,5-triazin-2-yl; -O-alkylene-X-Y; -O-arylene-X-Y; -S-alkylene-X-Y; -O-alkylenearylen-X-Y; unsubstituted or substituted sulfamoyl; unsubstituted or substituted carbamoyl or -X-Y; with the proviso that at least one -X-Y group be present in the structure.

34. A composition of matter of claim 33 wherein said tagging compound is selected from 2-arylbenzazoles of the following structure:

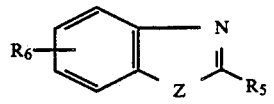

wherein:

$R_5$ is an electron rich aromatic moiety selected from the following structures:

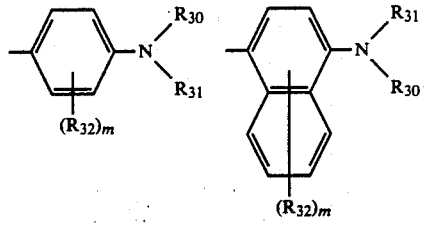

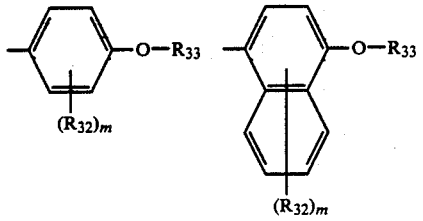

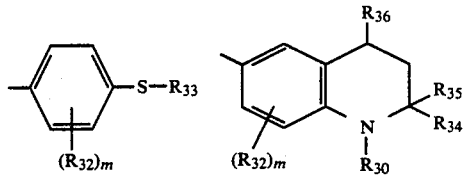

-continued

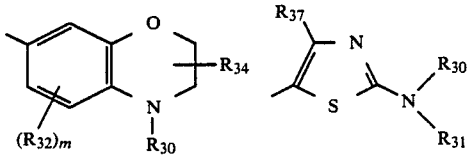

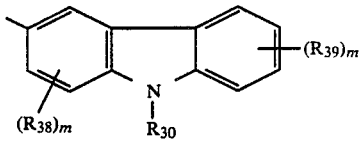

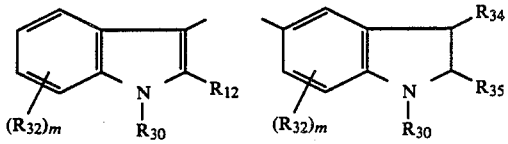

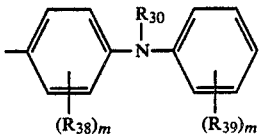

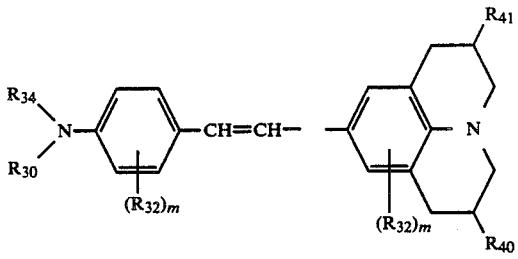

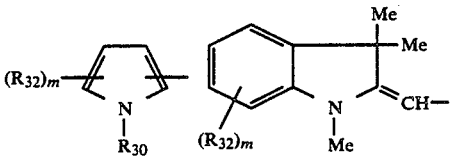

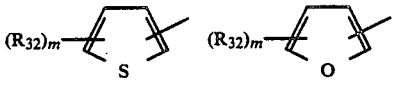

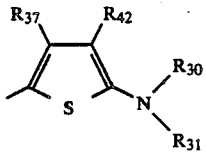

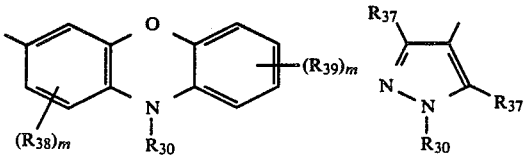

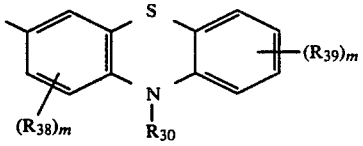

-continued

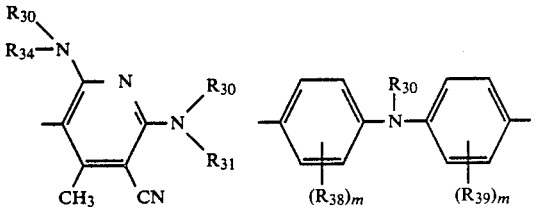

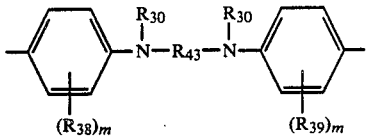

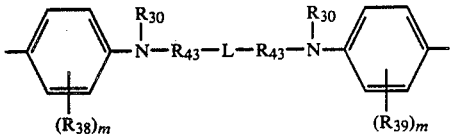

wherein:

$R_{30}$ and $R_{31}$ are selected from hydrogen, Y, straight or branched lower alkenyl; cycloalkyl; cycloalkyl substituted with hydroxy, alkoxy, halogen or alkanoyloxy; phenyl; phenyl substituted with one or more groups selected from lower alkyl, lower alkoxy, halogen, hydroxy, alkanoylamino, carbalkoxy, carboxy, cyano, alkylanoyloxy or -X-Y; straight or branched chain alkyl of 1–12 carbons and such alkyl substituted with one or more of the following: -X-Y, groups of the following formula:

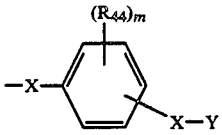

or

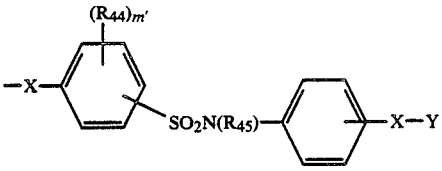

wherein $R_{44}$ is selected from hydrogen, lower alkyl, lower alkoxy, halogen, or lower alkanoylamino; cycloalkyl; cycloalkyl substituted with hydroxy, alkoxy, halogen, or alkanoyloxy; phenyl; phenyl substituted with lower alkyl, lower alkoxy, halogen, alkanoylamino, carboalkoxy, carboxy, hydroxy, carboalkoxy, cyano, or alkanoyloxy;

groups of the formula: $—OR_{45}$, $—SO_2R_{46}$, $—CON(R_{45})(R_{47})$, $—SO_2N(R_{45})(R_{47})$, $—N(R_{45})SO_2R_{46}$, $—O—X'—R_{46}$, $—SR_{48}$, and $—SO_2C_2H_4SR_{46}$;

$R_{45}$ and $R_{47}$ are selected from hydrogen; lower alkyl; lower alkyl substituted with hydroxy, acyloxy, halogen, cycloalkyl, alkoxy, or phenyl; cycloalkyl; phenyl substituted with lower alkyl, lower alkoxy, halogen, hydroxy, alkanoylamino, carbalkoxy, carboxy, cyano, or alkanoyloxy, wherein $R_{46}$ represents the same substituents listed for $R_{45}$ and $R_{47}$ excepting hydrogen, X' is selected from —CO—,—COO—, or —CON($R_{45}$)—; wherein $R_{48}$ is selected from the groups listed above for $R_{45}$ and $R_{47}$ plus benzothiazolyl, benzimidazolyl, pyridyl, pyrimidinyl, 1,3,4-thiadiazolyl, 1,3,4-oxadiazolyl, naphthyl, or triazolyl;

cyano, halogen, 2-pyrrolidino, phthalimidino, vinylsulfonyl, acryamido, -o-benzoylsulfonimido, groups of the formula:

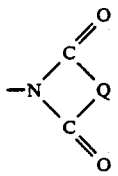

wherein Q is lower alkylene of 1-3 carbons; lower alkylene substituted with hydroxy, halogen, alkoxy, or acyloxy; vinyl; 1,2-phenylene; 1,2-phenylene substituted with lower alkyl, lower alkoxy, halogen, carboxy or carbalkoxy; 1,2-cyclohexylene; —O—$CH_2$—; —$CH_2OCH_2$—; —S—$CH_2$—; —N($R_{45}$)$CH_2$—; —N($R_{45}$)$CH_2$ $CH_2$— or —$CH_2$N($R_{45}$)$CH_2$—; wherein $R_{30}$ and $R_{31}$ can be a single combined group such as pentamethylene, tetramethylene, ethyleneoxyethylene, ethylenesulfonylethylene, ethylenethioethylene, ethylene-N($R_{45}$)ethylene, ethylene-N(—X'—$R_{46}$)ethylene, or ethylene($SO_2R_{47}$)ethylene which, with the nitrogen to which it is attached, forms a ring:

$R_{32}$, $R_{38}$, and $R_{39}$ are selected from hydrogen, chlorine, bromine, fluorine, iodine, lower alkyl, trifluoromethyl, lower alkoxy, alkoxy substituted with hydroxy, aryl, aryloxy, arylthio, alkylene-Z-Y or -O-alkylene-X-Y;

m and m' are 1 or 2;

$R_{33}$ is selected from hydrogen, or one or two groups selected selected from $R_{30}$ or Y;

$R_{34}$, $R_{35}$, and $R_{36}$ are each independently selected from hydrogen and lower alkyl;

$R_{37}$ is hydrogen, lower alkyl, halogen, aryl, or -O-arylene-X-Y;

$R_{40}$ and $R_{41}$ are selected from hydrogen, lower alkyl, lower alkoxy, halogen, hydroxy, or acyloxy;

$R_{42}$ is selected from hydrogen, cyano, —$COOR_{45}$, —CON($R_{45}$) ($R_{47}$), —$SO_2R_{46}$, —$COR_{46}$, or —CON($R_2$)-Y;

$R_{43}$ is alkylene; arylene; aralkylene; alkyleneoxy; alkyleneoxyalkylene; alkylene; alkylene substituted with hydroxy, acyloxy, alkoxy, halogen, aryloxy, -X-Y, or -X-arylene-X-Y;

L is a divalent single covalvent bond, —O(C=O)O—, —(C=O)—O— —(C=O)—, —O—, —S—, —$SO_2$—, —N($SO_2R_{46}$)—, —S—S—, —O—(C=O)-alkylene-(C=O)—O—, —O(C=O)-arylene-(C=O)—O—, —O—(C=O)NH-alkylene-NH(C=O)—O—, —O(C=O)NH-arylene-NH(C=O)—O—, —O—alkylene-O-, -O-arylene-O-, cycloalkylene or arylene.

35. A composition of matter of claim 33 wherein said tagging compounds is selected from those of the formulae:

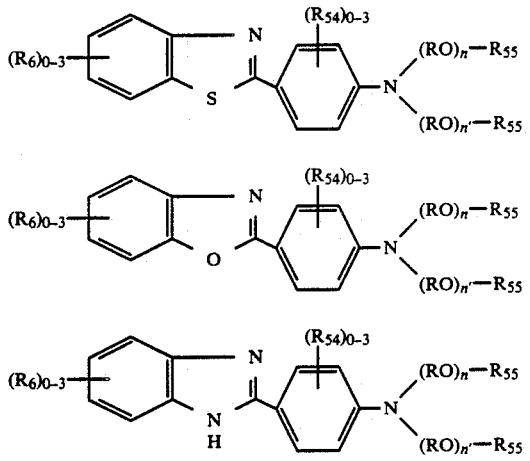

wherein each R is divalent ethylene, propylene, or butylene; each $R_6$ and $R_{54}$ is selected from alkyl of 1-8 carbons, alkoxy of 1-8 carbons, or halogen; each $R_{55}$ is selected from hydrogen, acyl of 1-8 carbons or alkyl of 1-8 carbons; and n+n' is an integer of from about 20 to 200.

* * * * *

UNITED STATES PATENT AND TRADEMARK OFFICE

CERTIFICATE OF CORRECTION

PATENT NO. : 4,992,204 
DATED : February 12, 1991
INVENTOR(S) : Kluger, Edward; Moore, Patrick; Hines, John and Lever, John It is certified that error appears in the above-identified patent and that said Letters Patent is hereby corrected as shown below:

Column 25,
Lines 67-68, after the word "to" delete "-$CH_2CH_2$-, -CH ($CH_3$) $CH_2$-, and -CH ($C_2H_5$) $CH_2$-," and insert -- -$CH_2CH_20$-,-CH ($CH_3$) $CH_20$-, and -CH ($C_2H_5$)$CH_20$- --.

Signed and Sealed this

Seventeenth Day of September, 2002

*Attest:*

JAMES E. ROGAN
*Director of the United States Patent and Trademark Office*

*Attesting Officer*